US006669553B2

(12) United States Patent
Adams

(10) Patent No.: US 6,669,553 B2
(45) Date of Patent: Dec. 30, 2003

(54) NOISE SUPPRESSION AND SOUND PROOF CHAMBER

(76) Inventor: Albert G. Adams, 5975-302 Glen Erin Drive, Mississauga (CA), L5M 5P9

( * ) Notice: Subject to any disclaimer, the term of this patent is extended or adjusted under 35 U.S.C. 154(b) by 0 days.

(21) Appl. No.: 10/321,457

(22) Filed: Dec. 18, 2002

(65) Prior Publication Data

US 2003/0087598 A1 May 8, 2003

Related U.S. Application Data

(63) Continuation-in-part of application No. 09/785,400, filed on Feb. 20, 2001, now abandoned.

(51) Int. Cl.[7] ..... F24F 13/00; F24F 7/00
(52) U.S. Cl. ..... 454/237; 454/252
(58) Field of Search ..... 454/237, 251, 454/252; 428/34.1; 49/475.1; 52/144; 342/1, 5; 455/228

(56) References Cited

U.S. PATENT DOCUMENTS

| | | | | | |
|---|---|---|---|---|---|
| 4,167,598 | A | * | 9/1979 | Logan et al. | 428/34.1 |
| 4,233,780 | A | * | 11/1980 | Royce et al. | 49/475.1 |
| 4,368,539 | A | * | 1/1983 | Whidden | 455/166.1 |
| 4,761,055 | A | * | 8/1988 | Hatje | 359/530 |
| 4,805,231 | A | * | 2/1989 | Whidden | 455/228 |
| 5,095,311 | A | * | 3/1992 | Sajiki et al. | 342/1 |

FOREIGN PATENT DOCUMENTS

| | | | |
|---|---|---|---|
| FR | 2 636 994 A1 | * | 3/1990 |
| JP | 3-252200 | * | 11/1991 |
| JP | 7-59870 | * | 3/1995 |
| JP | 8-37393 | * | 2/1996 |
| JP | 9-4083 | * | 1/1997 |
| JP | 11-148186 | * | 6/1999 |

* cited by examiner

*Primary Examiner*—Jiping Lu
(74) *Attorney, Agent, or Firm*—Marks & Clerk

(57) ABSTRACT

The present invention relates primarily to the provision of a Sound Proof Chamber (10), and optionally also relates to an Electronic Surveillance Bug Proof Chamber. Both embodiments comprise a sealed cavity located within all walls, roof, and optionally the floor surfaces of said chamber, which cavity is kept under a Partial Vacuum. The type of chamber which is fabricated is dependent on its intended use. For example, in high level applications, an additional combination of absorbing acoustic, and radio frequency blocking surfacing, and electronic sounds detector can be used to further restrict or detect the transmission of sounds within said enclosure. In lower level applications, the vacuum cavity may have sufficient noise suppression capability. The chamber is of the present invention is preferably manufactured using modular components in an assembly kit form in order to provide the consumer with a variety of chamber shapes, colors and incremental sizes.

16 Claims, 24 Drawing Sheets

(10)

(10)

(70)

TYPICAL INTERNAL & EXTERNAL SHEET DECKING CAVITY SURFACE

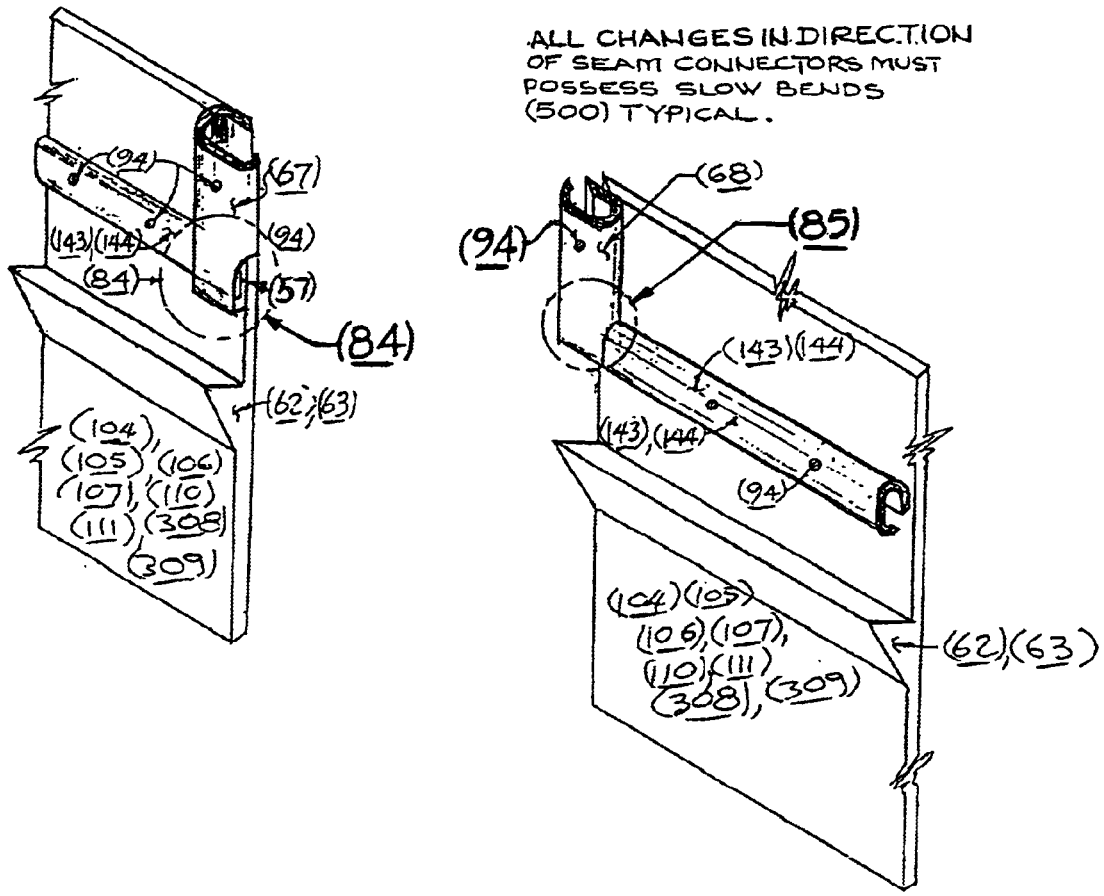
Fig. 34
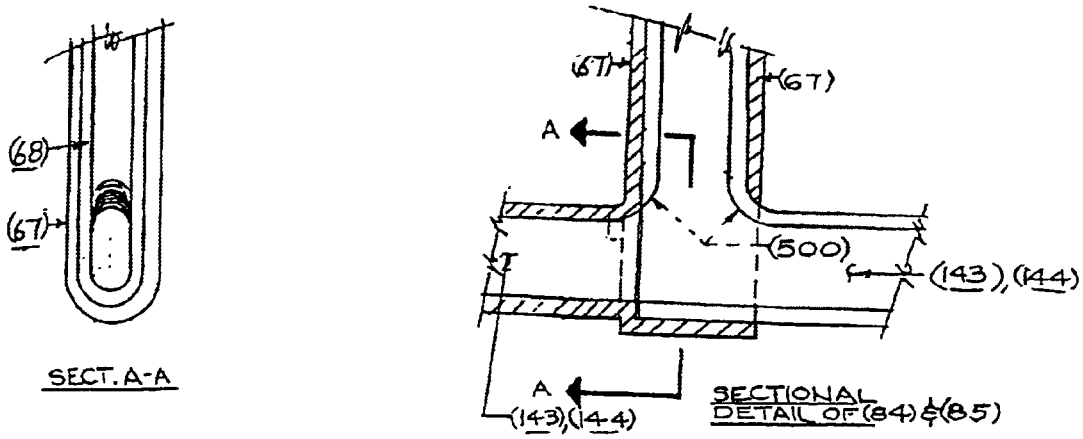

(325) CONSOLE CONTROL PANEL
(SURFACE MOUNTED)

(412)

NOISE SUPPRESSION AND SOUND PROOF CHAMBER

This application is a continuation-in-part of Ser. No. 09/785,450 filed on Feb. 20, 2001 now abandoned.

FIELD OF THE INVENTION

The present invention relates to the field of isolation chambers, and in particular, relates to chambers which are isolated from sound or other electronic or electronic "bug"-type surveillance.

BACKGROUND OF THE INVENTION

The prior art in this area describes a variety of different types of sound proof chambers. The conventional approach in the construction of sound proof chambers is to combine materials possessing acoustic damping properties (to be used as finishes) with thick materials which offer high resistance to vibration. These damping materials can also be incorporated within the cavity walls of conventional enclosures. The resultant devices provide some sound reduction, but additional sound proofing can be desired.

The use of vacuum conditions in the walls of a structure has been described, for example in a railcar, as described in U.S. Pat. No. 4,935,599, issued Jun. 19, 1990 to Babin et al. in which the walls of the railcar are kept under a partial vacuum. However, this vacuum is established more for the flow of air from the chamber, rather than for its sound proofing ability. Further, the railcar is a large structure which is not suitable for setting up or movement within, for example, the various rooms of a house or business location.

Further, technology is known for detecting electronic bugs or electronic surveillance. Whidden, for example, in U.S. Pat. No. 4,368,539 provides a frequency scanning means for detecting eavesdropping. However, no reference is made to the use of this technology in an isolation chamber-type application.

As such, it would also be desirable to provide such a chamber which has a modular construction allowing the chamber to be easily set up in a variety of configurations, sizes and locations. Accordingly, such a chamber would provide an improvement over chambers relying on the acoustic insulation approach, or the railcar system of Babin et al.

Definitions

In the following specification, the terms used are to be accorded the definitions as set out hereinbelow.

The invention is basically manufactured to perform at least one of two separate functions and will be differentiate by their model numbers "Mark I" & "Mark II" respectively. The significant difference between both models is that Mark II is an enhancement of Mark I.

In particular, in the preferred embodiments, the THINK TANK Mark I, is a structurally designed manufactured and assembled Sound Proof Chamber. The THINK TANK Mark II is a structurally designed manufactured and assembled Sound Proof Chamber as well as an Electronic Surveillance Bug Proof Chamber.

It should be noted, however, that unless stated otherwise the invention for which letters patent is being applied for is referred to throughout this application package as "Chamber", "Enclosure" or "THINK TANK" is deemed to mean those characteristics referring to THINK TANK Mark I.

"Embodiment" is deemed to mean either THINK TANK Mark I or THINK TANK Mark II or any part or parts thereof depending upon the respective context in which the said word is used.

"MODULE" refers to any single entity which must be collectively assembled in numbers so as to form a single wall floor or roof component side.

"A COMPONENT SIDE" means any one complete side of the present embodiment, such as, for example, the roof in it's entirety might be a component side. Additionally, any one of the three walls comprising one leg each of both corner wall modules and a required number of intermediate modules relative to the overall size of the enclosure. This constitutes one complete component side. Further, the door opening component unit with the door module including one leg each of both corner wall modules a required number of intermediate modules relative to the overall size of the enclosure. This constitutes the door component side. Yet further, a component side might be the floor in it's entirety.

"A COMPONENT MEMBER" means the required number of intermediate modules joined together along their longitudinal sides, including for example, with respect to the roof component side, less both roof end modules, with respect to the wall component sides, less one leg each of both corner wall modules, and with respect to the floor component side, less both floor end modules.

"A COMPONENT UNIT" means a single member unit integrally formed and molded to a size which is equal to that of it's component member counterpart. This applies for any of the roof, wall or floor component members.

"Internal and External" whenever used in context with "Sheet Decking" always refers to the interior and exterior locations respectively of the sound proof chamber.

The depth of the cavity, being the space between an inner and outer wall of the component sides, of all modules and component units can vary depending on the desired design structure, but is preferably between 50 mm and 300 mm, more preferably between 100 mm and 200 mm, and most preferably is about 150 mm (approximately 6").

Because of the modular nature of the components of the device of the present invention, it will be possible to form a combination of intermediate module and component units together with corner wall modules within the assembly of one and the same enclosure, and thus form complete component sides of various sizes, in accordance with the component sizing schedule.

Modules may be formed and molded in multiple sizes, preferably to a maximum width of that of one component unit.

The modules can be fabricated from any suitable material, but preferably are made from plastic. These plastic modules may be formed and molded in multiple sizes of incremental widths to a maximum width of that of one component unit for roof, wall or floor component sides.

It is to be noted, however, that all measurements and other design selection features are described without their actual quantity being necessarily specified. The components and materials used are also subjected to working stresses and hence must be suitably structurally designed prior to manufacture.

Each and every entity within this documentation that is provided for the said purpose of providing structural strength and rigidity to the said sound proof enclosure must be chemically and structurally designed and calculated in order to, for example, derive the correct polymerization of compounds of the plastic materials. Structural designs must also be effected so as to obtain the correct sizing and quantifying and some configuration changes to various entities might be required in order to obtain optimum structural stability within the said enclosure. Further, allowance should be made to accommodate additional entities, such as plastic entities, with respect to both their shape and size, solely for the purpose of ensuring adequate structural stability. Among such entities are deemed to be any or all of the following, namely: all stiffener ribs; roof bearing ribs; under wall support ribs; buttresses; stiffener flanges; lateral stabilizing ribs; or, structural stiffener braces.

DESCRIPTION OF THE INVENTION

The principal object of the present invention relates primarily to the provision of a Sound Proof Chamber. A further object to the present invention is to provide an Electronic Surveillance Bug Proof Chamber; the latter object being an enhancement of the former embodiment.

The aforesaid is conceived on the principle that the propagation of audible sound is nonexistent within a vacuum environment. By creating an enclosure with both the inner and outer surfaces of all it's boundaries so sealed, a continuous cavity is formed within it's component sides. By applying a significantly high vacuum pressure of specified value within it's cavity, the transmission of audible sounds from either side of said enclosure will be restricted. Preferably, the vacuum applied to the cavity will be such that the air pressure within the cavity is maintained at a level of less 90%, and more preferably less than 50% of standard atmospheric pressure. Yet more preferably the air pressure is less than 25%, and still more preferably, less than 10% of standard atmospheric pressure. Lower pressures (also, higher vacuums) are desired to lower sound transmission, and thus most preferably, the air pressure within the cavity is lowered to less than 1% of standard atmospheric pressure, where possible. It may also be observed, however, that by overcoming those problems that present themselves while satisfying these requirements, that only the desired resistance to the transmission of air bourne sounds will be satisfied. The reason being that there are two mediums that are present to transmit sound one is the air from within the cavity and the other is the material from which the chamber is made. In the case of engine or machinery installation within the enclosure, transmission resistance to impact vibratory noises will be met by mounting the equipment on approved vibration damping means. Provision will be made to remove the exhaust gases from the enclosure and building via the muffled exhaust system of the aforementioned equipment. The resistance to the transmission of impact sounds, which can also be propagated from within the chamber, and caused by, for example, objects hitting the internal surfaces of the enclosure must also be contended with. To a lesser extent, there is also the actual transmission of air bourne sounds being transmitted within the preferred plastic material of which the enclosure is made. Steps are taken in order to overcome this problem by creating discontinuity within the internal stiffener rib assembly by forming stiffener ribs independently of interior and exterior sheet decking of the enclosure and providing all their contact areas with an approved rubber gasket seating cushion. The provision of an approved high acoustic finishes to all internal surfaces following assembly, also aids in noise suppression.

Accordingly, in a first aspect, the present invention provides a sound transmission restricting chamber for reducing the transmission of sound between the outside of said chamber and the inside of said chamber, comprising a plurality of interconnected modular components which essentially surrounds an area in order to form said chamber, wherein a plurality of said modular components comprise an inner wall surface, an outer wall surface, an edge frame structure jointing said inner wall surface to said outer wall surface, which edge frame structure extends around the perimeter of said modular component, wherein a cavity is formed between said inner and said outer wall surface, and wherein said edge frame includes a seal for sealing one component to an adjacent second component, and each edge frame comprises at least one depressurization opening which can be positioned operatively adjacent to a depressurization opening on an adjacent edge frame from an adjacent modular component to interconnect said modular components, whereby air can be simultaneously extracted from at least two of said modular components in order to establish at least a partial vacuum within the cavities of said interconnected modular components.

DETAILED DESCRIPTION OF THE INVENTION

This invention may be found useful in order to accommodate a specific number of individuals, such as within a business environment, who so choose to convene in order to discuss issues of a sensitive and private nature such as mergers and other business ventures of which the enhancement to the basic embodiment will prove most favorable. The enclosure may also be found useful in the domestic environment, such as, for example, where a musical band convenes for practice sessions.

In order for the embodiment to function in the prescribed manner it is of paramount importance that the jointed seals created between adjacent modules and component units also component sides not be broken nor modules punctured. If this feature is violated then there will be a total or partial loss in vacuum pressure which will result in a direct violation of the principle upon which the functionality of the invention is based. At this point repairs must be effected by first locating the fracture by means of an ultra sound leak detection device or some other detection device.

In a first preferred embodiment of the invention, the "THINK TANK" is intended to be assembled within an existing room. The room in which the preferred embodiment is intended to be installed within is one which will be typically equipped to withstand external weathering of excessive sunlight, wind, snow and rain, and possess within it's members, load bearing roof walls and floor. The "THINK TANK" is not generally expected to withstand any external loading such as objects placed upon or leaning against it's component sides and as such will not be expected to support any objects on it's roof walls and door component sides except it's floor component side only which will support the loading of it's roof and walls, and also the loading from the occupants and optional furniture placed within.

The THINK TANK will preferably be manufactured and assembled with a focus on achieving optimum economic as well as functional efficiency. As such, construction from low cost, high strength materials, such as plastic materials is preferred. Accordingly, the chamber is preferably manufactured while utilizing principles and practices of plastic molding processes that is currently available. The modules and component units will preferably be molded and formed in a variety of chosen colors and in accordance with configurations as exemplified in the accompanying drawings. The method of manufacture of all modules and component units will be a combination of prefabrication and assembly of integrally formed and molded elements.

Because the enclosure is typically to be installed within an existing building it will commonly be dependent on the surrounding main structure's electrical power as well as it's HVAC (heating, ventilation, and air conditioning) supplies for these services. HVAC will be extracted from the confines of the existing room in which the THINK TANK is installed and will utilize and control the treated air as it is received within the said existing building. The THINK TANK'S air exchange system will function as a combination inflow and, extract ventilation system while controlling the inflow of fresh air as required from the outer room and expelling the stale air at a different location from that of it's intake within it's building envelope.

Expected Properties and Performance of all Material

Although a number of materials may be used for construction, the modules and component units are all fabricated from plastic materials, and preferably all such plastic entities will be preferably formed and molded of an approved plastic material as herein described. They are preferably integrally formed and molded within their respective unit members via the use of an appropriate and approved synthetic organic polymeric resin of suitable composition which may be thermoplastic or thermosetting. Said modules component units and all other plastic parts must be structurally designed so as to exhibit appropriate thicknesses and numbers of all members relative to the most suitable polymeric combination available in order to withstand the stresses to which each member will be subjected. The required number of internal stiffener ribs within the modules and component units must also be provided in order to provide sufficient structural rigidity. This must be done in accordance with the predetermined composition and properties of the plastic to be used. This should be done in order to satisfy the required working stresses that will be imposed upon the enclosure subsequent to it's assembly while subjected to a specified partial vacuum pressure and imposed loading caused by human occupancy throughout it's life expectancy.

Copolymerization of plastic may be utilized to provide a material which possess the following characteristics, namely: (i) the plastic material to be used for the manufacture of modules and component units and all other plastic parts as shown in the drawings, for example, must be durable and strong; (ii) the material must display resistance to cracking brittleness or tearing either due to impact or working stresses; (iii) the plastic must also possess the ability of non deformity due to shrinking or creeping with minimum sagging between supports following assembly; and (iv) they must be adequately structurally designed and manufactured so as to meet all the requirements that are expected of them in order to withstand all compressive and tensile stresses that will be imposed upon their members without a significant display of structural deformity that may result from sagging or by vacuum pressure. Further, the material should display a significant degree of resilience and rigidity. All above characteristics are typically desired in order to overcome the working stresses to which the enclosure will be subjected throughout the working life expectancy of the enclosure.

All of the preferably rubber gaskets seating cushion used for sealing of the components of the device of the present invention are to be formed of a quality and degree of density to display non deformity and non shrinking nor splitting while subjected to compressive working stresses. The quality of rubber must also display resilience and resistance to dry rot or crystallization or any other forms of breakdown throughout it's life expectancy. The gaskets must possess the ability to offer a significant increase in resistance to the transmission of sound when used as a cushion between adjacent plastic members. When subjected to compressive working stresses the gasket should not function as a medium for the transmission of sound from one member to another.

The specified Jointing Sealant is preferably of the Thermoplastic type or an equivalent thereof. This includes for example a plasticized filler which is used for sealing adjacent modules during the assembly process. This material must possess the ability to flow within the formed core of the jointed seam connectors via a high pressured pneumatic glue gun at high temperature while filling the inner surface of the seams. The sealant should possess the ability to melt at a specified temperature and to completely and continuously spread and fill the cavity within the jointed seam connectors without the presence of air pockets while displaying a high degree of continuous adhesive bonding and sealing throughout it's adjacent surfaces. On cooling the melt must be strong, It must display resilient elasticity durability and resistance to shrinkage and cracking. All the above qualities are expected of the approved sealant in order for the approved thermoplastic or equivalent sealant to withstand the working stresses imposed upon jointed seams due to fatigue during usage and working stresses imposed due to the specified vacuum pressure. All Jointed Seam Connectors will be provided with Air Vents in order to expel air as the heated pressurized melt rushes within the seamed cavity as the injection sealing process progresses.

Details of the Enclosure Fabrication

The following comments are made in respect of one preferred embodiment of the present invention. However, it will be understood that modifications can be made to this design which will still fall within the scope of the present invention.

The modules and component units will be assembled to form floor walls and roof component sides respectively. Each component side of the aforesaid invention consists of a series of modular members collectively connected to each other along their longitudinal sides as said modular members range in incremental sizes the larger comprising a single component unit member. For example, reference can be made to the component sizing schedule provided hereinbelow. The enclosure may be assembled within an existing room that is slightly larger than the enclosure. It may also be assembled within a room that is much larger than the enclosure itself. Whichever location is desired the method of assembly will be virtually the same. The modules and component units will be molded and formed in a variety of chosen colors and in accordance with configurations. The method of manufacture of all modules and component units will be a combination of prefabrication and assembly of integrally formed and molded elements.

Because the enclosure is typically to be installed within a building it will be dependent on the surrounding main structure's electrical power source. HVAC within the building will also be implemented for some low level applications. The THINK TANK'S air exchange system for the most part will preferably function as an air revitalization system in accordance with the Photocatalyst Technology or equivalent, which will function independently of the HVAC system within the building.

BRIEF DESCRIPTION OF THE DRAWINGS

Embodiments of this invention will now be described by way of example only in association with the accompanying drawings in which:

FIG. 34—Displays a pictorial view of a typical male longitudinal jointed seam connector element and male horizontal seam connector element junction. Also a female longitudinal jointed seam connector element and male horizontal seam connector element junction prior to assembly of both units.

Figure 4:
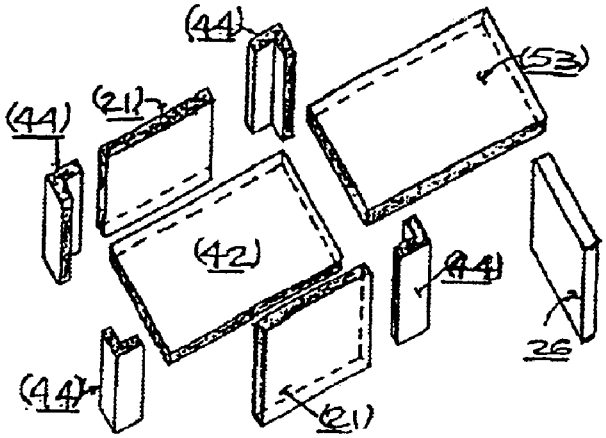
FIG. 4—Depicts an exploded view of FIG. 1 depicting the enclosure in it's component unit form prior to assembly.

With respect to the drawings, the following listing is provided as a guide to the identification of the majority of the various components shown in the drawings, namely:

(10) SOUND PROOF ENCLOSURE
(20) ONE FLOOR COMPONENT SIDE
(22) TWO SIDE WALL COMPONENT SIDES
(21) ONE DOOR COMPONENT SIDE
(23) ONE ROOF COMPONENT SIDE

(26) ONE REAR WALL COMPONENT SIDE
(30) MISCELLANEOUS ACCESSORIES
(40) TWO FLOOR END MODULES
(41) FLOOR INTERMEDIATE MODULE
(42) FLOOR COMPONENT UNIT
(43) FLOOR COMPONENT MEMBER
(44) WALL CORNER MODULES
(45) DUMMY DOOR COMPONENT UNIT
(46) WALL COMPONENT UNIT
(47) WALL COMPONENT MEMBER
(48) WALL INTERMEDIATE MODULE
(49) DOOR OPENING COMPONENT UNIT
(50) DOOR MODULE
(51) ROOF END MODULES
(52) ROOF INTERMEDIATE MODULE
(53) ROOF COMPONENT UNIT
(54) ROOF COMPONENT MEMBER
(60) Inner Female Fastener Track
(61) Outer Female Fastener Track
(62) Inner Male Fastener Track
(63) Outer Male Fastener Track
(65) Outer Female Horizontal Seam Connector Element
(66) Inner Female Horizontal Seam Connector Element
(67) Female Longitudinal Jointed Seam Connector Element
(68) Male Longitudinal Jointed Seam Connector Element
(69) Raised and Fielded Panel
(70) Structural Stiffener Braces
(71) Transverse Deflection Stiffener
(72) Longitudinal Deflection Stiffener
(73) Transverse End Enclosure Strip
(74) Longitudinal Stiffener Rib
(75) Transverse Stiffener Rib
(76) Rubber Gasket Seating cushion
(77) Intersecting Rubber Connector
(78) Set Square Up-Stand Register
(79) External Female Fastener Buttress
(80) Internal Female Fastener Buttress
(81) Under Wall Support Rib
(82) Lateral Stabilizing Rib
(83) Intermediate Internal Sheet Decking Sealing Strip
(84) Female Longitudinal Jointed Seam Connector Socket
(85) Male Longitudinal and Horizontal Junction Connector
(86) Pressure Compensating Door Closing Device
(87) Fulcrum Mount
(88) One Closure Fulcrum Pin
(89) One Closure Pivot Pin
(91) Parameter Gasket
(92) Three Tiered Access Opening Closure Strip
(94) Air Vent Holes
(95) Longitudinal and Enclosure Strip
(96) Internal—End Sheet Decking—(Floor & Roof End Module)
(97) Intermediate Internal Sheet Decking—(Floor & Roof Intermediate Module)
(98) External—End Sheet Decking—(Floor & Roof End Module)
(99) Intermediate External Sheet Decking—(Floor & Roof intermediate Module)
(100) Rib Stiffener Flange
(101) Two U-Shaped Transverse Ends Enclosure Channels
(102) Component Unit External Sheet Decking—(Floor & Roof Component Unit)
(103) Component Unit Internal Sheet Decking—(Floor & Roof Component Unit)
(104) Wall Corner External L-Shaped Sheet Decking—(Wall Corner Module)
(105) Wall Corner Internal L-Shaped Sheet Decking—(Wall Corner Module)
(106) Wall Intermediate—Internal Sheet Decking—(Wall Intermediate Module)
(107) Wall Intermediate—External Sheet Decking—(Wall Intermediate Module)
(108) U-Shaped Web Stiffener Rib
(109) Female Hinge Extender—(Door)
(110) Substantial External Sheet Decking—(Door Opening Component Unit)
(111) Substantial Internal Sheet Decking—(Door Opening Component Unit)
(112) Lintel Vertical Stiffener Ribs
(113) Lintel Horizontal Stiffener Ribs
(114) One Closing Arm
(115) One Tension Arm
(116) Hole Within Door Male Hinge Extender
(118) Door Module Exterior Sheet Decking
(119) Door Module Interior Sheet Decking
(120) Adjustable Slot Door Hinge
(121) Two Male Hinge Extender—(Door)
(122) Two Hinge Pivot Pins—(Door)
(123) Intermediate Door Handles
(124) Four Door Closing Anchor Hooks—(Door)
(126) Root Bearing Ribs
(127) Corrugated Openings—(Stiffener Rib Assembly)
(128) Intersecting Recesses
(129) External Sheet Decking
(130) Triangular External Up-Stand Register
(131) Right Angle Internal Up-Stand Register
(132) Perpendicular Corners—(Raised and Fielded Panel)
(133) Door Lintel
(134) Door Threshold
(135) Door Jamb Portions—(Each Side)
(136) Two Pairs Female Hinge Extenders
(137) Illuminated Sign
(138) Set Square Down Stand Register
(139) Outer Female Fastener Stem
(140) Transverse L-Shaped Stiffener Ribs
(141) Door Module Three Tiered Internal Perimeter
(142) Three Tiered Web Stiffener
(143) Inner Male Horizontal Seam Connector Element
(144) Outer Male Horizontal Seam Connector Element
(153) Substantial Chiseled Shaped End
(154) Dummy Door Component Unit External Sheet Decking
(155) Dummy Door Component Unit Internal Sheet Decking
(158) Transverse L-Shaped End Enclosure Channel—(Wall Corner Module)
(159) Vacuum Pressure Valve
(173) Horizontal Seam Connector Stem
(308) Internal Sheet Decking—(Wall Component Unit)
(309) External Sheet Decking—(Wall Component Unit)
(325) Instrumentation and Control Console Panel
(326) Barometric Pressure Gauge
(327) Vacuum Pressure Gauge
(328) Humidity Gauge
(329) AC Electrical Receptacle
(330) Electrical Lighting Toggle Switch
(331) Timer
(332) AC/DC Electrical Lighting Fixture
(333) "Occupied Sign"
(334) Attenuated Muffler Air Exchange System—Air Revitalizer
(335) External Single Male AC Power Supply Plug
(336) Console Cabinet
(337) Console Cabinet Lock
(338) Cabinet Door—(Control Console Panel)

(339) Air Exchange Controller
(340) DC Electrical Female Outlet Jack
(400) Fine Copper Mesh
(401) Thermoplastic/Thermosetting Stand-Off
(402) Finishing Cap Screws
(403) High Quality Acoustic Sheeting
(404) Thermoplastic/Thermosetting Stand-Off with stud
(405) Heavy Duty Electrical Grounding Cables
(406) Electrical Conductor Retainers
(407) Electrical Conductor with Ground
(408) External Single Male AC Power Supply Plug
(409) Continuous Laminated Sheeting Ply of Equivalent Other features will be described hereinbelow, as appropriate.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Figure 1:
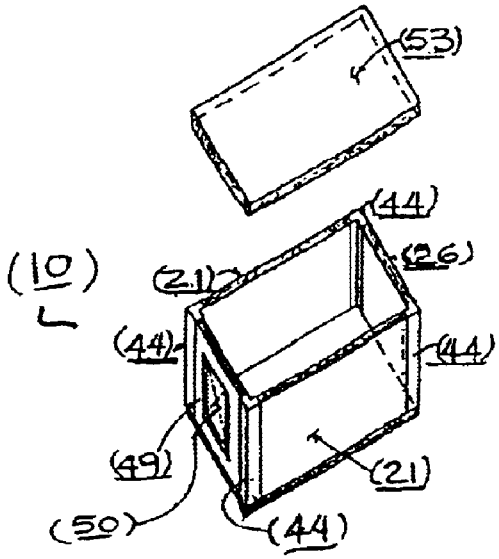
FIG. 1—Displays a partially assembled internal view of the enclosure in it's Component Unit form looking from above to within.
Figure 3:
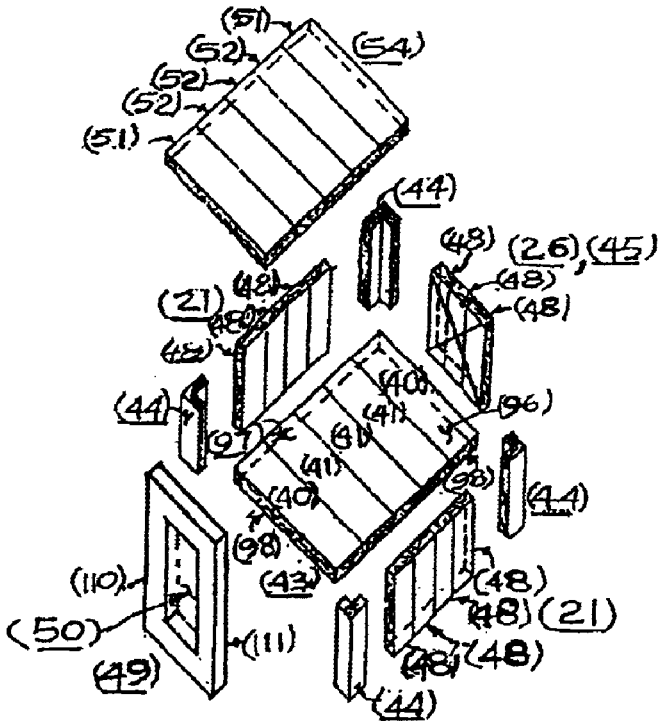
FIG. 3—Illustrates via an exploded perspective view of FIG. 2 the embodiment in it's modular form prior to assembly.
Figure 2:
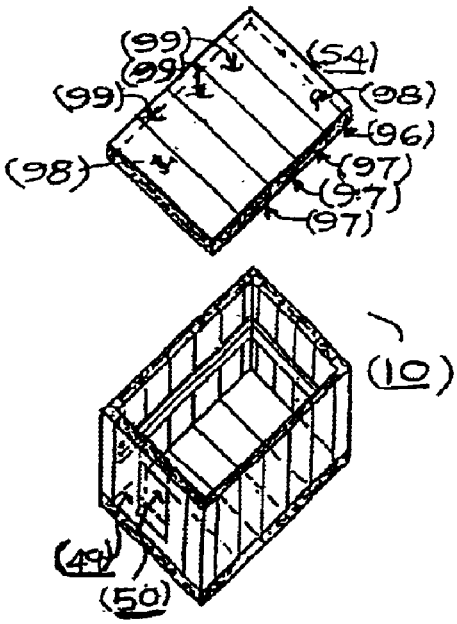
FIG. 2—Shows a partially assembled internal view of the enclosure in it's modular form from above to within.

Referring to the drawings and in particular, FIG. 1 a preferred embodiment of the present invention is illustrated and the reference numeral 10 generally designates the Sound Proof Chamber.

The preferred embodiment comprises the assembly of a series of single modules collectively connected to each other thus forming a component member which is also connected along the longitudinal side to one leg each of two wall corner modules (44) placed at both ends from which each wall component side is formed. The same principle is employed relative to the floor and roof component sides where floor end modules (40) and roof end modules (51) are assembled directly beneath and above the wall corner module (44) respectively. The floor and roof end modules and each leg of the wall corner modules possess one common width measured along their transverse extremities. The dummy door component unit (45) is also equal in size along both it's longitudinal and transverse extremities as that of the door opening component unit and both members are assembled on opposing walls to each other. All modules and component units will possess all female mating elements on one longitudinal extremity of both internal and external sheet decking and all male mating elements on the other longitudinal extremity of both internal and external sheet decking. The only exception is in the case of the roof and floor end modules (40) and (51) and door component units (49) which will be preferably manufactured and assembled with both male or female elements along their longitudinal extremities as alternatives to satisfy assembly demands. Sizes will range from multiple modular to larger single component units. Each of the larger single component units together with one leg each of two wall corner module will also form one wall component side of the present invention. It will be possible to form a combination of modular and component units within the assembly of one and the same enclosure thus forming complete component sides in accordance with the component sizing schedule.

Modular and Component Breakdown

The Sound Proof Enclosure (10) of the present invention preferably comprises a Floor Component side (20) which consists of Two Floor End Modules (40), Floor Intermediate Modules (41)—(Enclosure size dependent), and one Floor Component Unit (42)—(Enclosure size dependent).

A typical Side Wall Component Sides (21)—consists of two Wall Corner Modules (44), Wall Intermediate Modules (48)—(Enclosure size dependent), and Wall Component Unit (46)—(Enclosure size dependent).

A Rear Wall Component Side (26) typically consists of two Wall Corner Modules (44), Wall Intermediate Modules (48)—if necessary (Enclosure size dependent), and a Dummy Door Component Unit (45).

The Door Component side (22) consists of two Wall Corner Modules (44), Wall Intermediate Modules (48)—if necessary (Enclosure size dependent), a Door Opening Component Unit (49) and a Door Module (50).

The Roof Component Side (23) consists of two Roof End Modules (51), Roof Intermediate Modules (52)—(Enclosure size dependent), and a Roof Component Unit (53)—(Enclosure size dependent).

Figure 40:
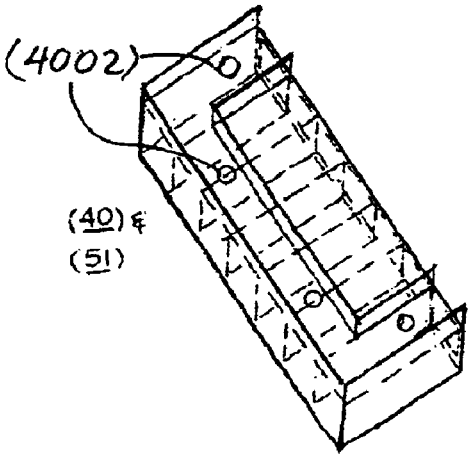
FIG. 40—Displays an isometric view of a typically assembled floor end module (40) which is also identically configured for the roof end module (51) but in an inversely rotated position.
Figure 43:
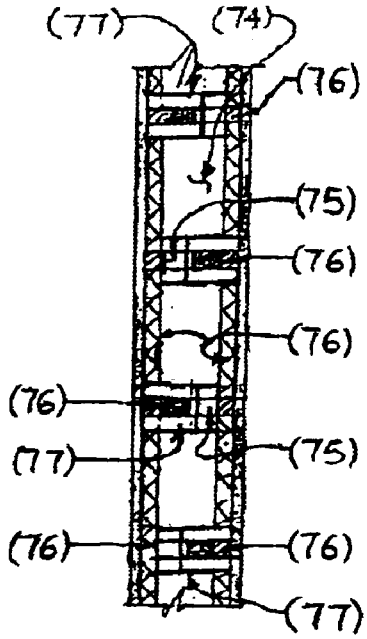
FIG. 43—Depicts a sectional detail of the stiffener rib assembly unit and intersecting rubber connectors (77) in position.
Figure 45:
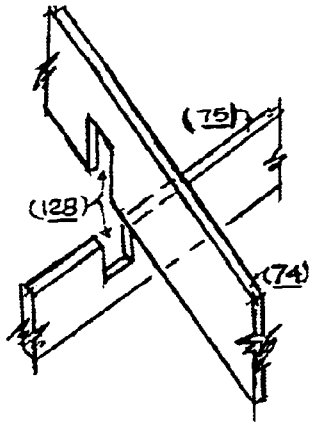
FIG. 45—Reveals a blown up view of the recesses within longitudinal and transverse stiffener ribs.

There are three types of Modules, namely, an End Module, an Intermediate Module, and a Wall Corner Module. The End Module is described in particular in, for example, FIG. 40.

Figure 42:
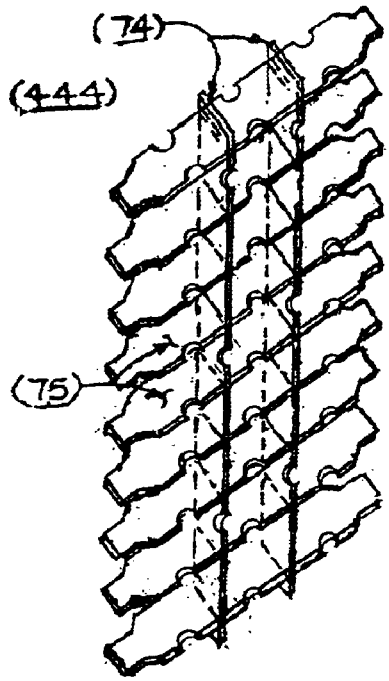
FIG. 42—Shows a typical stiffener rib assembly unit prior to installation.

End modules are rectangular in shape and possess a (6") 150 mm cavity between both internal and external sheet decking. They are applicable for both Floor and Roof component sides and are located at both ends of their respective component sides. They comprise five outer surfaces which are an internal and an external sheet decking and two transverse end enclosure strips and one longitudinal end enclosure strip. The sixth longitudinal side is open for the purpose of joining to an adjacent intermediate module or one component unit or one component member. The width of all end modules measured along its transverse side is of one constant value and is also equal in value to that of each leg of the wall corner module (44). Within each end module is indexed and registered a stiffener rib assembly, as per FIG. 42.

Figure 7:
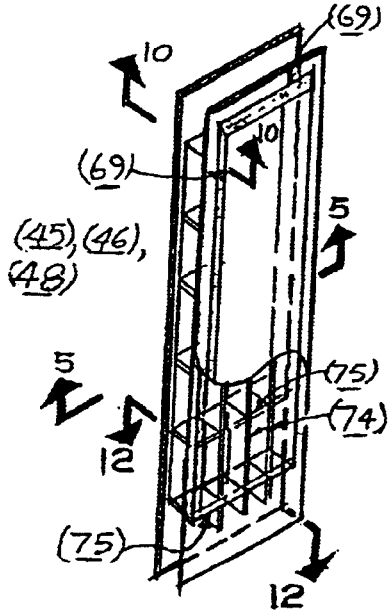
FIG. 7—Depicts a partially open view of a typical wall module or component unit revealing the longitudinal and transverse stiffener rib assembly as seated between both internal and external sheet decking. Transverse cross-sectional axis 5—5 also typical of that of the floor and roof modules and component units. Depicts a wall intermediate module (48) and wall component unit (46).
Figure 30:
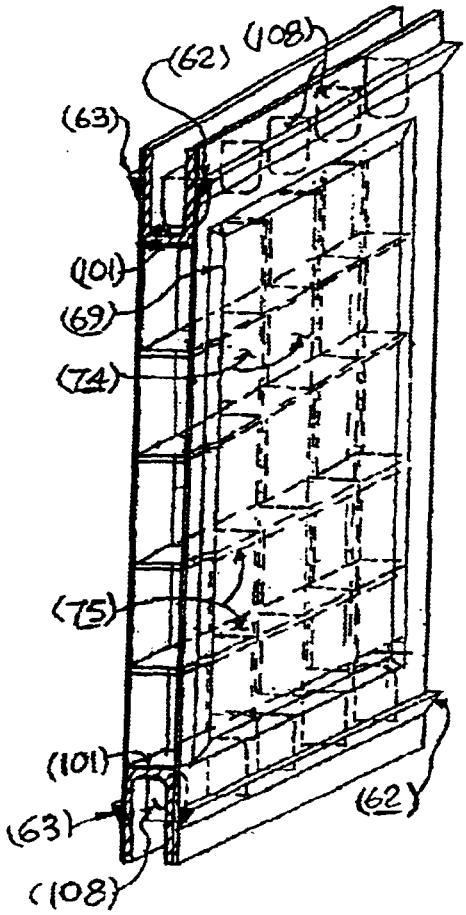
FIG. 30—Reveals an isometric view of a typical wall intermediate and wall component unit in it's assembled form.
Figure 41:
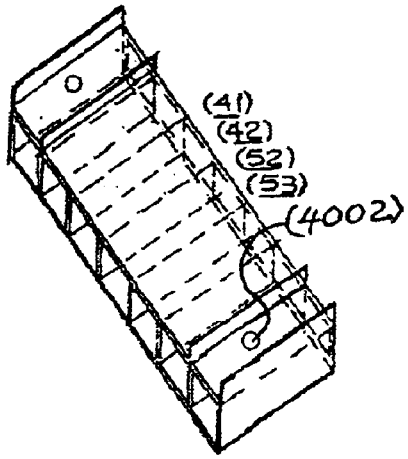
FIG. 41—Displays an isometric view of a typically assembled floor intermediate module and component unit which is also identically configured for the roof intermediate module and component units but in a inversely rotated position.

The Intermediate Modules are shown in particular in FIGS. 7, 30, 41.

Intermediate modules are also rectangular in shape and possess a cavity of (6") 150 mm, in this embodiment, between both internal sheet decking and external sheet decking. Intermediate modules range in sizes the largest of which is a single component unit. They are applicable to all component sides and are collectively joined along their longitudinal extremities thus forming a component member which is equivalent to a single component unit subsequently joined to end modules or corner wall modules at its extremities along their longitudinal edges thus forming floor roof and wall component sides.

Figure 6:
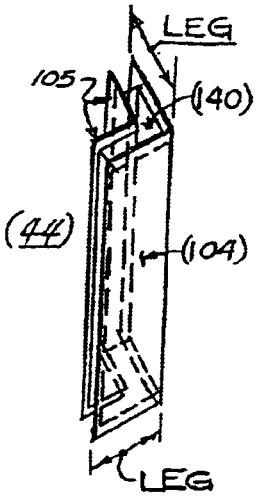
FIG. 6—Displays a pictorial view of a typical wall corner module (44).
Figure 44:
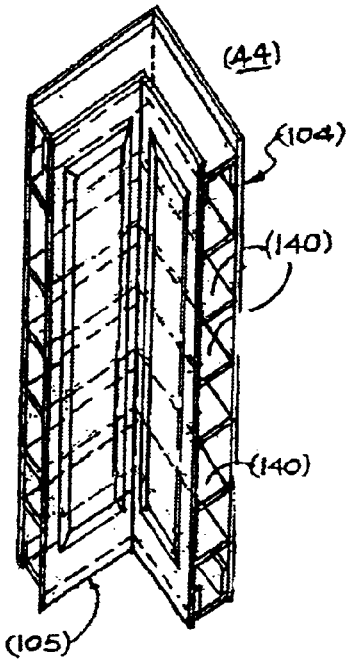
FIG. 44—Reveals a typical wall corner module (44).

The Wall Corner Module (44), best seen in FIGS. 6 and 44, possess a 6" (150 mm) cavity between it's internal sheet decking and external sheet decking. Wall corner modules are substantially L-shaped along it's transverse axis having each of both portions from it's apex referred to as the legs of the wall corner module. Within it's cavity is indexed and registered a substantial L-shaped longitudinal stiffener rib assembly. The distance measured along it's longitudinal extremities represents the internal vertical height of the Enclosure which varies in accordance with the height of the wall component side as per the "component sizing schedule". Both legs measured along it's transverse ends are equal in size and to each other. The length of each leg of the wall corner module measured along it's transverse sides is standard and equal in value to the width of all aforementioned end module.

The Dummy Door Component Unit (45), best seen in FIGS. 7 and 30, is identical in configuration and content to that of a wall component unit. It maintains one constant transverse overall dimension which is always equal to that of the transverse overall width of it's door opening component unit (49) counterpart. Both the dummy door component unit (45) and the door opening component unit (49) are always identical in overall size and installed within opposite walls to each other within the same enclosure.

Each component side may be assembled from a combination of:

For Floor component sides:

Two floor end modules (40) and floor intermediate modules (41).

Two floor end modules (40) and a floor component unit (42)

For two side wall component sides:

Two wall corner modules (44) a wall component member (47)

Two wall corner modules (44) a wall component unit (46).

For Rear wall component side:

Two wall corner modules (44) and a dummy door component unit (45)

Two wall corner modules (44) and wall intermediate modules (48) and a dummy door component unit (45).

For the Door Component Side:

Two wall corner modules (44) and a door opening component unit (49) also one door module (50)

Two wall corner modules (44) and wall intermediate modules (48) and one door opening component unit (49) one door module (50).

For Roof Component Side:

Two roof end modules (51) and Roof intermediate modules (52)

Two Roof end modules (51) and one Roof component unit (53)

The typical module and dummy door module and component unit consists of two sheet decking. One on each side of the module/component unit and referred to as internal and external sheet decking. Between both sheet decking are longitudinal and transverse stiffener ribs. The stiffener ribs are fitted with approved rubber gasket seating cushion (76) which is secured along their edges with an approved adhesive. Transverse stiffener ribs are fitted within longitudinal stiffener ribs with intersecting rubber connectors thus holding both stiffener ribs on edge and in a perpendicularly tight position. The stiffener rib assembly is then indexed and registered upon eight set square up-stand registers that are integrally formed and molded within the inner cavity surfaces of both sheet decking (Four up-stand registers per sheet decking). The outer surface of the rubber gasket seating cushion (76) will be in relaxed contact with the inner surfaces of both sheet decking prior to being vacuum pressurized. On one longitudinal edge on both internal and external sheet decking and the same longitudinal side of the module/component unit is integrally formed and molded one female longitudinal jointed seam connector element (67) on each sheet decking. On the opposite longitudinal side of every module/component unit is also integrally formed and molded within both internal and external sheet decking two male longitudinal jointed seam connector elements (68). One on each sheet decking. All for the purpose of mating with adjoining modules and ensuring a snug fit when connected thus forming jointed seam connectors within which "Melt" is forced in order to form a sealed connection.

Expected Performance of the Enclosure After Assembly

The THINK TANK on completion of assembly will perform in a manner as described herein. The floor component side (20) being the only load bearing component side within the enclosure will sit flush upon a firm flat level and smooth spread foundation such as an existing concrete or well constructed wooden floor. This will significantly reduce the magnitude of flexure within the floor component side when it is subjected to imposed loading caused by frequent usage by it's occupants. Also the weight of furniture loading within. Fatigue resulting from continuous usage will lead to weak seams thus resulting in loss of vacuum pressure from within the cavity of the floor component side.

In addition to a firm floor base and upon the innermost surface of the said floor component side (20) will be laid a double layer of polyurethane sheeting covering from wall to wall and upon these layers will be placed an approved cork sheeting of specified thickness and density or equivalent material (403) of conventional construction. Above and upon this will be laid an approved rigid and strong light weight continuous wall to wall laminated ply wood sheeting or equivalent also of conventional construction and of adequate thickness which is expected to withstand it's maximum loading. This is provided for the purpose of establishing an even distribution of imposed concentrated loading over the entire surface area of the floor component side. The above procedure will greatly reduce the stresses within the aforementioned jointed seam connectors of said floor component side (20). Rubber gasket seating cushion (76) of approved quality will be glued using an approved quality adhesive (of conventional construction) to both upper and lower transverse ends of both external and internal sheet decking of all wall component sides (21) and door component side (22) during the assembly process.

The rubber gasket seating cushion (76) is provided in order to form a cushion upon which the upper portion of the enclosure—comprising the aforementioned roof walls and door opening component sides will "sit and ride". Plastic extrusion members in the form of intermediate stiffeners and braces will be structurally designed for correct structural strength to be used in order to stabilize the enclosure and provide lateral restraints to all it's component sides both internally and externally so as to prevent the enclosure from becoming a "mechanism" (a state of structural failure).

The roofing modules and component units will then be assembled and jointed seam connections sealed thus forming the roof component side. All jointed seam connections will be sealed by the use of a preheated pneumatic pressurized gun which is charged with a plasticized filler of an approved quality or equivalent. It should be bourne in mind that during normal use both inner and outer surfaces of all the component sides will be subjected to tensile stresses on account of the high vacuum pressure within their cavities. Following complete assembly and sealing of the jointed seams the enclosure will be expected to display a relative degree of lateral flexibility when subjected to minor lateral forces caused by pushing furniture around against the walls or occupants bracing slightly against the walls of the enclosure. Movement that will be considered relatively normal provided such movement is minimal.

It might be found necessary to employ additional external and internal bracing, a frame work comprising struts, braces and tie members in order to allow for additional stability and support, subject to structural designing analysis as recommended.

Figure 56:
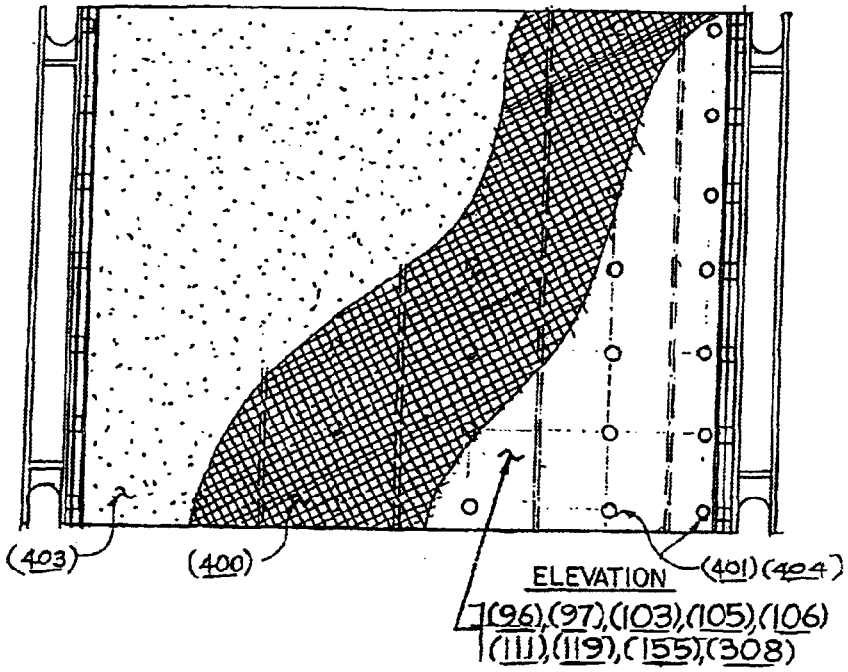
FIG. 56—Shows an elevational view that is unique to THINK TANK—MARK II only.
Figure 55:
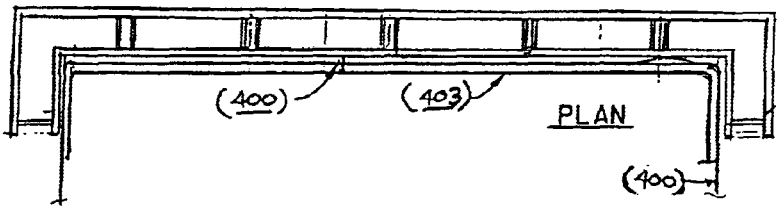
FIG. 55—Illustrates a plan view from top down revealing FIG. 54 within any typical component side.
Figure 54:
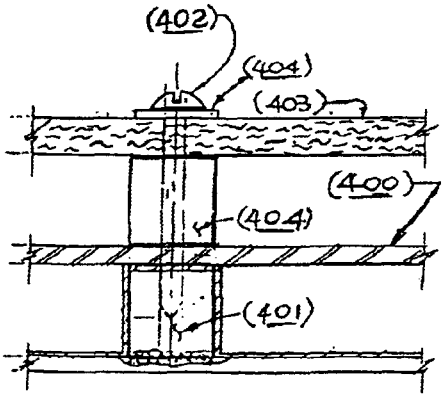
FIG. 54—Reveals a mounting detail unique to THINK TANK—MARK II only. Where copper mesh (400) or equivalent is sandwiched between the internal sheet decking of the enclosure and the approved acoustic sheeting (403).
Figure 57:
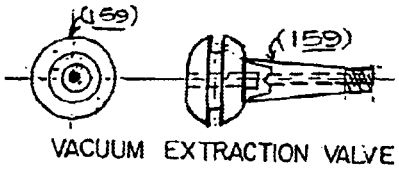
FIG. 57—Illustrates a configuration representing a vacuum extraction valve (159) of conventional construction whose shape is not necessarily as specified.

With particular respect to the THINK TANK—Mark II only, in accordance specifically with FIGS. 54, 55 & 56 which illustrate an approved quality fine copper mesh or equivalent sheeting (400) of conventional construction is to be suspended within all innermost aforementioned walls door and roof component sides to beyond the innermost surfaces of all stiffener braces (70) by means of thermoplastic or thermosetting cylindrical stand-offs (401) which are about 40 mm in diameter. Said stand-offs will be uniformly and integrally affixed to the innermost surfaces of internal sheet decking with an approved bonding solvent. Said mesh or equivalent (400) will be subsequently secured to the stand-offs (401) by means of a second stand-off (404) which is equipped with a threaded stud projecting from one of it's extremities and having a threaded hole in it's opposite end. Said stand-off (404) will be screwed within stand-off (401) which secures said mesh (400) into place. The acoustic sheeting (403) will subsequently be attached to the said second stand-off (404) by means of finishing cap screws (402).

Figure 63:
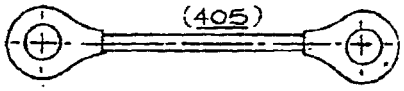
FIG. 63—Illustrates a typical heavy gage ground strap (405).
Figure 58:
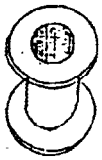
FIG. 58—Is an acoustic collar for installation within a through hole within the roof component side. A ventilation facility.

During assembly of the said mesh (400 ground straps (405) as per FIG. 63 will be used for grounding said mesh (400) of each component side to an external grounding source. The floor component side of said enclosure will have upon it's upper innermost surface and lying flat a lightweight continuous laminated sheeting ply or equivalent wall to wall. Upon said sheeting ply will be placed the fine copper mesh or equivalent (400) and having aforementioned high quality acoustic sheeting (403) placed above and on top of said fine mesh (400). All metallic mesh to be overlapped and secured at all corners of their adjacent component sides.

The THINK TANK—Mark II will have within its interior:

(i) An all frequency scanning device (410) of conventional construction having access to input power supply within said Instrumentation and Controls Console Panel;

(ii) An optional stand alone Temperature Air Conditioner (411) of conventional construction;

(iii) An Air Exchange System (334) such as air revitalization by photo catalyst, or equivalent technology of conventional construction which will provide the rejuvenation of air within aforementioned Sound Proof Enclosure with minimal aid from the external HVAC source within the surrounding building.

It will be clear, though, that the mesh can be manufactured of any suitable metallic material. Also, those skilled in the art will be aware that the mesh might be located on the external surfaces of the chamber or the internal surfaces of the chamber. Preferably, however, the mesh is located within the chamber, and is affixed to the inner wall surface.

Again, now referring to the drawings, which illustrate an embodiment of the present invention, the reference numeral 10 generally designates the Sound Proof Chamber and is applicable to both THINK TANK—Mark I and THINK TANK—Mark II.

The components of construction included are described hereinbelow.

The Floor End Module (40) consists of:

Transverse deflection stiffeners (71)—formed within items (96) and (98)

Longitudinal deflection stiffeners (72)—formed within items (96) and (98)

One external-end sheet decking (98)

Two female longitudinal jointed seam connector elements (67) Affixed to (96) and (98)

Air vent holes (94)—formed within (145)

Two Transverse ends enclosure strips (73)—affixed to (81) (98)(100)

One longitudinal end enclosure strip (95)—affixed to (81) (98)(100)

One internal-end sheet decking (96)

One inner Female fastener track (60)—affixed to (80)(96)

One outer Female fastener track (61)—affixed to (73)(79) (95)

Longitudinal stiffener Ribs (74)

Transverse stiffener Ribs (75)

Rubber gasket seating cushion (76)

Intersecting Rubber Connectors (77)

Four Set Square Up-stand Registers (78)—affixed to (98)

Four Set Square Down-stand registers (138)—affixed to (96)

External Female fastener Buttresses (79)—affixed to (73) (95)

Internal Female Fastener Buttresses (80)—affixed to (60) (96)

Under wall support Ribs (81)—affixed to (73)(82)(95)(98)

Lateral Stabilizing Ribs (82)—affixed to (81)

Internal Sheet Decking Sealing Strips (83)—affixed to (96)

One inner female horizontal seam connector element (66)—affixed to (60)

One outer female horizontal seam connector element (65)—affixed to (73)(95)

Raised and fielded panel (69)—formed within (96)(98)

Rib stiffener flange (100)—affixed to (73)(81)(82)(95)

One vacuum pressure valve (159)—affixed to (96)

A detailed description is provided hereinbelow.

Figure 29:
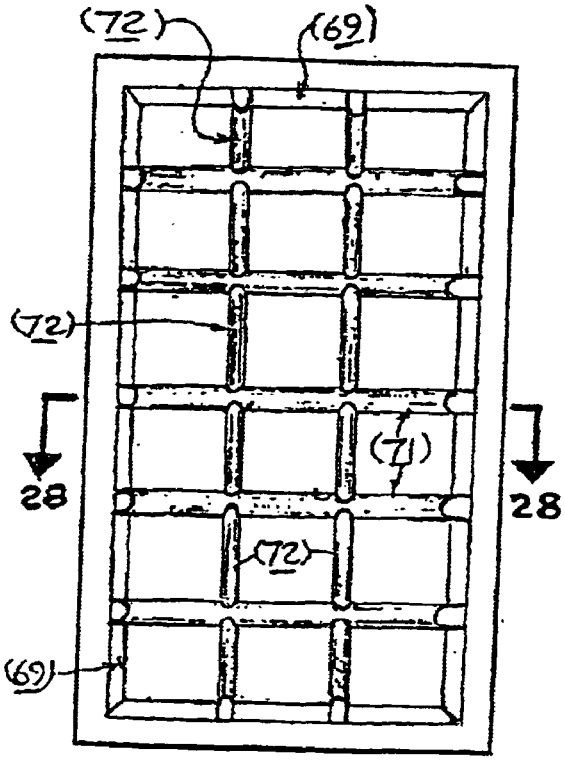
FIG. 29—Displays a typical elevational view of the cavity surfaces of all sheet decking.

The external-end sheet decking comprise, as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and intersecting the contact points of the transverse deflection stiffeners. The integrated combination of both longitudinal and transverse deflection stiffeners reveals a substantially apparent waffled cavity surface pattern.

The raised and fielded panel (69) is formed within the surfaces of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel creates an elevated panel within the areas surrounding the centrally inner regions of the sheet decking with perpendicular corners and serves as a protection to the seam connectors. In the drawings, in should be noted that, for clarity, the raised and fielded panels appear somewhat larger than in actual size.

The panels are preferably straight in overall configuration, with the exception of the corner modules which have a right angle bend.

The external-end sheet decking has integrally formed and molded within it's inner cavity surface and uprightly perpendicular to it a set square up-stand register (78) which is offset a given distance away from each of the four corners. Also in a perpendicularly upright position to the external-end sheet decking's cavity surface and at it's extremities integrally formed and molded are three consecutive end enclosure strips of which two are transverse end enclosure strips (73) and one longitudinal end enclosure strip (95) all having the outermost female fastener track (61) integrally formed and molded and in a vertically upright position a specified distance above the internal-end sheet decking's surface. For a further short distance above and beyond this point and circumventing three outer sides of the module and within the upper extremities of the three end enclosure strips is integrally formed and molded one outer female horizontal seam connector element (65). On the external-end sheet decking's longitudinal edge and opposite to that which the longitudinal end enclosure strip is connected there is also integrally formed and molded the female longitudinal jointed seam connector element (67). All angular bends within the jointed seam connectors to be slow bends as per FIG. 34.

Figure 20:
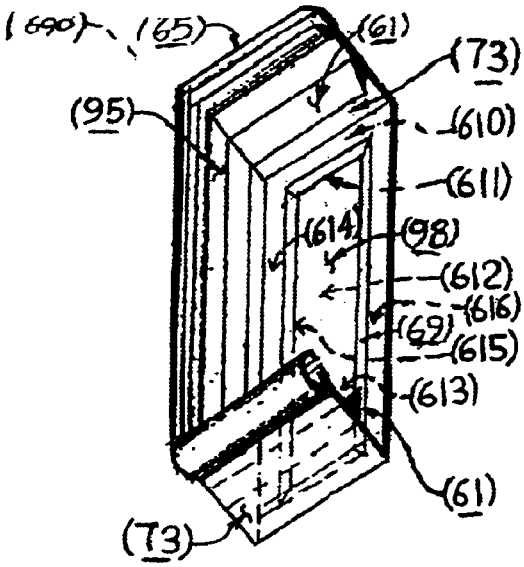
FIG. 20—Reveals a typical floor and roof end module external sheet decking (98) complete with transverse and longitudinal end enclosure strips (73) and (95) respectively.

The floor end modules (40) also comprise within it's three enclosed extremities of it's cavity and integrally formed and molded within the cavity surfaces of it's longitudinal and transverse end enclosure strips and it's external-end sheet decking are equally spaced and perpendicularly upright under wall support ribs (81). These are also reinforced with lateral stabilizing ribs (82) these are integrally formed and molded within the external end sheet decking and under wall support ribs and uprightly perpendicular to it. These features are shown in FIG. 20.

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses also having corrugated openings (129) which are formed along both lengthwise extremities of the longitudinal and transverse stiffener ribs. The rubber gasket seating cushion (76) is glued with These corrugated openings are shaped and positioned with a clear fit within and over the transverse deflection stiffeners (71) and the longitudinal deflection stiffeners (72) respectively. an approved adhesive to all of their extremities except within their recesses. One intersecting rubber connector (77) is snugly fitted within each intersecting recess of the longitudinal stiffener ribs and the transverse stiffener ribs are subsequently snugly fitted within the intersecting rubber connectors on edge and perpendicular to each other. This process continues thus forming the stiffener rib assembly. These features are described in FIGS. 13, 17, 18, 23 and 42.

The internal-end sheet decking comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The internal-end sheet decking has integrally formed and molded within it's inner cavity surface and downwardly perpendicular to it one set square down-stand register (138) offset at a given distance away from each of it's four corners. Also within the internal-end sheet decking and peripherally located along one longitudinal extremity and both transverse ends consecutively is integrally formed and molded on it's three edges in a perpendicularly upright position an internal sheet decking sealing strip (83). The inner female fastener track (60) is integrally formed and molded within its most inner surface and in a perpendicular upright position to it and inwardly offset and parallel to the outer female fastener track for a distance of a typical component side's thickness. Also having along it's fourth edge and integrally formed and molded and sharing the same parallel plane within it, is a female longitudinal jointed seam connector element (67).

Small air vent holds (94) are formed along the shafts (145) of the male and female longitudinal jointed seam connector elements. The male and female horizontal seam connector elements are in precise locational alignment with their mating partners in order to facilitate the assembly process specifically (64), (65), (66) and (68), as per FIGS. 34 and 35.

The floor end modules (40) having without the extremities of it's cavity and externally to it integrally formed and molded within the outer surfaces of it's transverse ends enclosure strips and longitudinal end enclosure strip are equally spaced and perpendicularly upright external female fastener buttresses (79). Also integrally formed and molded within the internal sheet decking and the internal female fastener track are internal female fastener buttresses (80). These are also equally spaced and perpendicularly upright to both surfaces, as per FIG. 25.

The Floor Intermediate Module (41) consists of:

One intermediate sheet decking (97)
Transverse deflection stiffeners (71) formed within (72), (97), (99)
Longitudinal deflection stiffeners (72) formed within (71), (97), (99)
One Intermediate external sheet decking (99)
Two female longitudinal jointed seam connector elements (67) affixed to (97), (99)
External Female Fastener Buttresses (79) affixed to (61), (73)
Internal Female Fastener Buttresses (80) affixed to (60), (97)
Under wall support ribs (81) affixed to (73), (99), (100), (82)
Lateral Stabilizing Ribs (82)—affixed to (81) (99) (100)
Two intermediate internal Sheet decking Sealing Strip (83)—affixed to (97)
One inner female horizontal seam connector element (66)—affixed to (97)
One outer female horizontal seam connector element (65)—affixed to (73)
Rib stiffener flange (100)—affixed to (73) (81) (99)
Raised and fielded panel (69)—formed within (97) (99); and
Air vent holes (94)—formed within (145)

These details are described hereinbelow.

The floor intermediate external sheet decking is shown in FIG. 29. Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The raised and fielded panel (69) is formed within the surface of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel creates an elevated panel within the areas surrounding the centrally inner regions of the sheet decking with perpendicular corners and serves as a protection to the seam connectors.

The floor intermediate external sheet decking has integrally formed and molded within it's inner cavity surface and uprightly perpendicular to it one set square up-stand register (78) which is offset at a given distance away from each of it's four corners. One outer female fastener track is integrally formed and molded along one longitudinal edge and share the same parallel plane with each of it's two transverse ends enclosure strips. These are both subsequently integrally formed and molded in a perpendicularly upright position to the transverse extremities of the intermediate external sheet decking's cavity surface. Above the outer female fastener track and for a short specified distance at it's track's extremity is the female horizontal seam connector element (65). Within each of it's two longitudinal extremities is integrally formed and molded to each one female longitudinal jointed seam connector element (67) and one male longitudinal jointed seam connector element (68) respectively.

The floor intermediate module (41) also comprises within the extremities of it's cavity of it's transverse ends integrally formed and molded within the inner surfaces of the transverse end enclosure strips and it's intermediate external sheet decking equally spaced and perpendicularly upright under wall support ribs (81) which are also reinforced with lateral stabilizing ribs (82). These are integrally formed and molded within the intermediate external sheet decking and the under wall support ribs (81) and uprightly perpendicular to it.

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses. Corrugated openings are formed along both lengthwise extremities of the longitudinal and transverse stiffener ribs. These corrugated openings are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses and corrugated openings. One intersecting rubber connector (77) is snugly fitted within each intersecting recess of the longitudinal stiffener ribs and the transverse stiffener ribs are subsequently snugly fitted within the intersecting rubber connectors on edge and perpendicular to each other. The process continues thus forming the stiffener rib assembly.

The floor intermediate internal sheet decking comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The Floor intermediate internal sheet decking has integrally formed and molded within it's cavity surface and downwardly perpendicular to it one set square down-stand register (78) offset at a given distance away from each of it's four corners. Also within the intermediate internal sheet decking and peripherally located along it's two transverse ends are integrally formed and molded in a perpendicularly upright position an intermediate internal sheet decking sealing strip (83). Also perpendicularly upright to the internal sheet decking's most inner surface and inwardly offset and parallel to the outer female fastener track for a distance of a typical component side's thickness is the inner female fastener track (60) integrally formed and molded within the intermediate internal sheet decking. Above the inner female fastener track and for a short specified distance further away from the internal sheet decking's innermost surface and at it's track's extremity is the female horizontal seam connector element (66). Having within it's longitudinal extremity integrally formed and molded one female longitudinal jointed seam connector element (67) and one male longitudinal jointed seam connector element (68) one element assigned to each longitudinal side respectively. These features are shown in FIGS. 22, 25, 32 and 35.

Figure 35:
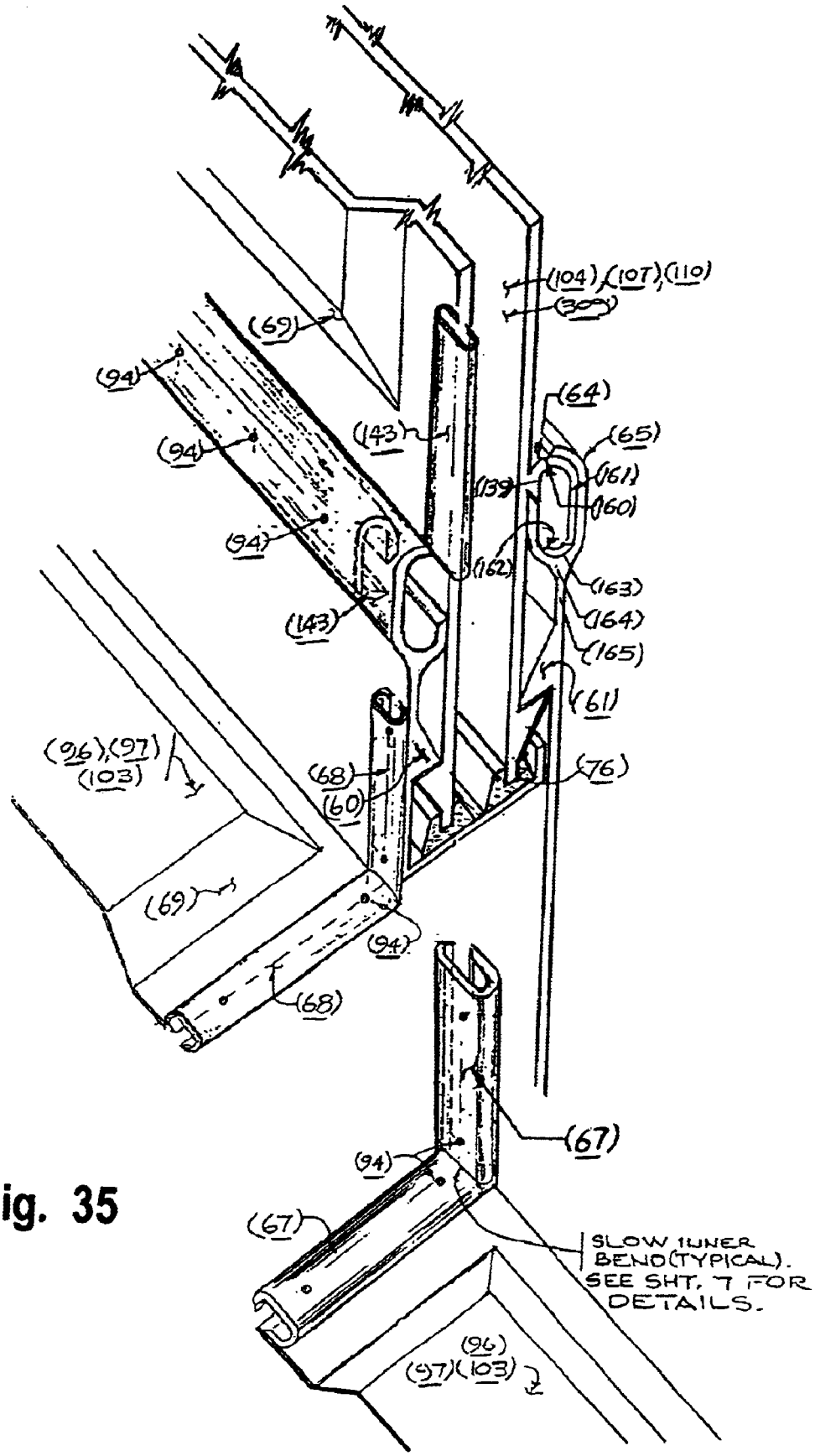
FIG. 35—Displays a pictorial view of a typical floor to wall connection detail with male longitudinal jointed seam connector element and female longitudinal jointed seam connector integrally formed in their respective internal sheet decking. Also a typical wall to floor attachment detail similar to that of FIG. 25.

Small air vent holes (94) are formed along the shafts (145) of the male and female longitudinal jointed seam connector elements. The male and female horizontal seam connector elements are in precise locational alignment with their mating partners in order to facilitate the assembly process specifically (64), (65), (66), (67) and (68). These are shown in FIGS. 34 and 35.

The floor intermediate modules (41) having without the extremities of it's cavity and externally to it integrally formed and molded within the outer surfaces of it's transverse ends enclosure strips equally spaced and perpendicularly upright are external female fastener buttresses (79). Also integrally formed and molded within the intermediate internal sheet decking and the internal female fastener track are internal female fastener buttresses. These are also equally spaced and perpendicularly upright to both surfaces.

The Floor Component Unit (42) comprises:

Transverse deflection stiffeners (71) formed within (102) (103)
Longitudinal deflection stiffeners (72) formed within (102) (103)
One component unit external sheet decking (102)
Two female longitudinal jointed seam connector elements (67)—affixed to (102)(103)
Two transverse end enclosure strips (73)—affixed to (81) (100)(102)
One component unit internal sheet decking (103)
Two male longitudinal jointed seam connector elements (68)—affixed to (60)(73)
One inner Female fastener track (60)—affixed to (80)(103)
One outer Female fastener track (61)—affixed to (73)(79)
Longitudinal Stiffener Ribs (74)
Transverse Stiffener Ribs (75)
Rubber gasket seating cushion (76)
Intersecting Rubber Connectors (77)
Four Set Square Up-stand Registers (78)—affixed to (102)
Four Set Square Down-stand Registers (138)—affixed to (103)
External Female Fastener Buttresses (79)—affixed to (73)
Under Wall Support ribs (81)—affixed to (73)(82)(100) (102)
Lateral Stabilizing Ribs (82)—affixed to (81)(100)(102)
Two internal sheet decking sealing strips (83)—affixed to (103)
Air vent holes (94)—formed within (145)
Internal female fastener buttresses (80)—affixed to (60) (103)

Rib stiffener flange (100)—affixed to (73)(81)
Raised and fielded panel (69)—formed within (102)(103)
One inner female horizontal seam connector element (66)—affixed to (60)
One outer female horizontal seam connector element (65)—affixed to (61)

These features are described in detail hereinbelow.

Figure 21:
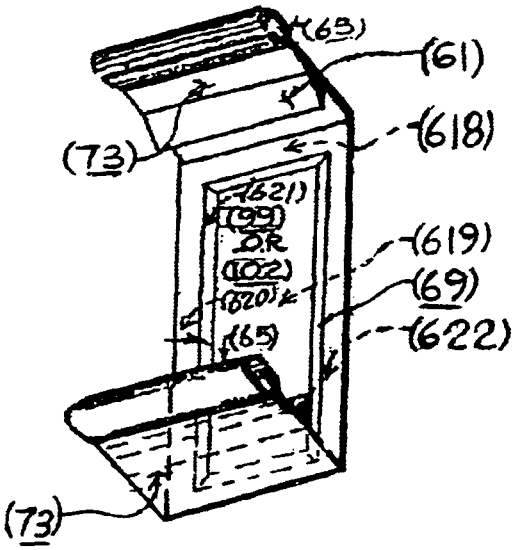
FIG. 21—Reveals a typical floor and roof intermediate module and component unit external sheet decking complete with transverse ends enclosure strips (73).

The floor component unit's external sheet decking (102) comprise as per FIGS. 21 and 29 Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The raised and fielded panel (69) is formed within the surface of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel creates an elevated panel within the areas surrounding the centrally inner regions of the sheet decking with perpendicular corners and serves as a protection to the seam connectors.

The floor component unit's external sheet decking (102) has integrally formed and molded within it's inner cavity surface and uprightly perpendicular to it one set square up-stand register (78) which is offset at a given distance away from each of it's four corners. One outer female fastener track (61) is integrally formed and molded and also shares the same parallel plane along one longitudinal edge of each of it's two transverse ends enclosure strips (73). These are both subsequently integrally formed and molded in a perpendicularly upright position to and integral with the transverse extremities of the floor component unit's external sheet decking. Above the outer female fastener track and for a short specified distance at it's track's extremity is the female horizontal seam connector element (65). Within each of it's two longitudinal extremities and integrally formed and molded to each is one female longitudinal jointed seam connector element (67) and one male-longitudinal jointed seam connector element (68) respectively. Reference is made to FIGS. 14, 21, 25 and 31.

Figure 25:
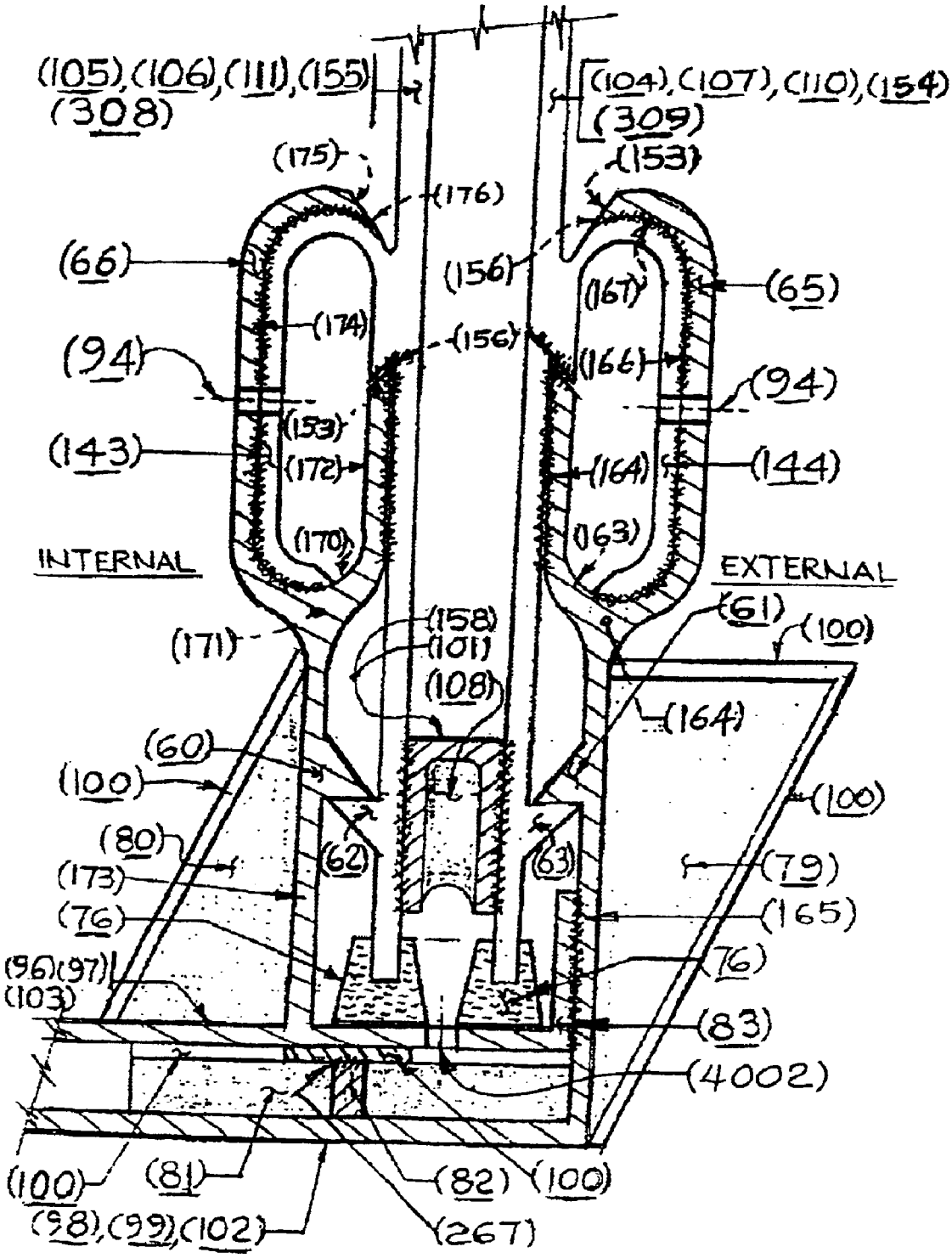
FIG. 25—Reveals an enlarged view of the wall and door modules and wall and door component units detailed attachment to the floor end modules and intermediate modules and floor component units. This configuration is identical to that of it's roof to wall attachment but with these members inverted.

The floor component unit (42) also comprises within the extremities of it's cavity of it's transverse ends integrally formed and molded within the cavity surfaces of the transverse end enclosure strips and it's component unit's external sheet decking equally spaced and perpendicularly upright under wall support ribs (81) which are also reinforced with lateral stabilizing ribs (82) that are integrally formed and molded in a perpendicularly upright position within the component unit under wall support ribs and the external sheet decking cavity surfaces. This is shown in FIG. 25.

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses. Corrugated openings (129) are formed along both lengthwise extremities of the longitudinal and transverse stiffener ribs. These corrugated openings are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses and corrugated openings (129). One intersecting rubber connector (77) is snugly fitted within each intersecting recess of the longitudinal stiffener ribs and the transverse stiffener ribs are subsequently snugly fitted within the intersecting rubber connectors on edge and perpendicular to each other. This process continues thus forming the stiffener rib assembly. These features are shown in FIGS. 13, 17, 18, 23 and 42.

The component units—internal sheet decking comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveals an apparent waffled cavity surface pattern.

Figure 22:
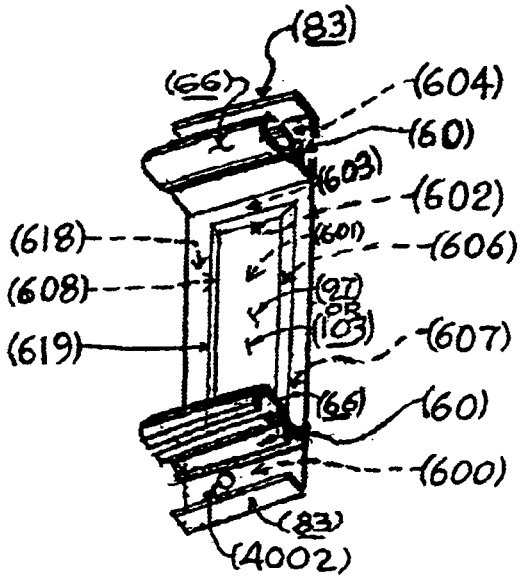
FIG. 22—Shows a view depicting the floor and roof intermediate module and component unit internal sheet decking.

The floor component unit's—internal sheet decking has integrally formed and molded within it's inner cavity surface and downwardly perpendicular to it one set square downstand register (138) offset at a given distance away from each of it's four corners. Also within the internal sheet decking and peripherally located along it's two transverse ends are integrally formed and molded in a perpendicularly upright position a component unit internal sheet decking sealing strip (83). Also perpendicularly upright to the internal sheet decking's surface and inwardly offset and parallel to the outer female fastener track for a distance equal to that of a typical component side's thickness is the inner female fastener track (60) integrally formed and molded within the component unit's—internal sheet decking. Above the inner female fastener track and for a short specified distance at it's track's extremity is the female horizontal seam connector element (66). Having within it's longitudinal extremity integrally formed and molded one female longitudinal jointed seam connector element (67) and one male longitudinal jointed seam connector element (68) one element assigned to each longitudinal side respectively. These features are shown in FIG. 22.

Small air-vent holes (94) are formed along the shafts of the male and female longitudinal jointed seam connector elements. The male and female horizontal seam connector elements are in precise locational alignment with their mating partners in order to facilitate the assembly process specifically (64)(65)(66)(67) and (68), as shown in FIGS. 34 and 35.

The floor component unit (42) having without the extremities of it's cavity and externally to it integrally formed and molded within the outer surfaces of it's transverse ends enclosure strips equally spaced and perpendicularly upright are external female fastener buttresses (79). Also integrally formed and molded within the internal sheet decking (103) and the inner female fastener track (60) are internal female fastener buttresses (80). These are also equally spaced and perpendicularly upright to both surfaces. These features are shown in FIG. 25.

The Wall Corner Module (44) consists of:

One wall corner external L-shaped sheet decking (104)

Transverse deflection stiffeners (71)—formed within (72)(104)(105)

Longitudinal deflection stiffeners (72)—formed within (71)(104)(105)

Two female longitudinal jointed seam connector elements (67)—affixed to (104)(105)

One wall corner internal L-shaped sheet decking (105)

Two male longitudinal jointed seam connector elements (68)—affixed to (104)(105)

Two inner male fastener tracks (62)—affixed to (105)

Longitudinal Stiffener Ribs (74)

Two outer male fastener tracks (63)—affixed to (104)

Transverse L-shaped Stiffener Ribs (140)

Rubber gasket seating cushion (76)

Intersecting Rubber Connectors (77)

Eight Set Square Up-stand Registers (78)—affixed to (104)(105)

Two triangular external up-stand registers (130)—affixed to (104)

Two right angle internal up-stand registers (131)—affixed to (105)

Two transverse L-shaped end enclosure channels (158)—affixed to (108)

U-Shaped web stiffener ribs (108)—affixed to (158)

Two inner male horizontal seam connector elements (143)—affixed to (105)

Two outer male horizontal seam connector elements (144)—affixed to (104)

Raised and fielded panel (69) formed within (104)(105)

Four female longitudinal jointed seam connector sockets (84)—affixed to (67)(104)(105)

Air vent holes (94)—formed within (145)

Four male longitudinal and horizontal seam connector junctions (85)—affixed to (68)(104)(105)(143)(144)

One vacuum pressure valve (159)—affixed to (105)

These features are described in detail hereinbelow.

The wall corner module's—wall corner external sheet decking (104) comprise as per FIGS. 6 and 44, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantial apparent waffled cavity surface pattern as per FIG. 29.

Figure 32:
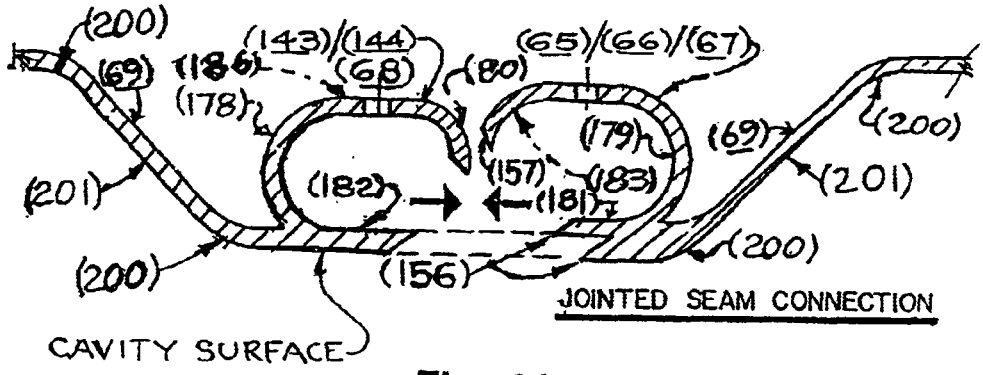
FIG. 32—Displays a typical detail of a Jointed Seam Connector cradled within the confines of the Raised and Fielded Panel (69).

The raised and fielded panel (69) is formed within the surface of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel (69) creates an elevated panel within the areas surrounding the centrally inner regions of the sheet decking with perpendicular corners and serves as a protection to the seam connectors. These features are shown in FIG. 32.

The wall corner module's—wall corner external L-shaped sheet decking (104) comprise two legs which are integrally formed and molded perpendicularly to each other along one of their longitudinal sides as per FIGS. 6 and 44, which displays a substantially L-shape cross sectional configuration. Integrally formed and molded within it's inner cavity surface and projecting perpendicularly inwardly from it are four set square up-stand registers (78) which are offset at a given distance away from each of it's four corners and two triangular external up-stand registers (130) integrally formed and molded within the apex where both legs are formed and located the same short distance away from it's upper and lower extremities as that of it's corner set square registers. Also having one male fastener track (63) integrally formed and molded along each leg and adjacently to it's transverse horizontal upper and lower extremities and sharing the same parallel plane with the wall corner external sheet decking surface. One upper and one lower male horizontal seam connector element (144) is integrally formed and molded within and upon the opposite surface to that of it's cavity surface of the wall corner module's external sheet decking and at a specified distance away from it's upper and lower transverse extremities and integrally affixed adjacently between and parallel to the male fastener track (63) and the raised and fielded panel (69). The male horizontal seam connector element (144) has on one of it's ends specifically to that end which is axially perpendicularly adjacent to the male longitudinal jointed seam connector element (68) and of the said external sheet decking and integrally formed and molded within it is one male longitudinal and horizontal seam connector junction (85) as per FIGS. 10, 12, 25, 27 and 31.

Figure 11:
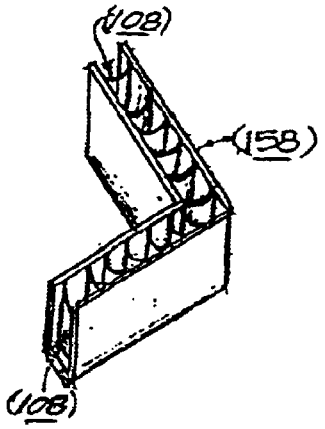
FIG. 11—Depicts a wall corner module (44) Transverse L-shaped end enclosure channel (158).

The wall corner module (44) having within the upper and lower ends of it's wall cavity and parallel to it's transverse horizontal extremities possess two substantially U-shaped end enclosure channels (158). One at it's upper end and the other at it's lower extremity. Both substantially U-shaped transverse ends enclosure channels (101) are substantially U-shaped in appearance along it's cross section and are also substantially L-shaped along it's longitudinal axis. Each enclosure strip consisting of equally spaced and perpendicularly upright U-shaped web stiffener ribs (108) which are integrally formed and molded within it's inner surfaces. The substantially U-shaped end enclosure channels (158) are subsequently bonded and sealed to both cavity inner contact surfaces of the wall corner external and internal sheet decking with an approved sealing solvent. These features are shown in FIG. 11.

The longitudinal stiffener ribs (74) posses intersecting recesses (128). These are narrow recesses which extends to more than one half the width of the rib The transverse L-shaped stiffener ribs (140) are substantially L-shaped along it's longitudinal axis while maintaining a constant rectangular configuration throughout it's cross-section and having intersecting recesses (128) which also extends to more than one half it's width. Both transverse and longitudinal ribs have equal widths and equal size recesses and corrugated openings (129). Corrugated openings (129) are formed along both lengthwise extremities of the longitudinal and transverse stiffener ribs. These corrugated openings are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses. One intersecting rubber connector (77) is snugly fitted within each intersecting recess of the longitudinal stiffener ribs and the transverse stiffener ribs are subsequently snugly fitted within the intersecting rubber connectors on edge and perpendicular to each other. This process continues thus forming the stiffener rib assembly. These features are shown in FIGS. 13, 17, 18, 23, 42 and 44.

The wall corner internal L-shaped sheet decking (105) comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveals a substantially apparent waffled cavity surface pattern.

The wall corner module's—wall corner internal L-shaped sheet decking (105) comprise two legs which are integrally formed and molded perpendicularly to each other along one of their longitudinal sides as per FIGS. 6 and 44, which displays a substantially L-shaped cross sectional configuration. Integrally formed and molded within it's inner cavity surface and projecting perpendicularly inwardly from it are four set square up-stand registers (78) which are offset at a given distance away from each of it's four corners and two right angular internal up-stand registers (131) which are integrally formed and molded within the apex where both legs are formed (78) and located the same short distance away from both upper and lower extremities as that of it's set square up-stand registers (78). It also has a inner male fastener track (62) which is integrally formed and molded and sharing the same parallel plane along each leg and adjacently to it's transverse horizontal upper and lower extremities. One upper and one lower male horizontal seam connector element (143) is integrally formed and molded within and upon the opposite surface to that of it's cavity surface of the wall corner module's internal sheet decking and at a specified distance away from it's upper and lower transverse extremities and integrally affixed adjacently between and parallel to the male fastener track (62) and the raised and fielded panel (69). The male horizontal seam connector element (143) has on one of it's ends specifically to that end which is axially perpendicularly adjacent to the male longitudinal jointed seam connector element (68) and of the said external sheet decking and integrally formed and molded within it is one male longitudinal and horizontal seam connector junction (85) as per FIGS. 26, 27, 31 and 34.

The male longitudinal and horizontal seam connector junction (85) is provided upon all wall component sides internal and external sheet decking specifically at the location where the male longitudinal jointed seam connector element (68) converges with the inner and outer male horizontal seam connector element (143) and (144) respectively. These features are shown in FIG. 34.

Small air vent holes (94) are formed along the shafts of the male and female longitudinal jointed connector elements. The male and female horizontal seam connector elements are in precise locational alignment with their mating partners in order to facilitate the assembly process specifically (64)(65)(66)(67)(68), as shown in FIGS. 34 and 35.

As per FIG. 34, both upper and lower extremities of the internal and external wall sheet deckings of the wall corner module will possess within both extremities of their female longitudinal jointed seam connector element (67) and in a horizontally outward direction one female longitudinal jointed seam connector socket (84) having each integrally formed and molded within one extremity and on the same side of both inner and outer male horizontal seam connector elements (143) and (144) respectively for the purpose of accommodating the male horizontal seam connector elements of the adjacent wall module and component units.

The Wall Intermediate Module (48) comprises:

One wall intermediate—external sheet decking (107)
Two female longitudinal jointed seam connector elements (67)—affixed to (84)(106)(107)
Two U-shaped transverse ends enclosure channels (101)—affixed to (108)
U-shaped web stiffener ribs (108)—affixed to (101)
One wall intermediate—internal sheet decking (106)
Two male longitudinal jointed seam connector elements (68)—affixed to (106)(107)
Two inner male fastener tracks (62)—affixed to (106)
Two outer male fastener tracks (63)—affixed to (107)
Longitudinal Stiffener Ribs (74)
Transverse Stiffener Ribs (75)
Rubber gasket seating cushion (76)
Intersecting Rubber Connectors (77)
Eight Set Square Up-stand Registers (78)—affixed to (106)(107)
Transverse deflection stiffeners (71)—formed within (72)(106)(107)
Longitudinal deflection stiffeners (72)—formed within (71)(106)(107)
Two inner male horizontal seam connector element (143)—affixed to (85)(106)
Two outer male horizontal seam connector element (144)—affixed to (85)(107)
Raised and fielded panel (69)—formed within (106)(107)
Air vent holes (94)—formed within (145)
Four female longitudinal jointed seam connector sockets (84)—affixed to (67)(106)(107); and
Four male longitudinal and horizontal seam connector junctions (85)—affixed to (68)(106)(107)(143)(144).

These features are described hereinbelow.

Figure 28:
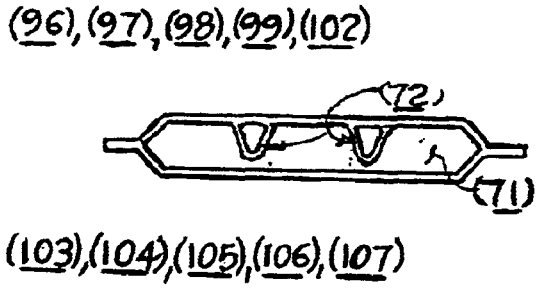
FIG. 28—Reveals a typical cross sectional transverse axis view of all sheet decking.
Figure 27:
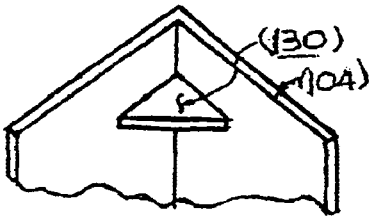
FIG. 27—Depicts a typical triangular external up-stand register (130) which is integrally formed within the wall corner module external sheet decking (104).
Figure 26:
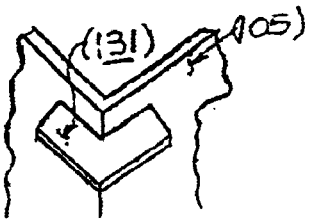
FIG. 26—Depicts a typical right angle internal up-stand register (131) which is integrally formed within the wall corner module internal sheet decking (105).

The wall intermediate—external sheet decking (107) comprise as per FIGS. 28 and 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveals a substantially apparent waffled cavity surface pattern.

The raised and fielded panel (69) is formed within the surface of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel (69) creates an elevated panel within the areas surrounding the centrally inner regions of the sheet decking with perpendicular (132) corners and serves as a protection to the seam connectors. These features are shown in FIG. 32.

The wall intermediate—external sheet decking (107) has integrally formed and molded within it's inner cavity surface and projecting perpendicularly inwardly from it one set square up-stand register (78) offset at a given distance away from each of the four corners. One outer male fastener track (63) each integrally formed and molded and sharing the same parallel plane along it's transverse horizontal upper and lower extremities of the intermediate external sheet decking. Also within each of it's two longitudinal vertical extremities is integrally formed and molded also sharing the same parallel plane is one female longitudinal jointed seam connector element (67) and one male longitudinal jointed seam connector element (68) one to each longitudinal extremity. One upper and one lower male horizontal seam connector element (144) is integrally formed and molded within and upon the opposite surface to that of it's cavity surface of the wall intermediate module's external sheet decking and at a specified distance away from it's upper and lower transverse extremities and integrally affixed adjacently between and parallel to the outer male fastener track (63) and the raised and fielded panel (69). The male horizontal seam connector element (144) has on one of it's ends specifically to that end which is axially perpendicularly adjacent to the male longitudinal jointed seam connector element (68) and of the said external sheet decking and integrally formed and molded within it is one male longitudinal and horizontal seam connector junction (85) as per FIGS. 10, 12, 25 and 31.

Figure 8:
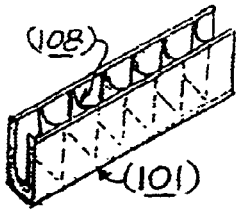
FIG. 8—U-shaped transverse ends enclosure channel (101).

The wall intermediate modules (48) having within it's upper and lower ends of the wall's cavity and parallel to it's transverse horizontal extremities U-shaped transverse ends enclosure channels (101) consisting of equally spaced end enclosure web stiffener ribs (108) which are integrally formed and molded and positioned perpendicularly upright within it's external surfaces as per FIGS. 8 and 25. Both end enclosure strips are bonded and sealed to the inner surfaces of both the internal and external wall sheet decking and at it's extremities in a horizontal position to their upper and lower ends with an approved bonding sealing solvent.

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses. Corrugated openings (129) are formed along both lengthwise extremities of the longitudinal and transverse stiffener ribs. These corrugated openings are shaped and positioned with a clear fit within and over the transverse deflection stiffeners (71) and the, longitudinal deflection stiffeners (72 respectively. The rubber gasket seating cushion (76) is glued with an approved adhesive to all of their extremities except within their recesses and corrugated openings (129). One intersecting rubber connector (77) is snugly fitted within each intersecting recess of the longitudinal stiffener ribs and the transverse stiffener ribs are subsequently snugly fitted within the intersecting rubber connectors on edge and perpendicular to each other. This process continues thus forming the stiffener rib assembly. These features are shown in FIGS. 13, 17, 18, 23 and 42.

The wall intermediate—internal sheet decking (106) comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The wall intermediate—internal sheet decking (106) has integrally formed and molded within it's inner cavity surface and projecting perpendicularly inwardly from it one set square up-stand register (78) offset at a given distance away from each of it's four corners. Also having one inner male fastener track (62) each integrally formed and molded and sharing the same parallel plane along it's transverse horizontal upper and lower extremities of the wall intermediate—internal sheet decking and having within it's longitudinal vertical extremity integrally formed and molded and sharing the same parallel plane is one female longitudinal jointed seam connector element (67) and one male longitudinal jointed seam connector element (68) one element assigned to each of it's vertically longitudinal extremities. One upper and one lower male horizontal seam connector element (64) is integrally formed and molded within and upon the opposite surface to that of it's cavity surface of the wall intermediate module's internal sheet decking and at a specified distance away from it's upper and lower transverse extremities and integrally affixed adjacently between and parallel to the inner male fastener track (62) and the raised and fielded panel (69). The male horizontal seam connector element (64) has on one of it's ends specifically to that end which is axially perpendicularly adjacent to the male longitudinal jointed seam connector element (68) and of the said internal sheet decking and integrally formed and molded within it is one male longitudinal and horizontal seam connector junction (85) as per FIG. 34.

The male longitudinal and horizontal seam connector junction (85) is provided upon all wall component sides internal and external sheet decking specifically at the location where the male longitudinal jointed seam connector element (68) converges with the inner and outer male horizontal seam connector element (143) and (144) respectively. These features are shown in FIG. 34.

As per FIG. 34, both upper and lower extremities of the internal and external wall sheet deckings of the wall intermediate module will possess within both extremities of their female longitudinal jointed seam connector element (67) and in a horizontally outward direction one female longitudinal jointed seam connector socket (84) having each integrally formed and molded within one extremity and on the same side of both inner and outer male horizontal seam connector elements (143) and (144) respectively for the purpose of accommodating the male horizontal seam connector elements of the adjacent wall module/component units.

Small air vent holes (94) are formed along the shafts (145) of the male and female longitudinal jointed seam connector elements. The male and female horizontal seam connector elements are in precise locational alignment with their mating partners in order to facilitate the assembly process specifically (64)(65)(66)(67) (68), as shown in FIGS. 34 and 35.

The Wall Component Unit (46) consists of:

One wall component unit external sheet decking (309)

Two female longitudinal jointed seam connector elements (67)—affixed to (84)(308)(309)

Two U-shaped transverse ends enclosure channels (101)—affixed to (108)

One wall component unit internal sheet decking (308)

Two male longitudinal jointed seam connector elements (68)—affixed to (308)(309)

Two inner male fastener tracks (62)—affixed to (308)
Two outer male fastener tracks (63)—affixed to (309)
Longitudinal Stiffener Ribs (74)
Transverse Stiffener Ribs (75)
Rubber gasket seating cushion (76)
Intersecting Rubber Connectors (77)
Set Square Up-stand Registers (78)—affixed to (308)(309)
U-shaped web stiffener ribs (108)—affixed to (101)
Transverse deflection stiffeners (71)—formed within (72) (308)(309)
Longitudinal deflection stiffeners (72)—formed within (71) (308)(309)
Two inner male horizontal seam connector element (143)—affixed to (308)
Two outer male horizontal seam connector element (144)—affixed to (308)
Raised and fielded panel (69)—formed within (308)(309)
Four female longitudinal jointed seam connector sockets (84)—affixed to (67)(308)(309)
Air vent holes (94)—formed within (145)
Four male longitudinal and horizontal seam connector junctions (85)—affixed to (68)(143)(144)(308)(309)

These features are described in detail hereinbelow.

The wall component unit's external sheet decking (309) comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The raised and fielded panel (69) is formed within the surface of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel creates an elevated panel within the areas surrounding the centrally inner regions of the sheet decking with perpendicular corners (132) and serves as a protection to the seam connectors. These features are shown in FIG. 32.

The wall component unit's external sheet decking (309) has integrally formed and molded within it's inner cavity surface and projecting perpendicularly inwardly from it one set square up-stand register (78) offset at a given distance away from each of it's four corners and having intermediate set square up-stand registers (78) equally spaced and integrally formed and molded along both upper and lower extremities and in direct alignment with the said four corner up-stand registers. Two outer male fastener tracks (63) integrally formed and molded adjacent and parallel to it's upper and lower extremities respectively while sharing the same plane of the wall component unit's external sheet decking outer surface. Also within each of it's two longitudinal vertical extremities is integrally formed and molded and sharing the same parallel plane is one female longitudinal jointed seam connector element (67) and one male longitudinal jointed seam connector element (68) one to each longitudinal extremity. One upper and one lower male horizontal seam connector element (144) is integrally formed and molded within and upon the opposite surface to that of it's cavity surface of the wall component unit's external sheet decking and at a specified distance away from it's upper and lower transverse extremities and integrally affixed adjacently between and parallel to the outer male fastener track (63) and the raised and fielded panel (69). The male horizontal seam connector element (144) has on one of it's ends specifically to that end which is axially perpendicularly adjacent to the male longitudinal jointed seam connector element (68) and of the said external sheet decking and integrally formed and molded within it is one male longitudinal and horizontal seam connector junction (85) as per FIGS. 10, 12, 31 and 34.

The wall component unit (46) having within it's upper and lower ends of the wall's cavity and parallel to it's transverse horizontal extremities U-shaped end enclosure channels (101) consisting of equally spaced end enclosure web stiffener ribs (108) which are integrally formed and molded and positioned perpendicularly upright within it's external surfaces as per FIGS. 8 and 25. Both end enclosure strips are to be bonded and sealed to the inner surfaces of both the inner and outer wall sheet decking and at it's extremities in a horizontal position to their upper and lower ends with an approved bonding sealing solvent.

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses. Corrugated openings (129) are formed along both lengthwise extremities of the longitudinal and transverse stiffener ribs. These corrugated (129) openings are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses and corrugated openings (129). One intersecting rubber connector (77) is snugly fitted within each intersecting recess of the longitudinal stiffener ribs and the transverse stiffener ribs are subsequently snugly fitted within the intersecting rubber connectors on edge and perpendicular to each other. This process continues thus forming the stiffener rib assembly. These features are shown in FIGS. 13, 17,18, 23 and 42.

The component unit's internal sheet decking (106) comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The component unit's internal sheet decking (106) has integrally formed and molded within it's inner cavity surface and projecting perpendicularly inwardly from it one set square up-stand register (78) offset at a given distance away from each of it's four corners. Also having one inner male fastener track (62) integrally formed and molded and sharing the same parallel plane along it's transverse horizontal upper and lower extremities of the component unit's internal sheet decking and having within it's longitudinal vertical extremity integrally formed and molded and sharing the same parallel plane is one female longitudinal jointed seam connector element (67) and one male longitudinal jointed seam connector element (68) one element assigned to each of it's vertically longitudinal extremities. One upper and one lower male horizontal seam connector element (143) is integrally formed and molded within and upon the opposite surface to that of it's cavity surface of the wall component unit's internal sheet decking and at a specified distance away from it's upper and lower transverse extremities and integrally affixed adjacently between and parallel to the inner male fastener track (62) and the raised and fielded panel (69). The male horizontal seam connector element (143) has on one of it's ends specifically to that end which is axially perpendicularly adjacent to the male longitudinal jointed seam connector element (68) and of the said internal sheet decking and integrally formed and molded within it is one male longitudinal and horizontal seam connector junction (85) as per FIG. 34.

The dummy door component unit (45) is identical in configuration and content to that of a wall component unit. It maintains one constant transverse overall dimension which is always equal to that of the transverse overall width of it's door opening component unit (45) counterpart. Both the dummy door component unit (49) and the door opening component unit (49) are preferably always identical in overall size and installed within opposite walls to each other within the same enclosure. These features are shown in FIG. 30.

The male longitudinal and horizontal seam connector junction (85) is provided upon all wall component sides internal and external sheet decking specifically at the location where the male longitudinal jointed seam connector element (68) converges with the inner and outer male horizontal seam connector element (143) and (144) respectively.

As per FIG. 34, both upper and lower extremities of the internal and external wall sheet deckings of the wall component unit will possess within both extremities of their female longitudinal jointed seam connector element (67) and in a horizontally outward direction one female longitudinal jointed seam connector socket (84) having each integrally formed and molded within one extremity and on the same side of both inner and outer male horizontal seam connector elements (143) and (144) respectively for the purpose of accommodating the male horizontal seam connector elements of the adjacent wall module/component units.

Small air vent holes (94) are formed along the shafts (145) of the male and female longitudinal jointed seam connector elements. The male and female horizontal seam connector elements are in precise locational alignment with their mating partners in order to facilitate the assembly process specifically (64)(65)(66)(67) (68), as shown in FIGS. 34 and 35.

The Dummy Door Component Unit (45) consists of:

One Dummy Door component unit external sheet decking (154)

Two female longitudinal jointed seam connector elements (67)—affixed to (84)(154)(155)

Two U-shaped transverse ends enclosure channels (101)—affixed to (108)

One Dummy Door component unit internal sheet decking (155)

Two male longitudinal jointed seam connector elements (68)—affixed to (85)(154)(155)

Inner male fastener tracks (62)—affixed to (155)

Outer male fastener track (63) affixed to (154)

Longitudinal Stiffener Ribs (74)

Transverse Stiffener Ribs (75)

Rubber gasket seating cushion (76)

Intersecting Rubber Connectors (77)

Set Square Up-stand Registers (78)—affixed to (154)(155)

U-shaped web stiffener ribs (108)—affixed to (101)

Transverse deflection stiffeners (71)—formed within (72)(154)(155)

Longitudinal deflection stiffeners (72)—formed within (71)(154)(155)

Two inner male horizontal seam connector element (143)—affixed to (85)(155)

Two outer male horizontal seam connector element (144)—affixed to (85)(154)

Raised and fielded panel (69)—formed within (154)(155)

Four female longitudinal jointed seam connector sockets (84)—affixed to (67)(154)(155)

Air vent holes (94)—formed within (145)

Four male longitudinal and horizontal seam connector junctions (85)—affixed to (68)(143)(144)(154)(155)

These features are described in detail hereinbelow.

The Dummy Door component unit's external sheet decking (154) comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the said transverse deflection stiffeners. The integrated combination of both longitudinal and transverse deflection stiffeners reveal a substantially apparent waffled cavity surface pattern as per FIG. 29.

The raised and fielded panel (69) is formed within the surface of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel creates an elevated panel within the areas surrounding the centrally inner regions of the sheet decking with perpendicular corners (132) and serves as a protection to the seam connectors, as per FIG. 32.

The said Dummy Door component unit's external sheet decking (154) has integrally formed and molded within it's inner cavity surface and projecting perpendicularly inwardly from it one set square up-stand register (78) offset at a given distance away from each of it's four corners and having intermediate set square up-stand registers (78) equally spaced and integrally formed and molded along both upper and lower extremities and in direct alignment with the said four corner up-stand registers. Two outer male fastener tracks (63) integrally formed and molded adjacent and parallel to it's upper and lower extremities respectively while sharing the same plane of the Dummy Door component unit's external sheet decking outer surface (154). Also within each of it's two longitudinal vertical extremities is integrally formed and molded and sharing the same parallel plane is one female longitudinal jointed seam connector element (67) and one male longitudinal jointed seam connector element (68) one to each longitudinal extremity. One upper and one lower male horizontal seam connector element (144) is integrally formed and molded within and upon the opposite surface to that of it's cavity surface of the said Dummy Door component unit's external sheet decking and at a specified distance away from it's upper and lower transverse extremities and integrally affixed adjacently between and parallel to the male fastener track (63) and the raised and fielded panel (69). The male horizontal seam connector element (144) has on one of it's ends specifically to that end which is axially perpendicularly adjacent to the male longitudinal jointed seam connector element (68) and of the said external sheet decking and integrally formed and molded within it is one male longitudinal and horizontal seam connector junction (85) as per FIGS. 10, 12, 25, 27 and 34.

The Dummy Door component unit (45) having within it's upper and lower ends of the Dummy Door's cavity and parallel to it's transverse horizontal extremities U-shaped end enclosure channels (101) consisting of equally spaced end enclosure web stiffener ribs (108) which are integrally formed and molded and positioned perpendicularly upright within it's external surfaces as per FIG. 8. Both end enclosure channels (101) are to be bonded and sealed to the inner surfaces of both the said inner and outer Dummy Door sheet decking (154) and (155) and at it's extremities in a horizontal position to their upper and lower ends with an approved bonding sealing solvent, as shown in FIG. 8.

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses. Corrugated openings (129) are formed along both lengthwise extremities of the said longitudinal and transverse stiffener ribs. Said corrugated openings are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses and corrugated openings (129). One intersecting rubber connector (77) is snugly fitted within each intersecting recess of the said longitudinal stiffener ribs and the said transverse stiffener ribs are subsequently snugly fitted within the said intersecting rubber connectors on edge and perpendicular to each other. This process continues thus forming the stiffener rib assembly. These features are shown in FIGS. 13, 17, 18, 23, 42 or 45

The Dummy Door component unit's internal sheet decking (155) comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points with the said transverse deflection stiffeners. The integrated combination of both said longitudinal and transverse deflection stiffeners reveal a substantially apparent waffled cavity surface pattern as per FIG. 29.

The Dummy Door component unit's internal sheet decking (155) has integrally formed and molded within it's inner cavity surface and projecting perpendicularly inwardly from it one set square up-stand register (78) offset at a given distance away from each of it's four corners. Also having one inner male fastener track (62) integrally formed and molded and sharing the same parallel plane along it's transverse horizontal upper and lower extremities of the Dummy Door component unit's internal sheet decking and having within it's longitudinal vertical extremity integrally formed and molded and sharing the same parallel plane is one female longitudinal jointed seam connector element (67) and one male longitudinal jointed seam connector element (68) one element assigned to each of it's vertically longitudinal extremities. One inner and one outer male horizontal seam connector element (143) and (144) respectively is integrally formed and molded within and upon the opposite surface to that of it's cavity surface of the Dummy Door component unit's internal sheet decking (155) and at a specified distance away from it's upper and lower transverse extremities and integrally affixed adjacently between and parallel to the inner male fastener track (62) and the raised and fielded panel (69) The inner male horizontal seam connector element (143) has on one of it's ends specifically to that end which is axially perpendicularly adjacent to the male longitudinal jointed seam connector element (68) and of the said internal sheet decking and integrally formed and molded within it is one male longitudinal and horizontal seam connector junction (85) as per FIG. 34.

The Dummy Door component unit (45) is identical in configuration and content to that of a wall component unit (46). It maintains one constant transverse overall dimension which is always equal to that of the transverse overall width of said door opening component unit (49) counterpart. Both the dummy door component unit (45) and the door opening component unit (49) are always identical in overall size specifically their outer width and height and installed within opposite walls to each other within the same enclosure, as per FIG. 30.

The Door Opening Component Unit (49) consists of:

Three tiered access opening closure strip (92)
Two female hinge extenders (109)—affixed to (110)
Two female longitudinal jointed seam connector elements (67)—affixed to (110) and (111)
Three tiered web stiffeners (142)—affixed to (92), (110) and (111)
Two male longitudinal jointed seam connector elements (68)—affixed to (110) and (111)
Two inner male fastener tracks (62)—affixed to (111)
Two outer male fastener tracks (63)—affixed to (110)
Lintel vertical stiffener ribs (112)
Lintel horizontal stiffener ribs (113)
Rubber gasket seating cushion (76)
Intersecting rubber connectors (77)
Substantial External Sheet Decking (110)
Substantial Internal Sheet Decking (111)
Eight Set Square Up-stand Registers (78)
Transverse deflection stiffeners (71)—affixed to (110) and (111)
Longitudinal deflection stiffeners (72)—affixed to (110) and (111)
Two inner male horizontal seam connector element (143)—affixed to (111)
Two outer male horizontal seam connector element (144)—affixed to (110)
Raised and fielded panel (69)—formed within (110) and (111)
Air vent holes (94)—formed within (145)
Four female longitudinal jointed seam connector sockets (84)—affixed to (67), (110), (111), (143) and (144)
Four male longitudinal and horizontal junction connectors (85)—affixed to (68), (110), (111), (143) and (144)

Four pairs of fulcrum mounts (87)—affixed to (111)
Parameter Gasket (91)
Pressure Compensating Door closing device (86)

These features are described in detail hereinbelow.

Figure 38:
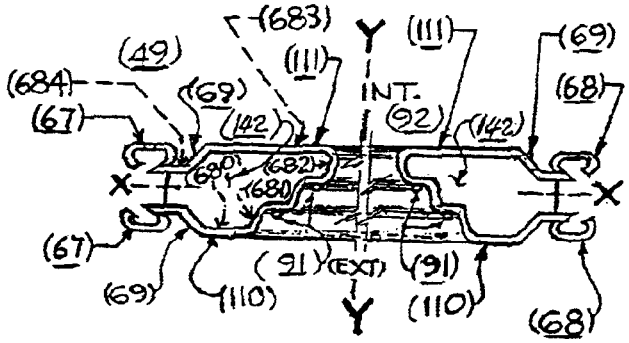
FIG. 38—Reveals a cross sectional transverse axis view of the door opening component unit (49) as per FIG. 36.
Figure 36:
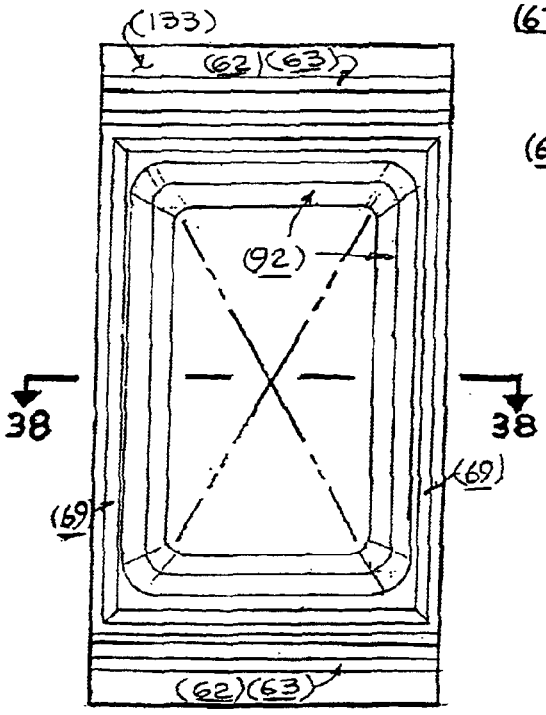
FIG. 36—Displays an elevational view of a typical door opening component unit (49).
Figure 39:
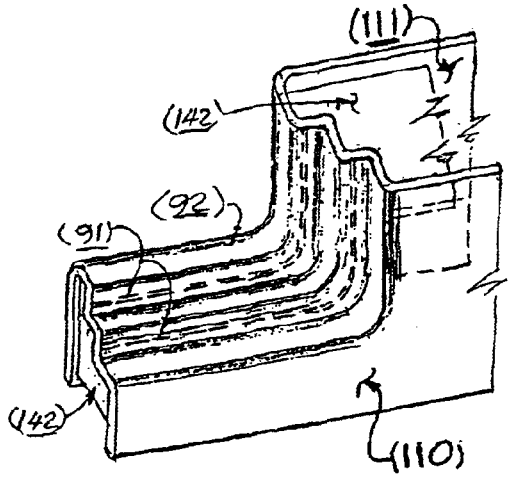
FIG. 39—Shows a blown up corner detail of the door opening component unit (49) which also displays a portion of the three tiered access opening closure strip (92) and the Parameter Gasket (91) in position.

As per the drawings which illustrate embodiments of the invention specifically FIGS. 36, 38 and 39, the door opening component unit (49) is formed within it's cross sectional configuration with an apparent rectangular three tiered and tapered opening (92) within it's interior surface to accommodate the aforementioned door module (50) and having a standard sized access opening within it's middle to accommodate one standard sized door module. At the top of the access opening is a lintel (133). Directly beneath the opening is a threshold (134). The threshold remains the same size regardless of the height of the said door opening component unit. At both longitudinal sides of the door opening and adjacent to it are two portions (135) that are equal in width which is also equal to the height of the said threshold. The overall width measured along the transverse extremity of the said door opening component unit will be between 900 mm (36") and 1350 mm (54") and will be of equal value to that of the dummy door component unit (45).

The raised and fielded panel (69) is formed within the surfaces of the internal and external sheet decking and traverses the most inner and most outer surfaces respectively of the sheet deckings. The raised and fielded panel (69) is located a short distance away from the four extremities of the sheet decking and parallel to it and yet still adjacently located on the farthest side of the seam connector elements relative to said extremities of the said sheet decking. The raised and fielded panel creates an elevated panel within the areas surrounding the centrally inner regions of the sheet decking with perpendicular corners (132) and serves as a protection to the seam connectors, as per FIG. 32.

The substantial external sheet decking of the door opening component unit (110) has integrally formed and molded within it's inner cavity surface and located within it's lintel (133) area and projecting perpendicularly inwardly from it two set square up-stand registers (78) offset at a given distance away from each of it's two upper corners. Also an additional two (78) of which are located directly vertically beneath the first two set square up-stand registers and projecting perpendicularly inwardly and of a specified distance away from the lower extremity of said lintel (133) as per FIG. 31. Also having two outer male fastener tracks (63) one each integrally formed and molded along it's transverse horizontal upper and lower extremities and sharing the same parallel plane. Within each of it's two longitudinal vertical extremities is integrally formed and molded two female longitudinal jointed seam connector element (67). Situated upon and within the external sheet decking's (110) outer surface are two female hinge extenders (109). One pivoted extender is located at the upper left side of the door opening. The other is at the lower left side of the door opening and directly beneath the upper extenders. Both pairs of female hinge pivoted extenders (109) are in horizontal as well as vertical alignment with each other. Each female extender possesses an elongated adjustable slotted through hole (136) semi circular at both it's ends all of equal size and is formed perpendicularly to the external surface of the enclosure and are in direct vertical alignment with each other. The purpose of the slotted holes (136) is to allow a sliding fit for the hinge pivoted pins (122) which are fixed to both male hinged extenders (120) of the door module but slides within said slots after the door installation, as per FIGS. 36 and 38.

The substantial internal sheet decking (111) of the door opening component unit has integrally formed and molded within it's inner cavity surface and located within it's lintel (133) area and projecting perpendicularly inwardly from the cavity surface and in direct alignment with those affixed to the external sheet decking's inner surface are two set square up-stand registers (78) offset at a given distance away from each of it's two upper corners. Also an additional two (78) of which are located directly vertically beneath the first two set square up-stand registers and projecting perpendicularly inwardly and of a specified distance away from the lower extremity of said lintel as per FIG. 31. Also having two male fastener tracks (63) one each integrally formed and molded and adjacent to it's transverse horizontal upper and lower extremities and sharing the same parallel plane. Within one of it's two longitudinal vertical extremities is integrally formed and molded one female longitudinal jointed seam connector element (67). One upper and one lower male horizontal seam connector element (143) is integrally formed and molded within and upon the opposite surface to that of it's cavity surface of the door opening component unit's internal sheet decking and at a specified distance away from it's upper and lower transverse extremities and integrally affixed adjacently between and parallel to the inner male fastener track (62) and the raised and fielded panel (69). The male horizontal seam connector element (143) has on one of it's upper and lower ends specifically to that end which is axially perpendicularly adjacent to the longitudinal male jointed seam connector element (68) and of the said internal sheet decking and integrally formed and molded within it is one male longitudinal and horizontal seam connector junction (85) as per FIG. 34.

The Lintel Vertical Stiffener Rib (112) posses intersecting recesses (128). These are narrow recesses which extends to more than one half the width of the rib. The Lintel Horizontal Stiffener Ribs (113) also have intersecting recesses (128) which also extends to more than one half the width of the transverse rib. Both transverse and longitudinal ribs have equal widths and equal size recesses. Corrugated openings (129) are formed along both lengthwise extremities of the longitudinal and transverse stiffener ribs. These corrugated openings (129) are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses and corrugated openings (129). One intersecting rubber connector (77) is snugly fitted within each intersecting recess of the Lintel Vertical stiffener ribs (112) and the Lintel horizontal stiffener ribs (113) are subsequently snugly fitted within the intersecting rubber connectors on edge and perpendicular to each other this process continues thus forming the stiffener rib assembly. A stiffener rib assembly is provided for the lintel (133) portion that is located directly above the access opening of the door opening component unit. The height of the lintel will vary in accordance with the height of the enclosure, as per FIGS. 13, 17, 18, 23, 42 and 45.

One upper and one lower male horizontal seam connector element (144) is integrally formed and molded within and upon the opposite surface to that of it's cavity surface of the door component unit's external sheet decking and at a specified distance away from it's upper and lower transverse (110) extremities and integrally affixed adjacently between and parallel to the outer male fastener track (63) and the raised and fielded panel (69). The male horizontal seam connector element (144) has on one of it's upper and lower ends specifically to that end which is axially perpendicularly adjacent to the male longitudinal jointed seam connector element (68) and of the said external sheet decking and integrally formed and molded within it is one male longitudinal junction connector (85) as per FIG. 34. The substantial external sheet decking (110) is also provided with and conveniently located upon it's outer surface that which is opposite to it's cavity surface provisions to accommodate a small surface mounted "occupied" illuminated sign (137). These features are shown in FIGS. 10, 12, 25, 36, 38 and 39.

As per FIG. 34, both substantial internal (111) and external (110) wall sheet deckings of the door opening component unit (49) will possess within both extremities of their female longitudinal jointed seam connector element (67) and in a horizontally outward direction one female longitudinal jointed seam connector socket (84) having each integrally formed and molded within one extremity and on the same side of both upper and lower male horizontal seam connector elements (143) for the purpose of accommodating the male horizontal seam connector elements of the adjacent wall module/component units, as per FIG. 25

The male longitudinal and horizontal junction connectors (85) is provided upon all wall component sides internal and external sheet decking specifically at the location where the male longitudinal jointed seam connector element (68) converges with the inner and outer male horizontal seam connector element (143) and (144) respectively, as per FIG. 34.

Small air vent holes (94) are formed along the shafts of the male and female longitudinal jointed seam connector elements. The male and female horizontal seam connector elements are in precise locational alignment with their mating partners in order to facilitate the assembly process specifically (143)(144)(65)(66)(67) and (68), as per FIG. 34 or 35.

The access opening within the door component unit is bonded by a three tiered configurations and is integrally formed and molded within the substantial internal and external sheet decking and is of a thicker gage than that of a typical sheet decking for the purpose of maintaining a close tolerance fit within the parameters of the seal which is made with the extremities of the door module when in the closed position. Having a uniform and parallel angular chamfered within the three tiered within the perimeter of the access opening with four filleted corners of an inner radius which is equal to the outer mating radius surfaces of the door module (50). Substantially U-shaped three tiered web stiffeners (142) are equally spaced integrally formed and molded and positioned perpendicularly upright within the cavity surfaces of all access opening closure strips and the adjacent internal and external sheet deckings, as per FIGS. 36, 38 or 39.

One of Four Pressure Compensating Door Closing Devices (86) comprise:

One closing arm (114)
One tension arm (115)
One closure fulcrum pin (88)
One closure pivot pin (89)

The Door Module (50) consists of:

Door Module Three Tiered Internal Perimeter (141)—affixed to (118)(119)(142)
U-Shaped Three Tiered Web Stiffeners (142)—affixed to (118)(119)(141)
Transverse deflection stiffeners (71)—affixed to (71)(118)(119)
Longitudinal deflection stiffeners (72)—affixed to (71)(118)(119)
One exterior sheet decking (118)—affixed to (141)(121)(123)
One interior sheet decking (119)—affixed to (141)(124)(123)
Longitudinal stiffener ribs (74)
Transverse stiffener ribs (75)
Rubber gasket seating cushions (76)
Intersecting rubber connectors (77)
Eight Set Square Up-stand Registers (78)—affixed to (118)(119)
Two male hinge extenders (121)—affixed to (118)
Two hinge pivot pins (122)—forced fitted to (121)
Three intermediate door handles (123)—affixed to (119)
Four door closing anchor hooks (124)—affixed to (119)(141)
One vacuum pressure valve (159)—affixed to (119)

These features are described in detail hereinbelow.

Figure 47:
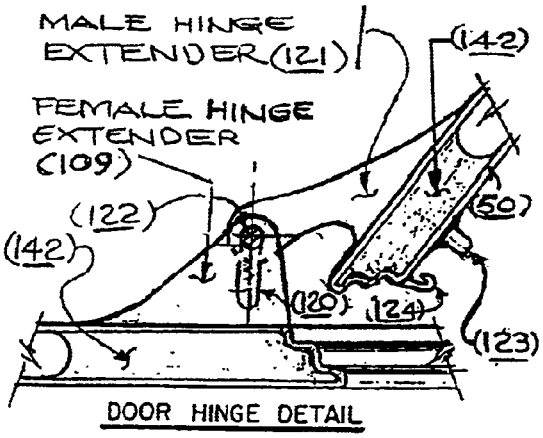
FIG. 47—Displays the door module hinged detail.

The door module (50) is preferably of one standard size. It is symmetrically chamfered at a specific angle along it's four perimeter extremities and is filleted about it's four corners and within said chamfered sides is a three tiered configuration with a reasonably sized outer radius fillet which is equal for all it's four corners and made to sit flush within it's opening which also has an identical angular chamfer on all it's four chamfered sides and a correspondingly equal inner radius fillet within it's corresponding chamfered edges. Door module thickness is greater than that of a component side's thickness. The four enclosure sides (141) which are substantially three tiered molded thicker than it's adjoining sheet decking for the purpose of maintaining a continuous close tolerance fit within the parameters of the door opening and the door modules's extremities respectively while subjected to vacuum pressure working stresses. The door module's three tiered chamfered inner sides also possess substantially U-shaped three tiered end enclosure web stiffener ribs (142) which are equally spaced and Integrally formed and molded within the door module's inner cavity surface and projecting perpendicularly outward from it, as per FIGS. 47 & 49

Figure 49:
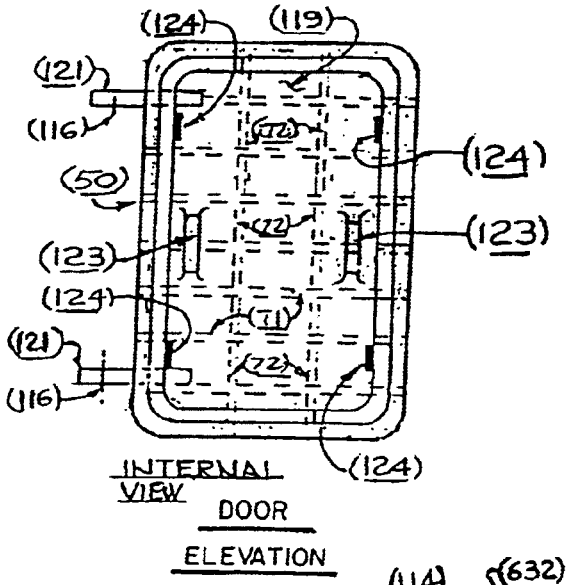
FIG. 49—Shows a typical inner elevational view of the door module (50).
Figure 50:
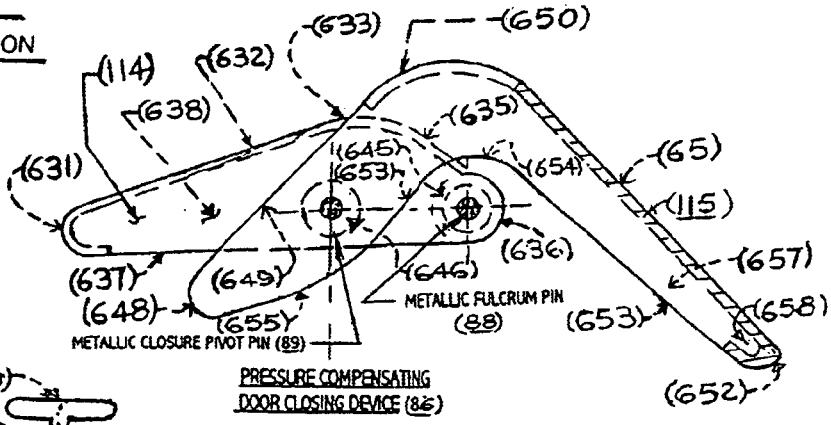
FIG. 50—Reveals an elevational view of the pressure compensating door closing device (86) which is attached to the door opening component unit (49) substantial internal sheet decking (111).

The door module external and internal sheet decking comprise as per FIG. 49 within their cavity surfaces transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffeled cavity surface pattern. The door module's internal sheet decking (119) having integrally formed and molded within it's inner cavity surface is one set square up-stand register (78) offset at a given distance away from each of it's four quadrantal corners. These features are shown in FIGS. 28 & 29.

Figure 46:
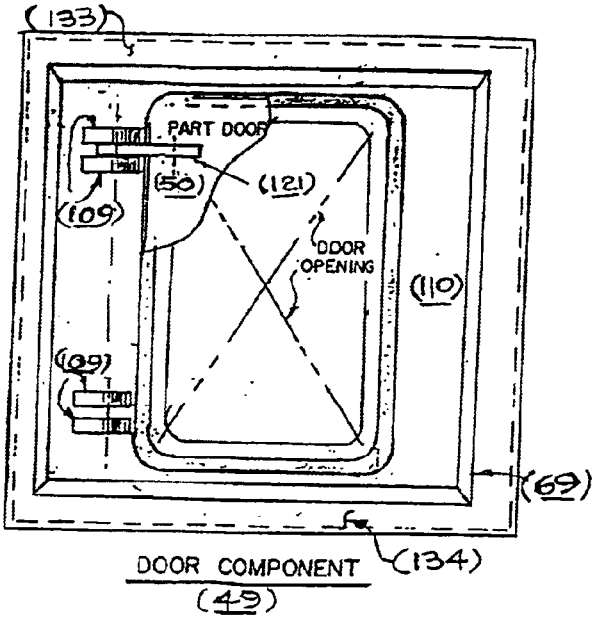
FIG. 46—Illustrates an elevational view of a typical door opening component unit (49).

The door module external sheet decking (118) having integrally formed and molded within it's inner cavity surface and projecting perpendicularly inwardly from it and also in perpendicular alignment with it's corresponding up-stand registers as located on the opposing cavity surface of the internal sheet decking is one each set square up-stand register (78) offset at a given distance away from each of it's four quadrantal corners. Situated upon and within the external sheet decking's outer surface of the door module are two male pivoted hinge extenders (121). One pivot extender is located at the upper left side and the other is located directly beneath it. Both male pivot extenders are in horizontal as well as vertical alignment with each other. Each female hinge extender (109) possess an adjustable slot through hole (120) having semicircular ends. Both adjustable slots (120) are perpendicularly formed to the plane of the door opening component unit's (49) external sheet decking's surface (110) and are equal in size also in parallel and vertical alignment with each other. It is proposed that the hinge pivot pins (122) Will be equal in size to each other and having a slightly smaller diameter than that of the width of the adjustable slotted holes (120). It is also proposed that the male hinge extenders (121) will possess a through hole of a slightly smaller diameter than that of the width of the said adjustable slotted holes (120) within which a tight tolerance fit to accommodate the hinge pivot pins (122). This arrangement will allow the door module to move with a close sliding tolerance fit along it's male hinge extenders which is sandwiched between the female hinge extenders subsequent to assembly, as per FIGS. 46 & 47.

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses. Corrugated openings (129) are formed along both lengthwise extremities of the longitudinal and transverse stiffener ribs. These corrugated openings are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses and corrugated openings (129). One intersecting rubber connector (77) is snugly fitted within each intersecting recess of the longitudinal stiffener ribs and the transverse stiffener ribs are subsequently snugly fitted within the intersecting rubber connectors on edge and perpendicular to each other. This process continues thus forming the stiffener rib assembly as shown in FIGS. 13, 17, 18, 23, 29, 42 and 45.

Allowance will be made to accommodate four pressure compensating vice clamping locking mechanisms a necessary door closing device in order to ensure a tight fit around it's edges when in the closed position. This door is to open outward away from the enclosure and provided with four pressure compensating tamper proof door closing devices (86). Each will be surface mounted internally upon and adjacent to each corner of the door module to the interior of the door module. The door closing device will be a pressure compensating type in order to ensure a tight continuous seal around it's opening. These features are shown in FIGS. 37, 50, 51, 52 and 53.

The Roof End Modules (51) consists of:

One external-end sheet decking (98)
Two Female longitudinal jointed seam connector elements (67)—affixed to (96)(98)
Two Transverse ends enclosure strips (73)—affixed to (98)(100)(126)
One longitudinal end enclosure strip (95)—affixed to (98)(100)(126)
One internal-end sheet decking (96)
Two Internal Sheet Decking Sealing Strips (83)—affixed (96)
One Inner Female fastener track (60)—affixed to (80)(96)
One outer Female fastener track (61)—affixed to (73)(95)
Longitudinal stiffener Ribs (74)
Transverse stiffener Ribs (75)
Rubber gasket seating cushion (76)
Intersecting Rubber Connectors (77)
Four Set Square Up-stand Registers (78)—affixed to (98)
Four Set Square Down-stand Registers (138)—affixed to (96)
Roof bearing ribs (126)—affixed to (73)(95)(98)(100)
External female fastener buttresses (79)—affixed to (73)(95)
Rib stiffener flange (100)—affixed to (73)(82)(95)(126)
Internal female fastener buttresses (80)—affixed to (60)(96)
Lateral stabilizing ribs (82)—affixed to (98)(100)(126)
Transverse deflection stiffeners (71)—formed within (96)(98)
Longitudinal deflection stiffeners (72)—formed within (96)(98)
One inner female horizontal seam connector element (66)—affixed to (60)
One outer female horizontal seam connector element (65)—affixed to (61)
Raised and fielded panel (69)—formed within (96)(98)
Air vent holes (94)—formed within (145)
One vacuum pressure valve (159)—affixed to (96)

These features are described in detail hereinbelow.

The roof end module's internal sheet decking comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The raised and fielded panel (69) is formed within the surface of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel creates an elevated panel within the areas surrounding the centrally inner regions of the sheet decking with perpendicular corners and serves as a protection to the seam connectors, as per FIG. 32.

The roof end module's external-end sheet decking (98) has integrally formed and molded within it's inner cavity surface and downrightly perpendicular to it a set square down-stand register (138) which is offset a given distance away from each of the four corners. Also in a perpendicularly downright position to the external end sheet decking's inner cavity surface and at it's extremities integrally formed and molded are three consecutive enclosure strips of which two are transverse end enclosure strips (73) and one is a longitudinal end enclosure strip (95) all having the outermost female fastener track (61) integrally formed and molded and in a vertically downright position within the lower extremities and sharing the same parallel plane with the three end enclosure strips. On the external-end sheet decking's longitudinal edge and opposite to that edge which the longitudinal end enclosure strip is connected there is also integrally formed and molded and sharing the same parallel plane as that of the external end sheet decking is the female longitudinal jointed seam connector element (67), as per FIG. 20.

The roof end modules (51) also comprise within it's three enclosed extremities of it's cavity and integrally formed and molded within the cavity surfaces of it's longitudinal (95)

and transverse (73) end enclosure strips and it's external-end sheet decking (98) are equally spaced and perpendicularly downright roof bearing ribs (126). These are also reinforced with lateral stabilizing ribs (82) which are integrally formed and molded within the external end sheet decking and roof end module bearing ribs and uprightly perpendicular to it, as per FIG. 9.

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses. Corrugated openings (129) are formed along both lengthwise extremities of the longitudinal and transverse stiffener ribs. These corrugated openings are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses and corrugated openings (129). One intersecting rubber connector (129) is snugly fitted within each intersecting recess of the longitudinal stiffener ribs and the transverse stiffener ribs are subsequently snugly fitted within the intersecting rubber connectors on edge and perpendicular to each other. This process continues thus forming the stiffener rib assembly, as per FIGS. 13, 17, 18, 23, 42 and 45.

Figure 19:
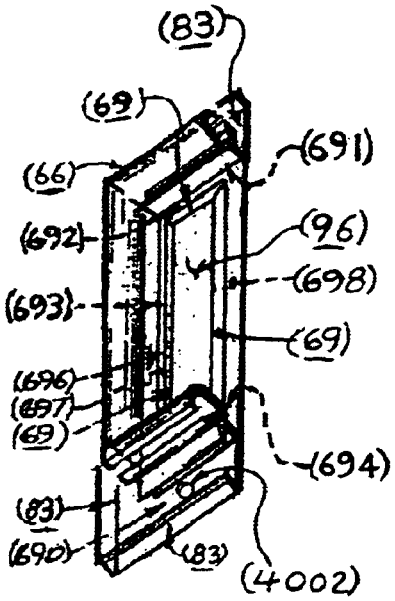
FIG. 19—Depicts the floor and roof end module internal sheet decking (96).
Figure 31:
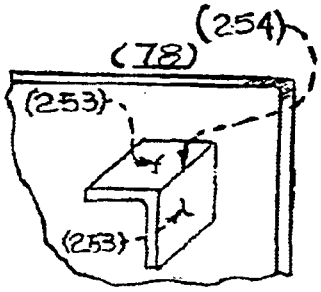
FIG. 31—Shows a typical detail of a Set Square Up-stand Register (78).

The internal-end sheet decking has integrally formed and molded within it's inner cavity surface and uprightly perpendicular to it one set square up-stand register (78) offset at a given distance away from each of it's four corners. Also within the internal-end sheet decking and peripherally located along one longitudinal extremity and both transverse ends consecutively is integrally formed and molded on it's three edges in a perpendicularly downright position an internal sheet decking sealing strip (83). Also having along it's fourth edge and integrally formed and molded within it is a female longitudinal jointed seam connector element (67). These features are shown in FIGS. 19 and 31.

Small air vent holes (94) formed along the shafts (145) of the male and female longitudinal jointed seam connector elements. The male and female horizontal seam connector elements are in precise locational alignment with their mating partners in order to facilitate the assembly process specifically (143), (144), (65), (66), (67) and (68), as per FIGS. 34 and 35.

The roof end modules (51) having without the extremities of it's cavity and externally to it integrally formed and molded within the outer surfaces of it's transverse ends enclosure strips (73) and longitudinal end enclosure strip (95) equally spaced and perpendicularly upright are external female fastener buttresses (79). Also integrally formed and molded within the roof end module's internal sheet decking (96) and the internal female fastener track (60) are internal female fastener buttresses (79). These are also equally spaced and perpendicularly upright to both surfaces as per FIGS. 20 and 25.

The Roof Intermediate Module (52) consists of:

One intermediate external sheet decking (99)
Two female longitudinal jointed seam connector elements (67)—affixed to (97)(99)
Two transverse end enclosure strips (73)—affixed to (61)(65)(99) One intermediate internal sheet decking (97)
Two male longitudinal jointed seam connector elements (68)—affixed to (97)(99)
One outer Female fastener track (61)—affixed to (73)(79)
One inner Female fastener track (60)—affixed to (80)(97)
Longitudinal Stiffener Ribs (74)
Transverse Stiffener Ribs (75)
Rubber gasket seating cushion (76)
Intersecting Rubber Connectors (77)
Four Set Square Up-stand Registers (78)—affixed to (97)
Four Set Square Down-stand Registers (138)—affixed to (99)
External Female Fastener Buttresses (79)—affixed to (61)(73)
Internal female fastener buttress (80)—affixed to (60)(97)
Roof bearing ribs (126)—affixed to (73)(82)(99)(100)
Rib stiffener flange (100)—affixed to (82)(126)
Two intermediate internal sheet decking sealing strips (83)—affixed to (97)
Lateral Stabilizing Ribs (82)—affixed to (99)(100)(126)
Transverse deflection stiffeners (71)—formed within (72)(97)(99)
Longitudinal deflection stiffeners (72)—formed within (71)(97)(99)
One inner female horizontal seam connector element (66)—affixed to (97)
One outer female horizontal seam connector element (65)—affixed to (99)
Raised and fielded panel (69)—formed within (97)(99)
Air vent holes (94)—formed within (145)

These features are described in detail hereinbelow.

The roof intermediate module's internal sheet decking comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The raised and fielded panel (69) is formed within the surface of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel creates an elevated panel within the areas surrounding the centrally inner regions of the sheet decking with perpendicular corners and serves as a protection to the seam connectors, as per FIG. 32.

The roof intermediate external sheet decking (99) integrally formed and molded within it's inner cavity surface and downrightly perpendicular to it one set square down-stand register (138) which is offset at a given distance away from each of it's four corners. One female fastener track is integrally formed and molded along one longitudinal edge of each of it's two transverse ends enclosure strips. The end enclosure strips are both subsequently integrally formed and molded in a perpendicularly downright position to the transverse extremities of the intermediate external sheet decking. Within each of it's two longitudinal extremities is integrally formed and molded to each one female longitudinal jointed seam connector element (67) and one male longitudinal jointed seam connector element (68) respectively. These features are shown in FIGS. 21 & 31.

The roof intermediate module (52) also comprises within the extremities of it's cavity of it's transverse ends integrally formed and molded within the inner cavity surfaces of the transverse end enclosure strips and it's intermediate external sheet decking equally spaced and perpendicularly downright roof intermediate module bearing ribs (126) which are also reinforced with lateral stabilizing ribs (82). These are integrally formed and molded within the roof intermediate external sheet decking and the roof bearing ribs (126) and uprightly perpendicular to it, as per FIG. 9

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses. Corrugated openings (129) are formed along both lengthwise extremities of the longitudinal and transverse stiffener ribs. These corrugated openings are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses and corrugated openings (129). One intersecting rubber connector (77) is snugly fitted within each intersecting recess of the longitudinal stiffener ribs and the transverse stiffener ribs are subsequently snugly fitted within the intersecting rubber connectors on edge and perpendicular to each other. This process continues thus forming the stiffener rib assembly. These features are shown in FIGS. 13, 17, 18, 23, 42 and 45.

The roof intermediate internal sheet decking (97) comprise as per FIG. 29, Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The roof intermediate internal sheet decking (97) has integrally formed and molded within it's inner cavity surface and uprightly perpendicular to it one set square up-stand register (78) offset at a given distance away from each it's four corners. Also within the intermediate internal sheet decking and peripherally located along it's two transverse ends are integrally formed and molded in a perpendicularly downright position two intermediate internal sheet decking sealing strips (83). Also perpendicularly downright to the internal sheet decking's surface and inwardly offset and parallel to the outer female fastener track (61) for a distance of a typical component side's thickness is the inner female fastener track (60) integrally formed and molded within the intermediate internal sheet decking. Having within it's longitudinal extremity integrally formed and molded one female longitudinal jointed seam connector element (67) and one male longitudinal jointed seam connector element (68) one element assigned to each longitudinal side respectively. These features are shown in FIG. 22 or 31.

Figure 24:
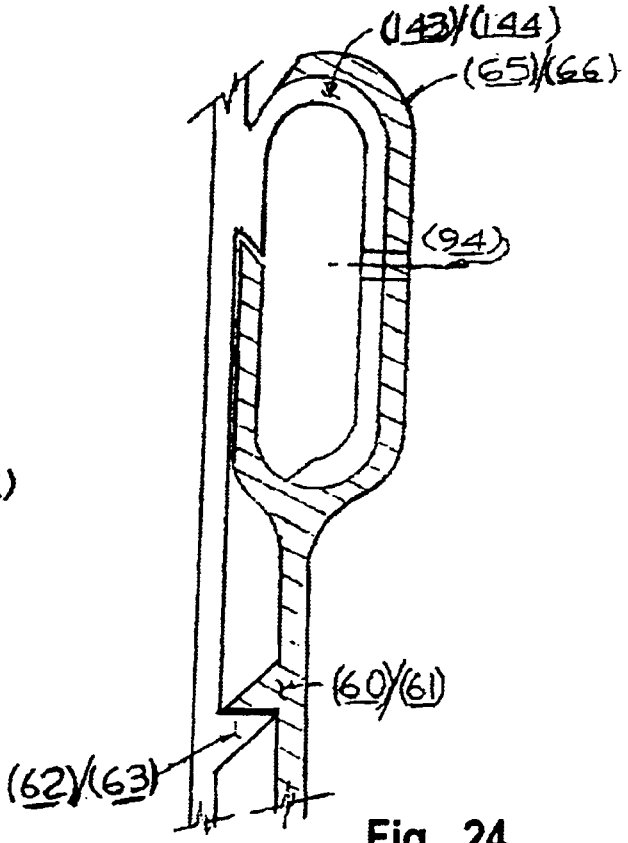
FIG. 24—Reveals a typical female horizontal seam connector element interlocked with the male horizontal seam connector element.

Small air vent holes (94) formed along the shafts of the male and female longitudinal jointed seam connector elements. The male and female horizontal seam connector elements are in precise locational alignment with their mating partners in order to facilitate the assembly process specifically (143), (144), (65), (66), (67) and (68). These features are shown in FIGS. 24, 34 & 35.

The roof intermediate modules (52) having without the extremities of it's cavity and externally to it integrally formed and molded within the outer surfaces of it's transverse ends enclosure strips equally spaced and perpendicularly upright are external female fastener buttresses (79). Also integrally formed and molded within the intermediate internal sheet decking (97) and the internal female fastener track (60) are internal female fastener buttresses. These are also equally spaced and perpendicularly downright to both surfaces, as per FIGS. 14 & 25.

The Roof Component Unit (53) consists of:

One component unit external sheet decking (102)
Two female longitudinal jointed seam connector element (67)—affixed to (102)(103)
Two transverse end enclosure strips (73)—affixed to (100)(102)(126)
One component unit internal sheet decking (103)
Two internal sheet decking sealing strips (83)—affixed to (103)
Two male longitudinal jointed seam connector elements (68)—affixed to (102)(103)
One outer Female fastener track (61)—affixed to (73)(79)
One inner Female fastener track (60)—affixed to (80)(103)
Longitudinal Stiffener Ribs (74)
Transverse Stiffener Ribs (75)
Rubber gasket seating cushion (76)
Intersecting Rubber Connectors (77)
Four Set Square Up-stand Registers (78)—affixed to (103)
Internal Female Fastener Buttress (80)—affixed to (60)(103)
Four Set Square Down-stand Registers (138)—affixed to (102)
External Female Fastener Buttresses (79)—affixed to (61)(73)
Roof bearing ribs (126)—affixed to (73)(82)(100)(102)
Rib stiffener flange (100)—affixed to (73)(82)(126)
Lateral Stabilizing Ribs (82)—formed within (100)(102)(126)
Transverse deflection stiffeners (71)—formed within (72)(102)(103)
Longitudinal deflection stiffeners (72)—affixed to (71)(102)(103)
One inner female horizontal seam connector element (66)—affixed to (103)
One outer female horizontal seam connector element (65)—affixed to (102)
Raised and fielded panel (69)—formed within (102)(103)
Air vent holes (94)—formed within (145)

These features are described in detail hereinbelow.

The roof component unit's internal sheet decking (102) comprise as per FIGS. 22 and 41. Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern.

The raised and fielded panel (69) is formed within the surface of the internal and external sheet decking and traverses the most inner and most outer surfaces respectively of the sheet decking. The raised and fielded panel (69) is located a short distance away from the four extremities of the sheet decking and parallel to it and yet still adjacently located on the farthest side of the seam connector elements relative to said extremities of the said sheet decking. The raised and fielded panel creates an elevated panel within the areas surrounding the centrally inner regions of the sheet decking with perpendicular corners and serves as a protection to the seam connectors. This is shown in FIG. 32.

The roof component unit external sheet decking (102) has integrally formed and molded within it's inner cavity surface and downrightly perpendicular to it one set square downstand register (138) which is offset at a given distance away from each of it's four corners. One female fastener track is integrally formed and molded and also share the same parallel plane along one longitudinal edge of each of it's two transverse ends enclosure strips (73). The end enclosure strips are both subsequently integrally formed and molded in a perpendicularly downright position to the transverse extremities of the component unit external sheet decking (102). Within each of it's two longitudinal extremities is integrally formed and molded and also share the same parallel plane to each one female longitudinal jointed seam connector element (67) and one male longitudinal jointed seam connector element (68) respectively. These are shown in FIGS. 21 and 31.

The roof component unit (53) also comprises within the extremities of the cavity of it's transverse ends and specifically within the cavity surfaces of the transverse end enclosure strips and it's external sheet decking integrally formed and molded and equally spaced and perpendicularly downright roof component unit bearing ribs (126) which are also reinforced with lateral stabilizing ribs (82) that are integrally formed and molded within the external end sheet decking and roof component unit bearing ribs and uprightly perpendicular to it.

The longitudinal stiffener ribs (74) posses intersecting recesses (128). These are narrow recesses which extends to more than one half the width of the rib. The transverse stiffener ribs (75) also have intersecting recesses (128) which also extends to more than one half the width of the transverse rib. Both transverse and longitudinal ribs have equal widths and equal size recesses. Corrugated openings (129) are formed along both lengthwise extremities of the longitudinal and transverse stiffener ribs. These corrugated openings are shaped and positioned with a clear fit within and over the transverse deflection stiffeners (71) and the longitudinal deflection stiffeners (72) respectively. The rubber gasket seating cushion (76) is glued with an approved adhesive to all of their extremities except within their recesses and corrugated openings (129). One intersecting rubber connector (77) is snugly fitted within each intersecting recess of the longitudinal stiffener ribs and the transverse stiffener ribs are subsequently snugly fitted within the intersecting rubber connectors on edge and perpendicular to each other. This process continues thus forming the stiffener rib assembly. This is described in FIGS. 30 & 42

The roof component unit's internal sheet decking comprise as per FIGS. 21 & 41. Transverse deflection stiffeners (71) which are integrally formed and molded within it's cavity surface having equal offsets between each other and also is parallel to it's transverse extremities. Longitudinal deflection stiffeners (72) are equally offset between each other and are perpendicularly intersected by the transverse deflection stiffeners (71) having integrally formed and molded within the cavity surface of the sheet decking and at it's contact points of the transverse deflection stiffeners. The integrated combination of both longitudinal and transverse deflection stiffeners reveal a substantially apparent waffled cavity surface pattern. This is shown in FIG. 29.

The roof component unit's internal sheet decking has integrally formed and molded within it's inner cavity surface and uprightly perpendicular to it one set square up-stand register (78) offset at a given distance away from each it's four corners. Also within the internal sheet decking and peripherally located along it's two transverse ends are integrally formed and molded in a perpendicularly downright position two internal sheet decking sealing strips (83). Also perpendicularly downright to the internal sheet decking's surface and inwardly offset and parallel to the outer female fastener track (61) for a distance of a typical component side's thickness is the inner female fastener track (60) integrally formed and molded within the component unit internal sheet decking. Having within it's longitudinal extremity integrally formed and molded one female longitudinal jointed seam connector element (67) and one male longitudinal jointed seam connector element (68) one element assigned to each longitudinal side respectively. This is shown in FIGS. 21 and 22.

Small air vent holes are formed along the shafts of the male and female longitudinal jointed seam connector elements (68) and (67) respectively. The male and female horizontal seam connector elements are in precise locational alignment with their mating partners in order to facilitate the assembly process as per FIGS. 25, 34 and 35.

The roof component unit (53) having without the extremities of it's cavity and externally to it integrally formed and molded within the outer surfaces of it's transverse ends enclosure strips (73) equally spaced and perpendicularly upright are external female fastener buttresses (79). Also integrally formed and molded within the roof component unit internal sheet decking and the internal female fastener track are internal female fastener buttresses (80). These are also equally spaced and perpendicularly downright to both surfaces. This is shown in FIG. 25.

The optional windowed wall intermediate module (3950) and windowed door module (3960) consist of:

Inner Male Fastener Track (62)
Outer Male Fastener Track (63)
Window Unit (4000)
Window perimeter gasket (4003)—affixed to (4000)
Acrylic Triangular stiffener (4004)—affixed within (4005)
Optically Clear Acrylic panes (4005)—affixed to (4004)
Acrylic window perimeter (4006)—affixed within (4005)
Window Opening three tiered closure strip (4007)—affixed to door
Window and Door transverse stiffener rib (4008)
Door longitudinal stiffener rib (4009)
Window Wall Intermediate Module transverse stiffener rib (4012)
Window opening internal sheet decking (4013)
Window opening external sheet decking (4011)
Rubber gasket seating cushion (76)—affixed to (71), (74), (4008) and (4012)
Depressurization holes (4002)—formed within (4003), (4004), (4006) and (4007).

These are described in detail hereinbelow.

Figure 88:
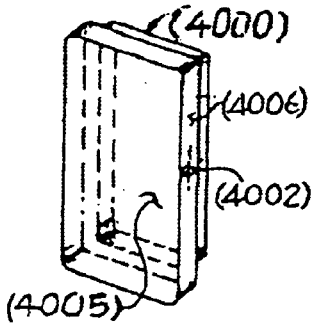
FIG. 88 displays a perspective view of the window unit (4000) as fully assembled.

The window unit (4000), as per FIG. 88 is laminated from substantially thick and clear acrylic material or equivalent. The unit is preferably transparent, and will exhibit optically clear properties, and display resistance to cracking, brittleness, and tearing either due to impact or working stresses. The material preferably possess the ability to resist deformity due to shrinkage or creeping, with virtually no sagging or buckling between acrylic triangular stiffeners (4004) while subject to vacuum working pressure. The acrylic, or equivalent material should have compatibility with the bonding solvents or equivalents.

The window unit is preferably depressurized through holes (4002) which are formed so that the holes are operatively aligned with each other when the units are assembled, in order that air can be extracted from the window unit (4000) simultaneously with the removal of air by vacuum pump from within all cavities of the noise suppression, sound proof chamber.

The acrylic window parameter (4006), which is preferably formed and molded about its transverse axis to a shape and size that is parallel to the perimeter of both interior and exterior optically clear panes (4005). The window parameter (4006) has its outer transverse longitudinal surface affixed in position along its thickened longitudinal edges, and sandwiched therebetween, in flush alignment with said perimeter extremities as per FIG. 88. Depressurization is achieved through holes (4002) formed, as shown, in registered alignment with the depressurization holes of window unit (4000).

Figure 93:
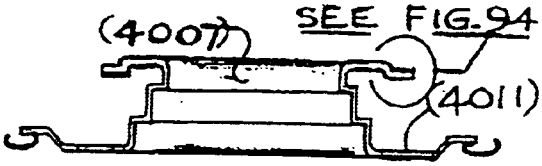
FIG. 93 shows a cross sectional view through said window external sheet decking (4011)
Figure 96:
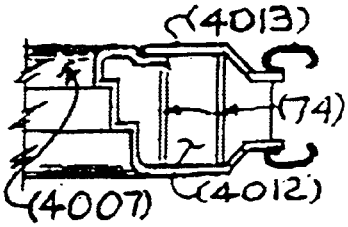
FIG. 96 shows a cross sectional detailed view of one side of the window opening of said windowed wall intermediate module (3950).

Window opening three tiered closure strip (4007) is integrally formed and molded in the configuration as shown in FIGS. 93 and 96, integrally affixed within the internal and external sheet decking. Said window unit, when installed, will be preferably tightly and evenly fitted within the tiers of the closure strip having the parameter gasket affixed within by means of an approved adhesive applied to all contact surfaces of the gasket. Depressurization through hole (4002) is achieved through three tiered closure strip (4007) as shown, and through alignment with the holes of acrylic window parameter (4006), and window unit (4000).

Figure 95:
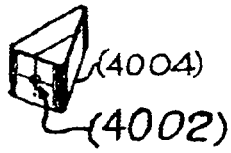
FIG. 95 shows a typical acrylic triangular stiffener (4004) having a depressurization hole (4002)

The acrylic triangular stiffener (4004), is preferably a substantially thick strip of optically clear acrylic which is formed about its transverse (width) axis to the shape of that of a substantial isosceles triangle as per FIG. 95, having one depressurization hole (4002) as shown. The width is substantially the thickness of the cavity between the innermost surfaces of internal and external acrylic panes (4005). The triangular stiffeners (4004) are preferably integrally fixed in position and location to be adjacent and parallel to an adjacent stiffener and to the window acrylic parameter (4006) where possible. The approved bonding solvent, or equivalent, is applied to both thickened longitudinal edges of the triangular stiffeners (4004), which are contact surfaces, sandwiched between both vacuumed surfaces of said acrylic interior and exterior panes (4005), and subjected to an evenly distributed pressure until dried.

Figure 89:
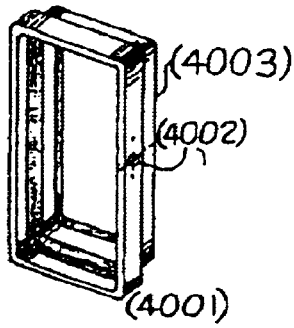
FIG. 89 is a perspective view which shows the window parameter gasket (4003) adjacent, but unattached to the window unit.

The window parameter gasket (4003) as per FIG. 89, having depressurization holes (4002), is formed and molded of a rubberized material or equivalent, exhibiting functional properties as discussed under the subtitle of "Expected properties and performances of all materials". The adhesive is applied to all external contact surfaces of said parameter gasket (4003) and said window opening three tiered closure strip (4007) wherein the window assembly in its entirety is mounted with a tight fit within said window opening three tiered closure strip (4007), as per FIGS. 90 and 91. All of the aforementioned depressurization holes (4002) are registered in alignment with each other to facilitate the vacuum pumping process.

Figure 92:
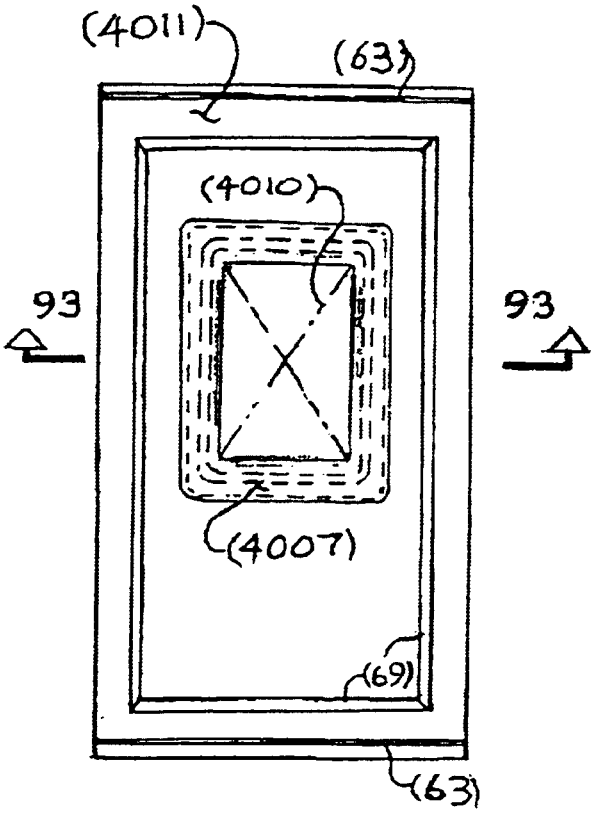
FIG. 92 displays an inner elevational view of the window opening external sheet decking (4011) having an opening to accommodate window unit (4000)

The window opening external decking (4001) would be identical in configuration to the external sheet decking (107) of a typical wall intermediate module (48), with the major difference comprising a window opening wherein the opening has an integrally formed and molded window opening three tiered closure strip (4007), all as per FIGS. 92 and 93.

During assembly, window transverse stiffener rib (4012), as per FIG. 96, having the previously mentioned longitudinal stiffener ribs (74), perpendicularly arranged inclusive of rubber seating cushions (76), having the previously mentioned intersecting rubber connectors (77) within their respective intersecting recesses (128) assembled in place, indexed and registered upon the aforementioned set square up-stand registers (78) which is offset at a given distance away from each of the four corners of the window opening external sheet decking (4011).

Figure 87:
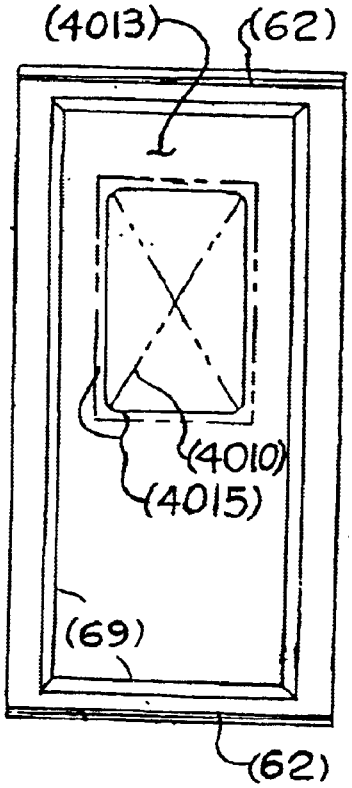
FIG. 87 shows a plan view fo the Window Opening Internal Sheet Decking (4013), on its side, having an opening to accommodate window unit (4000)
Figure 90:
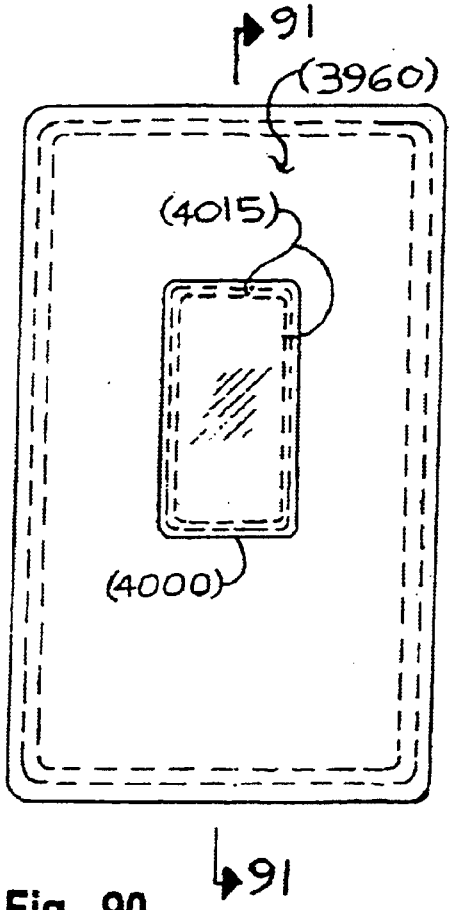
FIG. 90 shows an external elevational view of the windowed door module (3960) having window unit (4000) in place.
Figure 94:
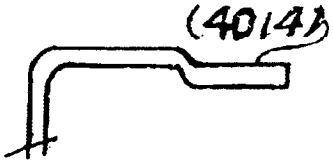
FIG. 94 shows an enlarged view of the "lip" detail upon which the window opening internal sheet decking (4013) is registered and sealed.
Figure 91:
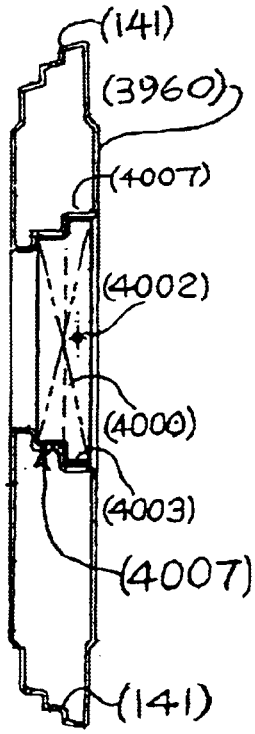
FIG. 91 shows a sectional elevation of the windowed door module.

Window opening internal sheet decking (4013) as per FIG. 87 having opening (4010) located in assembled perpendicular alignment to the plane of its external sheet decking counterpart, whereby approved sealing solvent is applied to all contact surfaces of both said internal and external sheet deckings, specifically the outer "lip" surface (4014) as per FIG. 94 and innermost surface adjacent to its window opening extremity (4015) as per FIGS. 87 and 90 of said window opening internal sheet decking (4013). This latter is indexed and registered in location and position whereby a uniform pressure is applied to contact areas until integrally bonded and sealed.

The aforementioned door module (50) may be optionally fitted with a window unit (4000) having similar features with respect to said windowed wall intermediate module (3950).

Detailed Elemental Description

Figure 9:
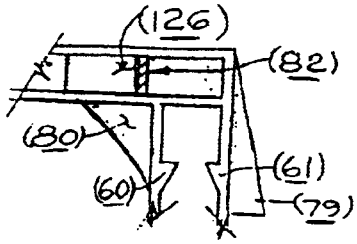
FIG. 9—Depicts a typical roof inner and outer female fastener parallel tracks (60) & (61) respectively.
Figure 12:
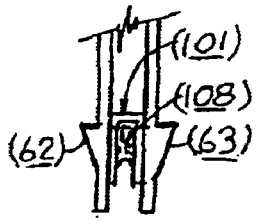
FIG. 12—Represents a typical cross sectional view taken along line 12—12 of FIG. 7 revealing the bottom of wall and wall corner module and wall component unit inner and outer male fastener tracks (62) & (63) respectively.
Figure 14:
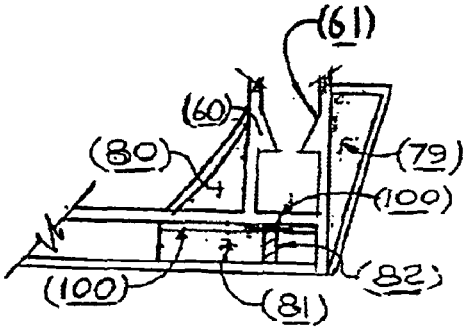
FIG. 14—Depicts a typical floor inner and outer female fastener parallel track (60) & (61) respectively.
Figure 10:
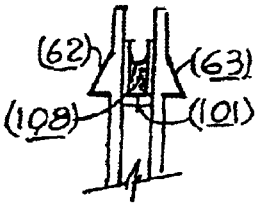
FIG. 10—Reveals the typical configuration of the top of wall and wall corner module and Component Unit inner and outer male fastener tracks (62) & (63) respectively.

An important object of the invention is the provision of the inner female fastener track (60) as shown in the drawings which illustrate embodiments of the invention; and specifically FIGS. 9 and 14. Each inner female fastener track (60) is integral with and projects perpendicularly from it's base which is formed within the aforementioned internal sheet decking's most inner surface. It's location and direction is preferably such that it is inset from and parallel to it's outer female fastener track (61). The inset is a distance which is equal to that of a wall component side thickness where it's configuration changes to that of a flat protruding lip (146) which is perpendicular to it's stem's cavity surface and projects parallel to it's base surface (147) to a point where it returns to it's former plane via a diagonal splay (148) which runs in a direction away from it's base (147) and towards it's stem (127) to a point where it's original thickness is resumed. The inner female fastener track (60) continues along it's said perpendicular projection to that of it's stem for a short specified distance (150). The inner female fastener track (60) maintains a constant cross sectional configuration throughout the extent of it's extrusional longitudinal axis, as per FIGS. 9, 14, and 25.

Another object of the invention is the provision of the outer female fastener track (61) as shown in the drawings which illustrate embodiments of the invention; and specifically FIGS. 9, 14 and 25. The outer female fastener track (61) is identical in shape and size to that of the inner female fastener track (60) and both tracks are parallel to each other and exists in the same perpendicular projected alignment. The outer female fastener track (61) is integrally formed and molded in a handed position to that of the inner female fastener track (60) and within one lengthwise extremity of each end enclosure strip and sharing it's parallel plane. They are located in all and only the external sheet decking of all the floor and roof component sides specifically those which are the end modules, intermediate modules, and component units (40), (41), (42), (51), (52) or (53) respectively. These are shown in FIGS. 9, 14 and/or 25.

Still another object of the invention is the provision of the Inner male fastener track (62) as per drawings which illustrate embodiments of the invention specifically FIGS. 6, 7, 10, 12, 25, 30 and 44. Male fastener tracks are located near the upper and lower extremities of the internal and external sheet decking of all wall corner modules (44) wall intermediate modules (48) wall component units (46) door opening component units (49) and dummy door component units (45). The lower inner male fastener track (62) is directionally handed to that of it's lower outer male fastener track (63) with both configurations facing each other. Said upper inner male fastener track and said upper outer male fastener track are both identical in configuration and size to the said lower male fastener track but are inversely positioned to the lower ones in accordance with their respective sheet decking. A wall internal sheet decking's lower inner male fastener track (62) commences at a specified short distance from it's lower extremities and tapering (151) in a most inwardly direction and away from the most inner surface of it's internal sheet decking and away from it's lowest extremity to a specific point where it changes direction toward said most inner surface of the internal sheet decking and perpendicular to it. These are shown in FIGS. 10, 12, 24, 25, 34 and/or 35.

Still another important object of the invention is the provision of the outer male fastener track (63) as per drawings which illustrate embodiments of the invention specifically FIGS. 10, 12, 25 and 34. Male fastener tracks are located near the upper and lower extremities of all wall corner modules (44) wall intermediate modules (48) wall component units (46) door opening component units (49) and dummy door component units (45). The lower inner male fastener track (62) is directionally handed to that of it's lower outer male fastener track (63). The upper inner male fastener track and upper outer male fastener tracks are both identical in configuration and size to the lower male fastener track but are inversely positioned to them in accordance with their respective sheet decking. A wall internal sheet decking's lower inner male fastener track (62) commences at a specified short distance from it's lower extremities and tapering in a most inwardly direction and away from the most inner surface of it's internal sheet decking and away from it's lowest extremity to a specific point where it changes direction toward said most inner surface of the internal sheet decking and perpendicular to it. These features are shown in FIGS. 10, 12, 24, 25 and/or 30.

Still another important object of the invention is the provision of the Outer male horizontal seam connector element (144) as per drawings which illustrate embodiments of the invention specifically FIGS. 24, 25 and 34. At a specific point further away from the lower extremity of the outer wall sheet decking and shortly above and beyond the lower outer male fastener track (63) within and upon the same surface of the sheet decking is the commencement (139) of the outer male horizontal seam connector element (144). At this specified point of contact and for a sustained short distance upon and within the outermost surface of the external sheet decking the outer male horizontal seam connector element (144) is affixed and commences with a specified thicker gage than that of the sheet decking with an outer radius semicircular curve (160) integrally formed and molded and tangential to the external sheet decking's outermost surface and is configured in a upward and over direction that is essentially clockwise with it's initial extremity commencing on it's X-axis and in it's second quadrant and it's terminal side terminating along said X-axis and in it's first quadrant respectively. At it's terminating point is further configured tangentially a straight portion downward (161) and toward the sheet decking lower extremity for a specified short distance where a circular arc with an equal outer radius curve as that of the first will be configured tangentially and in a clockwise direction terminating within it's third quadrant with an angular splayed substantially chiseled shaped end (162). Both the inner and outer female horizontal seam connector element's most inner surfaces is equal in shape and size to the inner surface of the female longitudinal jointed seam connector elements (167) which are all equal in shape and size to the outer surface of the male horizontal seam connector element (144) and male longitudinal jointed seam connector element (68) counterparts. These features are shown in FIGS. 24, 25, 32, 34 and/or 35.

Small circular holes (94) are provided along the shaft of the said outer male horizontal seam connector element and at specified regular intervals along the said exposed surface opposite to that of the inner cavity surface. Said vent holes are to be in alignment with corresponding vent holes of similar size and location along the shaft of it's mating counterpart (65) for the purpose of expelling the air during assembly as the injected melt is forced into the cylindrical sealing seam.

A still further important object of the invention is the provision of the outer female horizontal seam connector element (65) as per drawings which illustrate embodiments of the invention specifically FIG. 25. At the extremity of the outer female fastener track (61) which is in turn integrally affixed to the end enclosure strips of the external sheet decking of all floors and roof component sides is integrally formed and molded the female horizontal seam connector element (65) commencing with a semicircular inner radius curve (163) which is virtually equal to that of the outer radius curve (160) of the male horizontal seam connector element (144) the said inner radius semicircular curve (163) of the female horizontal seam connector element (65) is configured in both directions from it's point of fixation (164) where it is further reinforced with a thicker curved base above it's stem (165) and terminating at both extremities of the said semicircular curve (163) in parallel alignment with the surface of the external decking. At one extremity of the said semicircular radius curve specifically that which is located directly above the outer female fastener track (61) is integrally formed and molded tangentially to said extremity the first straight portion (164) which is parallel to the stem (165) and runs for about two thirds the distance of the entire said seam connector above the point of fixation and terminating with a substantially chiseled shaped end (153) with the seemingly sharp edge (156) toward it's outer surface and it's splayed edge virtually parallel to the opposing portion of it's aforementioned male element counterpart. At the other extremity of said semicircular radius curve and tangentially to it in a parallel and like direction to the first straight portion (164) is another straight portion (166) having a longer length than the first straight portion and terminating tangentially to it's extremity with the inner radius circular arc (167) of which itself finishes in it's second quadrant with a substantially chiseled shaped end (153) with it's seemingly sharp edge (156) toward it's inner surface. The female horizontal seam connector element's inner surfaces is equal in shape and size to the inner surface of the female longitudinal jointed seam connector elements (67). Both the said inner and said outer female horizontal seam connector element's most inner surfaces is equal in shape and size to the inner surface of the female longitudinal jointed seam connector elements (67) which are all equal in shape and size to that of their said male horizontal seam connector element and male longitudinal jointed seam connector element (68) counterparts outer surfaces. These features are shown in FIGS. 20, 21, 24, 25, 32 and/or 35.

Small circular holes (94) are provided along the shaft of the outer female horizontal seam connector element and at specified regular intervals along the said exposed surface opposite to that of the inner cavity surface. These vent holes are to be in alignment with corresponding vent holes of similar size and location along the shaft of it's mating counterpart for the purpose of expelling the air during assembly as the injected melt is forced into the cylindrical sealing seam. These features are shown in FIGS. 34 & 35.

Still a further important object of the invention is the provision of the inner female horizontal seam connector element (66) as per drawings which illustrate embodiments of the invention specifically FIG. 25. At the extremity of the inner female fastener track (60) which is itself integrally affixed to the internal sheet decking's innermost surface of all floors and roof component sides is integrally formed and molded the inner female horizontal seam connector element (66) commencing with a semicircular inner radius curve (170) which is virtually equal to that of the outer radius curve of the male horizontal seam connector element (143) the said inner radius semicircular curve (170) of the inner female horizontal seam connector element (66) is configured in both directions from it's point of fixation (171) where it is further reinforced with a thicker curved base (171) above it's stem and terminating at both extremities of the said semicircular curve (170) in parallel alignment with the surface of the internal sheet decking with both extremities initializing and terminating clockwise within it's fourth and third quadrants respectively. At one extremity of the semicircular radius curve specifically that which is located directly above the inner female fastener track (60) is integrally formed and molded tangentially to said extremity the first straight portion (172) which is parallel to the stem (173) and runs for about two thirds the distance of the entire seam connector (66) above the point of fixation and terminating with a substantially chiseled shaped end (153) with the seemingly sharp edge (156) toward it's outer surface and it's splayed edge virtually parallel to the opposing portion of it's aforementioned male element counterpart. At the other extremity at said semicircular radius curve and tangentially to it in a parallel and like direction to the first straight portion (174) having a longer length than the first straight portion and terminating tangentially to it's extremity with the inner radius circular arc of which itself finishes in it's first quadrant with a substantially chiseled shaped end (175) with it's seemingly sharp edge (176) toward it's inner surface. Both the aforementioned inner and outer female horizontal seam connector element's most inner surfaces is equal in shape and size to the inner surface of the female longitudinal jointed seam connector elements (67) which are all equal in shape and size to that of their aforementioned inner and outer male horizontal seam connector elements and said male longitudinal jointed seam connector element (68) counterparts. These features are shown in FIGS. 19, 22, 24, 25 and/or 32.

Small circular holes (94) are provided along the outer shaft of the inner female horizontal seam connector element and at specified regular intervals along the said exposed surface opposite to that of the inner cavity surface. Said vent holes are to be in alignment with corresponding vent holes of similar size and location along the shaft of it's aforementioned mating counterpart for the purpose of expelling the air during assembly as the injected melt is forced into the cylindrical sealing seam. This is shown in FIGS. 34 and 35.

Another object of the invention is the provision of the female longitudinal jointed seam connector element (67) as per drawings which illustrate embodiments of the invention specifically FIG. 32. The female longitudinal jointed seam connector element (67) is integrally formed and molded within the longitudinal extremity of the internal or external sheet decking to which it is affixed and having it configured upon it's outermost surface that which is opposite to it's inner cavity surface and facing outwards. The said female longitudinal jointed seam connector element (67) comprise a thicker gage than that of the sheet decking to which it is affixed and is of a gage that is equal to that of all other aforementioned seam connector elements. At one longitudinal extremity of the sheet decking is integrally formed and molded an added thickened gage (177) which configures into a substantial chiseled shaped end (153) of a specified angular measurement equal to that of all sheet decking longitudinal extremities for interlocking purposes. The said chiseled shaped end (153) commences at the outermost extremity of the sheet decking with an apparent sharp edge (156) and traverses in an inwardly direction at the aforementioned angular skew toward it's core surface where it terminates. Said angular splay (153) is equal to those of similar configuration on all interlocking configurations that are adjacent to the extremities of sheet deckings. On the opposite edge to that of the sharp edge (156) and for a short distance is a straight portion (181) at whose extremities commences an inner radius curve (179) of equal value to that of the outer radius (180) of it's said male mating counterpart (68). Is configured a semi circle (179) and at it's extremity and tangentially to it and parallel to the plane of it's sheet decking is a straight extended portion at the extremity of the extension (183) and tangential to it is the commencement of a circular arc of equal radius to that of it's assembled contact surface of its male mating counterpart (68). The said circular arc (178) is terminated within it's second quadrant with a splayed end (157) which is substantially parallel to the outer circular arc (180) opposing portion of it's male element counterpart specifically the position wherein initial contact is made during the assembly process and is expected to slide over it and lock into position. The female longitudinal jointed seam connector element (67) maintains a constant cross sectional configuration throughout the extent of it's extrusional longitudinal axis in accordance with this detailed description. Both the said inner and said outer female horizontal seam connector element's most inner surfaces is equal in shape and size to the inner surface of the female longitudinal jointed seam connector elements (67) which are all equal in shape and size to that of their said inner and said outer male horizontal seam connector elements and male longitudinal jointed seam connector element (68) counterparts. These features are shown in FIGS. 5, 32, 34, 35 and/or 38.

Small circular holes (94) are provided along the outer shaft of the said inner and said outer male horizontal seam connector elements and at specified regular intervals along the said exposed surface opposite to that of it's inner cavity surface. These said vent holes are to be in alignment with corresponding vent holes of similar size and location along the shaft of it's mating counterpart for the purpose of expelling the air during assembly as the injected melt is forced into the cylindrical sealing seam. This is shown in FIGS. 34 and/or 35.

Figure 5:
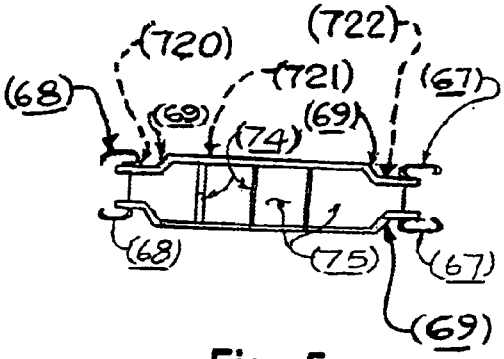
FIG. 5—Depicts a typical cross sectional transverse view of floor wall or roof intermediate module and component unit taken along line 5—5 in FIG. 7.

Still another object of the invention is the provision of the male longitudinal jointed seam connector element (68) as per drawings which illustrate embodiments of the invention specifically FIG. 34. The male longitudinal jointed seam connector element (68) is integrally formed and molded within the longitudinal extremity of the aforementioned internal and external sheet decking to which it is affixed and having it configured within and upon it's outermost surface that which is opposite to it's inner cavity surface and facing outwards. The said male longitudinal jointed seam connector element (68) comprise a thicker gage than that of the sheet decking to which it is affixed and is of a gage that is equal to it's female counterpart (67). At the opposite longitudinal extremity to that where it's female counterpart is affixed on said sheet decking is integrally formed and molded within it an added thickened gage distending within it's cavity surface and configures into a substantial chisel shaped end (153) of a specified angular measurement equal to that of all sheet decking longitudinal extremities for interlocking purposes. The splay commences at it's core surface extremity of the said sheet decking with a substantial chiseled point and configuring in a direction towards it's opposite edge in a receding manner where it converges with the opposite surface of said sheet decking. At this point the configuration of the male longitudinal jointed seam connector element projects parallel to the plane of the sheet decking and protrudes for a short straight distance (182) beyond the said chisel pointed extremity to a point where it configures in a direction away from the cavity surface tangential to it an outer radius curve (178) of equal value to that of the inner radius of it's female mating counterpart (179) is configured. At this point and tangentially to it and parallel to (182) and the plane of it's sheet decking is an extended portion (186) at the extremity of the extension and tangential to it is the commencement of a circular arc (180) of equal radius to that of it's opposing end (178). The said circular arc is terminated within it's fourth quadrant with a splayed end. The male longitudinal jointed seam connector element (68) maintains a constant cross sectional configuration throughout the extent of it's longitudinal axis. These features are shown in FIGS. 5, 34, 35 and/or 38.

Small circular air vent holes (94) are provided along the outer shaft of the male longitudinal jointed seam connector element (68) and at regular intervals along the said exposed surface opposite to that of the inner cavity surface. These vent holes are to be in alignment with corresponding vent holes of similar size and location along the shaft of it's mating counterpart for the purpose of expelling the air during assembly as the injected melt is forced into the cylindrical sealing core of the jointed seam connector. Both the inner and outer female horizontal seam connector element's most inner surfaces is equal in shape and size to the inner surface of the female longitudinal jointed seam connector elements (67) which are all equal in shape and size to that of their said inner and said outer male horizontal seam connector elements (143) and (144) respectively and said male longitudinal jointed seam connector element (68) counterparts as per FIGS. 5, 34, 35 and/or 38.

Still another object of the invention is the provision of the raised and fielded panel (69) as per the drawings which illustrate embodiments of the invention; and specifically FIGS. 30 & 32. All aforementioned internal and external sheet decking as described hereinbefore will possess one raised and fielded panel (69) to each. Having integrally formed and molded within the outer surface to that which is opposite it's cavity surface and traverses a short parallel distance away from the four edges and within the confines of the seam connector element and to be contained within and terminates along it's four extremities within the parameters and adjacent to the said seam connector elements as being specific to all aforementioned floors walls door and roof component sides said internal and external sheet decking including those of the said door module. Also aforementioned longitudinal jointed seam connector elements and all said inner female fastener tracks as being specific to all said floor and said roof component sides members. Having a said raised and fielded panel of specified angular inclination and depth (201) with specified short radius curves (200) at each change of direction from which said raised and fielded panel is formed. The purpose for this feature is to provide a protective cradled groove within which all said seam connectors will be protectively housed when adjacent modules and component units are subsequently joined to each other during the assembly process. These features are shown in FIGS. 19 to 22, 30 and/or 32.

Figure 15:
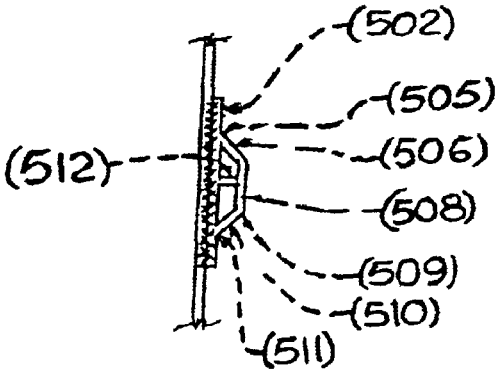
FIG. 15—Depicts a typical detail of the intermediate stiffener integrally bonded in position on typical sheet decking.
Figure 16:
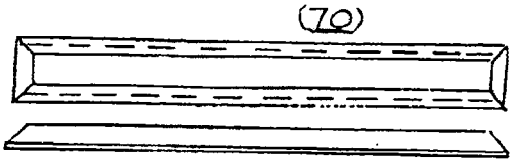
FIG. 16—Show a typical intermediate structural stiffener member in plan and elevational view (70).

A further object of the invention is the provision of the structural stiffener braces (70) as per drawings which illustrate embodiments of the invention; and specifically FIGS. 15 & 16. Structural stiffener braces (70) will be formed and molded as per the requirements as specified in the background section of this document. This member will be structurally designed to exhibit the cross sectional size and thickness which will be manufactured via the extrusion process. The structural stiffener braces (70) will possess a cross sectional configuration having a base strip (502) of specific width and thickness. An additional portion specifically a small radius arc (505) is integrally formed and molded within the said base (502) and terminates in it's third quadrant the end of which subtends tangentially a straight portion (506) of a specific angular value to a point where a second circular arc (507) of equal radius as the first and terminating in it's first quadrant. The extremity of which further subtends tangentially another straight portion (508) which configures in a parallel manner to that of it's base strip (502) to a specific point along it's parallel portion to a third circular arc (509) of equal radius will create a further directional change and terminating in it's fourth quadrant the extremity of which subtends a third straight portion (210) of an angular value diametrically opposed to that of the previous straight portion (506). At it's extremity and tangentially to the third straight portion (510) is the final circular arc of equal radius (511) which terminates in it's second quadrant and whose end is integrally formed and molded tangentially within the base strip (202). Within the cavity created is also perpendicularly centered integrally formed and molded a stiffener membrane (512) within (508) and (502).

Still another object of the invention is the provision of the transverse deflection stiffener (71) as per drawings which illustrate embodiments of the invention; and specifically FIGS. 28 & 29. The transverse deflection stiffener (71) is integrally formed and molded within the cavity surface of all sheet decking and is parallel to it's transverse extremities. A transverse deflection stiffener appears substantially corrugated along it's cross section axis. It's first end is formed and molded within the cavity surface of the sheet decking and rises above it's surface via a specified small radius circular arc (207) whose initial and terminal extremities are located within the first quadrant where a straight portion (208) is tangentially diagonally subtends relative to the plane of the surface of said sheet decking and terminates at a point where another circular curve (209) of specified radius is tangentially and integrally formed and molded whose initial and terminal extremities are located anti clockwise within the third and fourth quadrants respectively. Integrally and tangentially with it's terminal extremity is subtended tangentially and in a diagonally opposed direction to that of the previous said straight portion and equal in length is a second straight portion (210) which itself terminates at such a point to allow at it's extremity a small radius arc (211) equal to that of the said first arc is integrally formed and molded within the cavity surface of said sheet decking.

Still another object of the invention is the provision of the longitudinal deflection stiffener (72) as per the drawings which illustrate embodiments of the invention; and specifically FIGS. 28 and 29. The longitudinal deflection stiffener (72) is integrally formed and molded within the cavity surface of all sheet decking and is parallel to it's longitudinal extremities. A longitudinal deflection stiffener appears substantially corrugated along it's cross sectional axis. It's first end is formed and molded within the cavity surface of the sheet decking and rises above it's surface via a specified small radius circular arc (216) whose initial and terminal extremities are located within the fourth quadrant where a straight portion (217) is tangentially diagonally subtends relative to the plane of the surface of said sheet decking and terminates at a point where another circular curve (218) of specified radius is tangentially and integrally formed and molded whose initial and terminal extremities are located clockwise within the third and second quadrants respectively Integrally and tangentially with it's terminal extremity is subtended tangentially and in a diagonally opposed direction to that of the previous said straight portion and equal in length is a second straight portion (219) which itself terminates at such a point to allow at it's extremity a small radius arc (220) equal to that of the said first arc and is located within the fourth quadrant and is integrally formed and molded within the cavity surface of said sheet decking.

Still another object of the invention is the provision of the transverse end enclosure strip (73) as per the drawings which illustrate embodiments of the invention; and specifically FIGS. 20 & 21. The transverse end enclosure strip (73) is a flat rectangular strip which is integrally formed and molded within and perpendicular to the cavity surface of the external sheet decking's transverse extremities. At a specified distance away from said extremity and about three quarters it's width is the outer female fastener track (61) which is integrally formed and molded upon it's cavity surface and yet beyond and without the cavity and a short distance beyond the position of the internal sheet decking's sealing strip (83) contact surface. Extending beyond this point and in the same perpendicular plane to that of the external sheet decking's cavity surface and for a specified short distance beyond integrally formed and molded is the outer female horizontal seam connector element (65).

Still a further object of the invention is the provision of the longitudinal end enclosure strip (95) as per drawings which illustrate embodiments of the invention specifically FIG. 20. As in the case of the end module. This is a flat rectangular strip which is identical to that of it's transverse end enclosure counterpart (73). And having it's outer female fastener track (61) and outer female horizontal seam connector element (65) integrally formed and molded within it's cavity surface and outer extremity respectively. The two transverse ends of the longitudinal end enclosure strip (95) is perpendicularly integrally formed and molded within one end of each transverse end enclosure strip (73).

Figure 17:
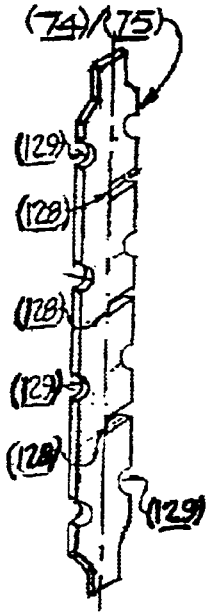
FIG. 17—Reveals a typical view of a longitudinal and transverse stiffener rib (74) and (75) respectively.

Yet a further object of the invention is the provision of the longitudinal stiffener rib (74) as per the drawings which illustrate embodiments of the invention; and specifically FIG. 17. It is substantially rectangular and flat in shape and having intersecting recesses (128) which are rectangular openings that are perpendicularly formed to a lengthwise edge of said longitudinal stiffener and extend for little more than one half within the stiffener's width. The intersecting recesses are formed within direct axial contact locations of their perpendicular intersecting transverse stiffener rib counterpart (75). Also having within said longitudinal stiffener ribs are corrugated openings (129) which are axially and centrally positioned and formed of exact shape but slightly larger than the transverse deflection stiffeners (71). These features are shown in FIGS. 17, 30 and/or 42.

Yet a further object of the invention is the provision of the transverse stiffener rib (75) as per the drawings which illustrate embodiments of the invention; and specifically FIG. 17. It is substantially rectangular and flat in shape and having intersecting recesses (128) which are rectangular openings that are perpendicularly formed to a lengthwise edge of said longitudinal stiffener and extend for little more than one half within the stiffener's width. The intersecting recesses are formed within direct axial contact locations of their perpendicular intersecting longitudinal stiffener counterpart (74). Also having within said transverse stiffener ribs (75) are corrugated openings (129) which are axially and centrally positioned and formed of exact shape but slightly larger than the longitudinal deflection stiffeners (72). These features are shown in FIGS. 17, 30 and/or 42.

Figure 13:
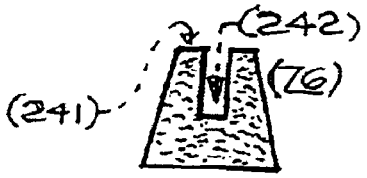
FIG. 13—Shows a typical cross section of the Rubber Gasket Seating Cushion to be used for cushioned seating at top and bottom of all wall component units and modules also on the edge of all stiffener rib members.

Still another object of the invention is the provision of the rubber gasket seating cushion (76) as per the drawings which illustrate embodiments of the invention; and specifically FIG. 13. The cross sectional configuration as taken along it's transverse axis reveals a substantial trapezoid having within it's smaller parallel side (241) and perpendicularly centrally positioned within it is a rectangular recess (242) the width of which allows for a snug fit to stiffener ribs extremities and wall sheet decking's transverse extremities.

Figure 18:
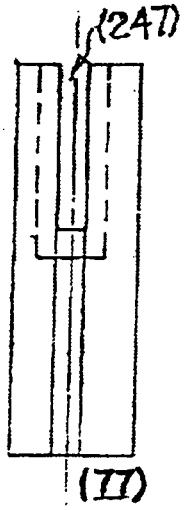
FIG. 18—Illustrates a side view of the intersecting rubber connector (77) as depicted in FIG. 23
Figure 23:
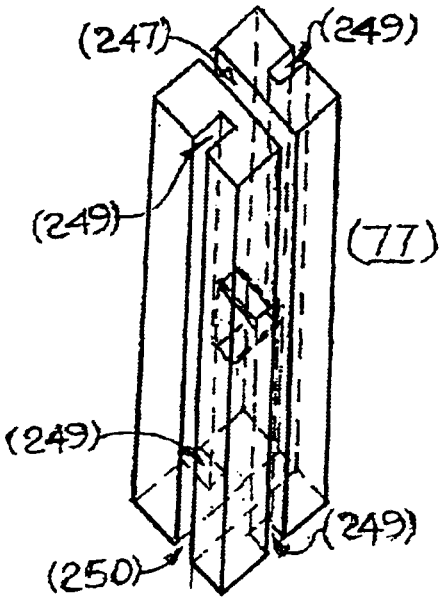
FIG. 23—Illustrates a view depicting the intersecting rubber connector (77).

Still another object of the invention is the provision of the intersecting rubber connector (77) as per the drawings which illustrate embodiments of the invention; and specifically FIGS. 18 & 23. The intersecting rubber connector (77) is square along it's cross sectional axis and is approximately equal in length to that of it's cross sectional perimeter. At one end is a first slot (247) which is directionally located parallel and central to two opposing sides of the square cross section and extends within it lengthwise (248) for a distance that is less than one half the entire length of said intersecting rubber connector (77). At that point two shallow slots (249) located on each of the said sides and in direct alignment with the internal extremity of the said first slot extends to the opposing ends of said intersecting rubber connector (77). On the opposite end of said intersecting rubber connector is likewise formed a second slot (250) which is directionally located parallel and central to the other two opposing sides to that of it's first two sides aforementioned within the cross sectional axis and perpendicular to said first slot. The second slot extends lengthwise for a distance that is less than one half the entire length (251) of the intersecting rubber connector (77) At that point two shallow slots (252) located on each of the sides as per the said second slot (250) and extending in direct parallel alignment with it's internal extremities towards and terminating at the surface of the first extremity of the said intersecting rubber connector (77).

Yet another object of the invention is the provision of the set square up-stand register (78) as per the drawings which illustrate embodiments of the invention; and specifically FIG. 31. The set square up-stand register (78) is integrally formed and molded on edge within and upon the cavity surface of all internal and external sheet decking and projects perpendicularly beyond the cavity surface for a distance of about 25 mm (1") in a substantially L-shaped configuration with each leg (253) square and equal in size to each other and integrally affixed to each other at it's apex (254).

A further object of the invention is the provision of the Set square down-stand register (138) The set square down stand registers (138) is identical in size and shape as that of the said set square up-stand registers (78). It's distinct classification is preferred for location differential descriptiveness only.

Still another object of the invention is the provision of the external female fastener buttress (79) as per the drawings which illustrate embodiments of the invention; and specifically FIGS. 9, 14 and/or 25. The external female fastener buttress (79) is configured substantially triangular and flat and possessing a rib stiffener flange (100) which is a flat rectangular strip that is perpendicularly integrally formed and molded along it's flat side lengthwise center line axis to the exposed outer edges of the external female fastener buttress (79) and is integrally affixed to both it's ends within their adjacent contact surfaces. Integrally formed and molded on edge within the external surface specifically that without the cavity surface of the end enclosure strip (95) and (73) and projects perpendicularly beyond it's surface and commencing within the stem (165) of the outer female horizontal seam connector element (65) where it tapers vertically to a finish within the surface of said end enclosure strip specifically at that point which is adjacent to the external sheet decking's extremity.

Yet a further object of the invention is the provision of the internal female fastener buttress (80) as per the drawings which illustrate embodiments of the invention; and specifically FIGS. 9, 14 and/or 25. The female fastener buttress (80) is configured substantially equilaterally triangular and flat and possessing a rib stiffener flange (100) which is a flat rectangular strip that is perpendicularly integrally formed and molded along it's flat side lengthwise center line axis to the exposed outer edge of the said female fastener buttress (80) and is integrally affixed to both it's ends within their adjacent contact surfaces. Said internal female fastener buttresses are equally spaced and integrally formed and molded on edge within the innermost surface of the internal sheet decking and the inner female fastener track (60) and projecting perpendicularly beyond these surfaces and within the enclosure commencing at a point adjacent to the stem of the inner female horizontal seam connector element (66) where it tapers vertically to a finish (262) within the innermost surface of the said internal sheet decking with a substantial 45 degree angular finish (263).

Still a further object of the invention is the provision of the under wall support rib (81) as per the drawings which illustrate embodiments of the invention; and specifically FIGS. 14 and 25. The under wall support rib (81) is configured rectangular and flat and having a rib stiffener flange (100) which is a flat rectangular strip that is perpendicularly integrally formed and molded along it's flat side lengthwise (267) center line axis to the exposed outer edges of said under wall support rib (81) and is integrally affixed to both it's ends (268) within their adjacent contact surfaces. They are equally spaced and integrally formed and molded on edge (269) within the cavity surface of the aforementioned end enclosure strips and the external sheet decking and projects perpendicularly beyond both cavity surfaces to the underside of the internal sheet decking's cavity surface (270) and rectangularly protrudes vertically beneath said internal sheet decking's cavity surface to a point (271) a short distance beyond the inner female fastener buttress (80) which is situated upon the adjacently opposite surface of the internal sheet decking.

Still a further object of the invention is the provision of the Roof bearing ribs (126) as per the drawings which illustrate embodiments of the invention; and specifically FIG. 9. The roof bearing ribs (126) is identical in shape and relative location as that of the aforementioned Under wall support ribs (81). It's distinct classification is preferred for location and functional differential descriptiveness. Reference is also made to FIG. 25.

Still another object of the invention is the provision of the lateral stabilizing rib (82) as per the drawings which illustrate embodiments of the invention; and specifically FIGS. 9, 14 and/or 25. The lateral stabilizing rib (82) is configured rectangular and flat is integrally formed and molded on edge within both surfaces of the under wall support rib (81) and the cavity surface of the external sheet decking and project perpendicularly beyond both surfaces to which they are integrally affixed and extend to the underside of the internal sheet decking's cavity surface (272) and rectangularly protrudes vertically beneath said internal sheet decking's cavity surface to a point (273) a short distance beyond it's origin where it terminates and having a rib stiffener flange (100) which is a flat rectangular strip that is perpendicularly integrally formed and molded along it's flat side lengthwise (274) center line axis to the exposed outer edges of the said lateral stabilizing rib (82) and is integrally affixed to both it's ends within their adjacent contact surfaces (275).

Still a further object of the invention is the provision of the internal sheet decking's sealing strip (83) as per the drawings which illustrate embodiments of the invention; and specifically FIG. 19. The internal sheet decking's sealing strip (83) is a straight flat rectangular and narrow strip which is integrally formed and molded and extrudes the entire length of the transverse extremities of all internal sheet decking (276) and as in the case of the floor and roof end modules is integrally affixed to the internal sheet decking's most inner extremity (277) that which is adjacent to the longitudinal end enclosure strip (95). The said sealing strip is formed perpendicularly vertical to the innermost surface of the internal sheet decking (278) and projects more inwardly away from said surface for a specified distance. These features are shown in FIGS. 19, 22 and/or 25.

Yet a further object of the invention is the provision of the female longitudinal jointed seam connector socket (84) as per drawings which illustrate embodiments of the invention specifically FIG. 34. The female longitudinal jointed seam connector socket (84) is integrally formed and molded within all aforementioned wall and door component sides internal and external sheet decking specifically at all junctions where the female longitudinal jointed seam connector elements (67) intersects (280) with the male longitudinal jointed seam connector element (67) intersects with the male longitudinal jointed seam connector element (68) which results in every internal and external wall sheet decking possessing one female longitudinal jointed seam connector socket (84) adjacent to it's lower extremity of the appropriate longitudinal side and the other located at the upper extremity of the said longitudinal side and integrally formed and molded in direct axial vertical alignment with each other and within both ends of the female longitudinal jointed seam connector element (67) and in direct axial horizontal alignment with that of the male horizontal seam connector element (67) of all wall and door component sides internal and external sheet deckings.

The female longitudinal jointed seam connector socket (84) commences at a point along the shaft (145) of the said female longitudinal jointed seam connector element and adjacent to the point (282) where it intersects with the aforementioned male horizontal seam connector element. It configures into a substantially square boxlike shape within it's visible surfaces (283) with filletted edges of a small radius (285) which projects beyond the surfaces of the shaft of both the aforementioned male and female jointed seam connector elements in a perpendicular manner to that of the surface of the sheet decking and having the end of both said female longitudinal jointed seam connector element (67) and aforementioned male horizontal seam connector elements integrally formed and molded within it's contact sides (286). The inner surfaces of said female longitudinal jointed seam connector socket (84) is configured large enough and of the same shape as the outer surfaces of the shaft of the adjoining male horizontal seam connector element (143) (144) so as to allow for a close tolerance fit and must be so formed to allow for a smooth flush fit within the internal bore and specifically that location at which both ends of the inner and outer male horizontal seam connector elements (143) and (144) respectively make contact Having the outer edge of said female connector socket (84) so formed with a cutaway portion (57 to allow for an even fit without interference of adjacent contact surfaces.

Still a further object of the invention is the provision of the male longitudinal and horizontal junction connector (85) as per the drawings which illustrate the embodiments of the invention; and specifically FIG. 34. The male longitudinal and horizontal seam connector junction (85) is provided upon all wall component sides internal and external sheet decking specifically at the location where the male longitudinal jointed seam connector element (68) converges with either a inner or outer male horizontal seam connector element (143) or (144) respectively having one located adjacent to the lower extremity of the appropriate longitudinal side of the sheet decking and the other located at the upper extremity of the said longitudinal side and integrally formed and molded in direct axial vertical alignment with each other and with both ends of the said male horizontal seam connector element specifically inner or outer.

Yet another object of the invention is the provision of the Floor and Roof end modules's internal sheet decking (96) as per the drawings which illustrate embodiments of the invention; and specifically FIG. 19. The floor and roof end modules (40)&(51) respectively are preferably identical in shape. Their sizes are always equal in value when used in the same said enclosure assembly. The aforementioned internal sheet decking (96) commences from left to right while viewed along its longitudinal axis with it's inner cavity surface in a laid flat and horizontal position with emphasis on it's innermost surface. The cavity surface of said sheet decking possess the longitudinal and transverse deflection stiffeners (72) and (71) respectively and set square up-stand registers as described and graphically illustrated in FIGS. 28, 29 and/or 31.

The internal sheet decking sealing strip (83) projects perpendicularly from it's innermost surface for a specific short distance and is configured into a vertically upright rectangular strip. It is integrally formed and molded within the said sheet decking's two transverse ends and one longitudinal extremity. Continuing from it's base and moving horizontally and perpendicularly to its longitudinal axis respectively for a distance (690) which is equal to the thickness of a typical wall module when measured across the cavity of the said walls' transverse extremity for a close tolerance sliding fit is integrally formed and molded in a perpendicularly upright position the inner female fastener track (60). Proceeding still vertically and for a short distance integral with said Female fastener track and directly above it is the Female horizontal seam connector element (66). Continuing perpendicularly from its base (691) and for a short distance (692) inwardly adjacent to it is the raised and fielded panel (69) which rises diagonally on an inclined plane to a specified constant higher most inwardly horizontal plane that which is a typical value for all sheet decking said raised and fielded panels (69). At this point and tangentially horizontal to it is a significantly longer straight portion (693) which is configured to a point where a second raised and fielded panel (69) is integrally formed and molded but in a diametrically opposed direction to that of the first at whose extremity a second straight and horizontal portion (694) of equal distance to that of the first (692) and extends to the base of the second inner Female fastener track (60) which is integrally formed and molded in a perpendicularly upright position to the innermost surface of said sheet decking. Proceeding still vertically and for a short distance integral with said Female fastener track and directly above it is the Female horizontal seam connector element (66). Continuing from its base and moving horizontally and perpendicularly for a final distance equal to the first straight position (690) is integrally formed and molded the second internal sheet decking sealing strip (83).

The view along the transverse cross sectional axis reveals an asymmetrical configuration as it possesses one internal sheet decking sealing strip (83) along it's longitudinal side. It commences from left to right with it's inner cavity surface in a laid flat and horizontal position with emphasis on it's innermost surface. The internal sheet decking sealing strip (83) projects perpendicularly from it's innermost surface for a specific short distance and is configured into an upright rectangular strip which is integrally formed and molded within the said sheet decking and along its longitudinal extremity.

Continuing from it's base and moving perpendicularly horizontally and to the right for a distance (690) which is equal to the thickness of a typical aforementioned wall module when measured across the cavity of its transverse extremity thus allowing for a close tolerance sliding fit is integrally formed and molded in a perpendicularly upright position the inner female fastener track (60). Proceeding still vertically and for a short distance integral with said Female fastener track and directly above it is the Female horizontal seam connector element (66) Continuing perpendicularly horizontally from its base (696) and for a short distance (697) and inwardly adjacent to it is the raised and fielded panel (69) which rises diagonally on an inclined plane to a specified and constant higher most inwardly horizontal plane that which is a typical value for all sheet decking said raised and fielded panel (69). At this point and tangentially horizontally to it is a significantly longer straight portion which is configured to a point where a second raised and fielded panel (69) is integrally formed and molded but in a diametrically opposed direction to that of the first at whose extremity a second straight portion (698) of equal distance to the first (697) extends and is integrally formed and molded within the said Male or said Female longitudinal jointed seam connectors' element (68) or (67 respectively as per FIG. 32. The chosen option must be the same as that used for the corresponding longitudinal extremity of the Floor and Roof end Module's external sheet decking (98).

Yet still another object of the invention is the provision of the Floor and Roof intermediate module/component unit internal sheet decking (97) and (103) respectively as per the drawings which illustrate embodiments of the invention; and specifically FIG. 22. The floor and roof intermediate modules and component units are identical in shape. Their sizes are always equal in value when used in one and the same enclosure assembly. A symmetrical configuration is revealed when viewed along it's longitudinal axis. The said internal sheet decking commences from left to right with it's inner cavity surface in a laid flat and horizontal position with emphasis on it's innermost surface. The cavity surface of said sheet decking possess the longitudinal and transverse deflection stiffeners (72) and (71) respectively and set square up-stand registers as described and graphically illustrated with respect to FIGS. 22, 35 and 41 respectively.

The internal sheet decking sealing strip (83) projects perpendicularly from the innermost surface and is integrally formed and molded within the said sheet decking and at it's extremity. Continuing from it's base and moving horizontally and to right for a distance which is equal to the thickness of a wall module (600) when measured across the cavity of the transverse extremity thus allowing a close tolerance sliding fit is integrally formed and molded in a perpendicularly upright position the inner female fastener track (60) and inner female horizontal seam connector element (66). Continuing along it's longitudinal axis and for a short distance and tangentially adjacent to it is the raised and fielded panel (69) which rises diagonally on an inclined plane to a specified constant higher horizontal plane. It begins via a first minute circular radius arc positioned within it's fourth quadrant from which tangentially subtends a short inclined straight portion of specified angular measurement and whose end is tangentially integrally affixed a second minute circular arc of equal magnitude to that of the first and is positioned within it's second quadrant. At this point and tangentially horizontal to it is a significantly longer straight portion (601) which is configured to a point which has tangentially and positioned in it's first quadrant a third minute circular radius arc and equal in magnitude to the previous two and tangentially integrally affixed within it's first quadrant of whose extremity configured still another straight declined portion (602) which is both equal in length and diametrically opposed to the first inclined portion which is tangentially and integrally affixed to the extremity of said short portion. A fourth minute circular radius arc which is also equal in magnitude to the other three and positioned within it's third quadrant. At this point a tangentially short and horizontal portion (603) which is equal in length and positioned within a corresponding horizontal plane to that of the opposing straight portion is configured at whose extremity is integrally formed and molded perpendicularly the second female fastener track (60) which configures in a perpendicularly upright projection to the innermost surface of said internal sheet decking. At this point specifically at the base and moving progressively towards the opposite longitudinal extremity to that of it's first and for a distance which is equal to the thickness of a wall module as measured across the cavity of it's transverse extremity thus allowing a close tolerance sliding fit and equal to the opposing first distance (600) and of a plane as that of it's first extremity and finally terminating at a point where the second internal sheet decking sealing strip (83) is configured perpendicularly upright to said innermost surface of the said internal sheet decking.

The view along the transverse cross sectional axis of the intermediate module/component unit's internal sheet decking (97) and (103) reveals an asymmetrical configuration as it possesses a male longitudinal jointed seam connector element (68) adjacently affixed near one longitudinal extremity and a female longitudinal jointed seam connector element (67) adjacently affixed at the other longitudinal extremity as herein described. It commences from left to right with it's inner cavity surface in a laid flat and horizontal position with emphasis on it's innermost surface where two substantial chiseled shaped configuration are formed at it's extremity with the apparent "sharp edges" towards and adjacent to the outermost surface FIG. 32 and it's splayed portion receding towards it's core surface at a specified angular measurement which is also equal in value to all other sheet decking longitudinal extremities for interlocking purposes. Integrally formed and molded within the said sheet decking's innermost surface and adjacent to it's extremity is one female longitudinal jointed seam connector element (67) details as per FIG. 32 and moving horizontally to the right for a short distance (608) equal to that of similar configuration on all other sheet decking and tangentially adjacent to it is the raised and fielded panel (69) which rises diagonally on an inclined plane to a specified constant higher horizontal plane via a tangentially affixed first minute circular radius arc positioned within it's fourth quadrant from which tangentially subtends a short inclined straight portion (605) of specified angular measurement and whose end is tangentially integrally affixed a second minute circular arc of equal magnitude to that of the first and is positioned within it's second quadrant At this point and tangentially horizontal to it is a significantly longer straight portion which is configured to a point where also tangentially to it's extremity is the raised and fielded panel (69). Positioned in it's first quadrant is a third minute circular radius arc and equal in magnitude to the previous two and tangentially integrally affixed within it's first quadrant of whose extremity configured still another straight declined portion (606) which is both equal in length and diametrically opposed to the first inclined portion (605) which is tangentially and integrally affixed to the extremity of said short portion (606). A fourth minute circular radius arc which is also equal in magnitude to the other three and positioned within it's third quadrant. At this point a tangentially short and horizontal straight portion (607) of equal length and positioned within a corresponding horizontal plane to that of the opposing straight portion (607) is configured within the innermost surface of said internal sheet decking and integrally formed and molded the male longitudinal jointed seam connector element (143). These details are shown in FIGS. 22 and/or 32.

Yet still another object of the invention is the provision of the Wall intermediate module's/dummy door component unit's/wall component unit's internal sheet decking (106) and (155) and (308) respectively as per the drawings which illustrate embodiments of the invention; and specifically FIGS. 7 and 30. The wall intermediate modules (106) and dummy door component units (155) and wall component units (308) are identical in shape. Their heights are always equal in value when used in one and the same enclosure assembly yet not necessarily true regarding the value of their transverse widths. A symmetrical configuration is revealed when viewed along their longitudinal axis. The aforementioned wall internal sheet decking commences from it's lowest to it's highest extremities as viewed in a vertically upright position while seated on it's transverse end with an emphasis on it's innermost surface. The cavity surface of said sheet decking possess the longitudinal and transverse deflection stiffeners (72) and (71) respectively and set square up-stand registers as described and graphically illustrated in FIGS. 5, 10, 12, 25, 28, 29 and/or 31.

A thicker straight portion (710) which distends towards and within its cavity surface and having squared edges adjacent to both inner and outer surfaces at it's extremity and moving vertically away from said extremity for a short specified distance (711) is the male fastener track (62).

Even further away in a vertical direction from it's extremity also from said male fastener track and for another specified short vertical straight distance (712) along it's longitudinal axis is positioned the inner male horizontal seam connector element (143) and still a further short vertical distance (713) away from it's extremity is configured tangentially adjacent to it is the raised and fielded panel (69) the extremity of which is tangentially integrally formed and molded a significantly tall vertical and straight portion (714) which ends with the second raised and fielded panel (69). Tangentially affixed to said extremity and the vertically short straight and thicker portion (715) which is identical to the previous (713). This is followed by a second inner male horizontal seam connector element (143) from whose extremity is configured still another short straight vertical portion (716) of equal thickness similar to the corresponding lower portion (712) which terminates with another inner Male fastener track (62).

At this point and vertically integrally affixed to it is another straight short portion (717) of equal thickness corresponding to similar thicker portion at the lower opposite end (711) and for a distance equal to that of it's corresponding opposing end and having squared edges adjacent to both inner and outer surfaces (718) at said extremity.

The view along the transverse cross sectional axis of the aforementioned wall intermediate module's/dummy door component unit's/wall component unit's internal sheet decking reveals an asymmetrical configuration as it possesses a male longitudinal jointed seam connector element (68) adjacently affixed at one longitudinal extremity and a female longitudinal jointed seam connector element (67) adjacently affixed at the other longitudinal extremity as herein described and graphically illustrated in FIGS. 5 and 32. It commences from left to right with emphasis on it's surface specifically that which is opposite that of its cavity surface where a substantial chiseled shaped configuration is formed at it's extremity with the apparent sharp edge (156) formed within and adjacent to the core surface of aforementioned male longitudinal jointed seam connector element (68) and it's splayed portion receding towards it's cavity surface at a specified angular measurement which is also equal in value to all other aforementioned sheet decking longitudinal extremities for interlocking purposes as per FIG. 32. Integrally formed and molded within the said sheet decking's surface specifically that which is opposite its cavity surface and adjacent to it's longitudinal extremity is one male longitudinal jointed seam connector element (68) and moving horizontally to the right for a short distance (720) equal to that of similar configuration on all other aforementioned sheet decking and tangentially adjacent to it is the raised and fielded panel (69). At this point and tangentially horizontal to it is a significantly longer straight portion (721) which is configured to a point where also tangentially to it's extremity is the second raised and fielded panel (69), which is both equal in length and diametrically opposed to the first portion (69). Tangentially and integrally affixed to the extremity of said raised and fielded panel (69) is a second short and straight portion (722) of equal length and positioned within a corresponding horizontal and parallel plane to that of the opposing straight portion (720) is configured within the innermost surface of said internal sheet decking and integrally formed and molded the female longitudinal jointed seam connector element (67)—finally adjacent to the point of fixation of said female longitudinal jointed seam connector element (67) and at it's extremity is integrally formed a substantial chiseled edge having it's apparent sharp edge (156) towards and adjacent to the inner core surface that which is opposite it's cavity surface of the said sheet decking with it's splayed portion receding towards and terminating at it's said opposite surface via a specified angular measurement that is equal to all similar configurations possessing the said female longitudinal jointed seam connector element (67).

Yet another object to the invention is the provision of the Floor and Roof end modules's External sheet decking (98) as per the drawings which illustrate embodiments of the invention; and specifically FIG. 20. The floor and roof end modules (98) are identical in shape. Their sizes are always equal in value as used in pairs in one and the same enclosure assembly. A symmetrical configuration is revealed when viewed along it's longitudinal axis. It commences from top down with it's outermost surface in a laid flat and horizontal position with the emphasis on it's said outermost surface. The cavity surface of said sheet decking possess the longitudinal and transverse deflection stiffeners (72) and (71) respectively and also the set square up-stand registers as described and graphically illustrated in FIGS. 28, 29 and/or 31.

In a vertically upright position and at the extremity of the transverse end enclosure strip (73) is integrally affixed the female horizontal seam connector element (65) as per FIG. 20. Descending vertically for a short distance and perpendicularly adjacent to the sheet decking's cavity surface is encountered the first outer female fastener track (61) which is positioned on the same horizontal elevational plane as that of it's inner female fastener counterpart (60). A further vertical descent and at it's extremity will reveal the extent of the transverse end enclosure strip (73) at whose extremity integrally formed and molded perpendicularly and horizontally to it is the floor end module's external sheet decking (98) which is configured along a horizontal plane for a specified short distance (610) at whose extremity is the raised and fielded panel (69) as per FIG. 32. Tangentially positioned and integrally formed and molded within it's extremity is a straight significant longitudinal portion at whose extremity is configured a second raised and fielded panel (69) but diametrically opposed in direction. At it's extremity and tangentially affixed to it is a short horizontal distance which is equal in length to it's corresponding opposing previous length (610). At this point and vertically perpendicular to it's cavity surface is the second transverse end enclosure strip (73) which is configured in an upright manner for a specific distance equal to that of it's first corresponding distance at this point is configured the second outer female fastener track (61) which is in direct horizontal alignment with the said first outer female fastener track. Another straight and vertical portion (613) is configured in a direction further away from the extremity where the second female horizontal seam connector element (65) is integrally affixed as per FIG. 20.

The view along the transverse cross sectional axis of the said floor and said roof end module external sheet decking reveals an asymmetrical configuration as it possesses a longitudinal end enclosure strip (95) along one longitudinal side only. It commences from left to right with it's inner cavity surface in a laid flat and horizontal position with emphasis on it's outermost surface. The external sheet decking's longitudinal end enclosure strip (95) projects vertically perpendicular to it's cavity surface and is integrally formed and molded within the said sheet decking and at it's extremity. In a vertically upright position and at the extremity of the end enclosure strip (95) is integrally affixed the female horizontal seam connector element (65) as per FIG. 20. Descending vertically for a short distance and perpendicularly adjacent to the cavity surface is encountered the first outer female fastener track (61) which is positioned on the same horizontal elevational plane as that of it's inner female fastener counterpart (60). A further vertical descent and at it's extremity will reveal the extent of the longitudinal end enclosure strip (73) at whose extremity and integrally formed and molded perpendicularly horizontal to it the floor end modules external sheet decking (98) which is configured for a short distance (614) at whose extremity is the raised and fielded panel (69). Positioned in it's first quadrant is a first minute circular radius arc and equal in magnitude to all previous and tangentially integrally affixed within it's first quadrant of whose extremity configured still another straight declined portion (615) which is tangentially and integrally affixed to the extremity of said short portion (616). A second minute circular radius arc which is also equal in magnitude to the other and positioned within it's third quadrant. A straight and horizontal portion is configured along it's transverse axis for a significant length at whose extremity is formed the second raised and fielded panel (69) beginning with a third tangential minute circular radius arc within it's fourth quadrant and is equal to all other in magnitude as is relative to the raised and fielded panels (69) of all sheet decking. At it's extremity and projecting on a diagonally angular plane to that of it's previous plane is another straight short portion which is both equal in length and diametrically opposed to the first portion (615). Tangentially and integrally affixed to the extremity of said short portion is a fourth minute circular radius arc which is also equal in magnitude to the other three and positioned within it's second quadrant. Tangentially to it's extremity and for a short horizontal distance (616) which is equal to that of all adjacent corresponding straight portion and integrally affixed to all raised and fielded panels and at it's extremity is also integrally formed and molded the second female longitudinal jointed seam connector element (67) finally and for a short distance away from the point of fixation of the seam connector element is the substantial chiseled edge having it's apparent sharp edge adjacent to the innermost surface of said external sheet decking. As per FIG. 32.

Yet another object of the invention is the provision of the Floor and Roof Intermediate module and component unit External sheet decking (99) and (102) respectively as per the drawings which illustrate embodiments of the invention; and specifically FIG. 21. The floor and roof intermediate modules/component units are identical in shape. A symmetrical configuration is revealed when viewed along it's longitudinal axis. It commences from top down as per FIG. 21 with it's outermost surface in a laid flat and horizontal position with the emphasis on it's said outermost surface. The cavity surface of said sheet decking possess the longitudinal and transverse deflection stiffeners (72) and (71) respectively and also the set square up-stand registers as described and graphically illustrated in FIGS. 28, 29 and/or 31.

In a vertically upright position and at the extremity of the end enclosure strip (73) is integrally affixed the female horizontal seam connector element (65). Descending vertically for a short distance and perpendicularly adjacent to the cavity surface is encountered the first outer female fastener track (61) which is positioned on the same horizontal elevational plane as that of it's inner female fastener counterpart (60). A further vertical descent and at it's extremity (FIGS. 20, 21, 22 and 25) will reveal the extent of the transverse end enclosure strip (73) at whose extremity and integrally formed and molded perpendicular and horizontal to it is the floor end module's external sheet decking (99) which is configured along a horizontal plane for a specified short distance (618) at whose extremity is the raised and fielded panel (69). Tangentially positioned and integrally formed and molded within the previous extremity is the first minute circular radius arc which resides within it's second quadrant. At it's extremity is configured still another straight diagonally short declined portion of specified angular magnitude and length which is equal to that of all corresponding lengths of all raised and fielded panels (69). Tangentially and integrally affixed to the extremity of said short diagonal portion is a second minute circular radius arc which is also equal in magnitude to the first and positioned within it's fourth quadrant. Tangentially and Integrally affixed to the last extremity and for a significantly long horizontal distance (619) at whose extremity is tangentially and integrally affixed a third tangential minute circular radius arc within it's third quadrant and is equal to all other in magnitude as is relative to the raised and fielded panels (69) of all sheet decking. At it's extremity and projecting on a diagonally angular plane to that of it's previous plane is another straight short portion which is both equal in length and diametrically opposed to the first portion. Tangentially and integrally affixed to the extremity of said short portion is a fourth minute circular radius arc which is also equal in magnitude to the other three and positioned within it's first quadrant. At it's extremity and tangentially affixed to it is a short horizontal distance which is equal in length to it's corresponding opposing previous length (618). At this point and vertically perpendicular to it's cavity surface is the second transverse end enclosure strip (73) which is configured in an upright manner for a specific distance equal to that of it's first corresponding distance at this point is configured the second outer female fastener track (61) which is in direct horizontal alignment with the said first outer female fastener track. Another straight and vertical portion is configured in a direction further away at the extremity where the second female horizontal seam connector element (65) is integrally affixed. These features are as shown in FIGS. 21, 28, 29 and/or 31.

The view along the transverse cross sectional axis of the floor and roof end module external sheet decking reveals an asymmetrical configuration as it possesses a male longitudinal jointed seam connector element (68) along the first longitudinal extremity and a female longitudinal jointed seam connector element (67) at the other. It commences from left to right with it's outermost surface in a laid flat and horizontal position with emphasis on it's outermost surface. At the first extremity is formed the substantial chiseled shaped configuration and for a short specified corresponding distance away from said extremity is integrally formed and molded one male longitudinal jointed seam connector element (68) and for a further short distance away (620) is the raised and fielded panel (69). Tangentially positioned and integrally formed and molded within the previous extremity is the first minute circular radius arc which resides within it's first quadrant. At it's extremity is configured still another straight diagonally short declined portion (621) of specified angular magnitude and length which is equal to that of all corresponding lengths of all raised and fielded panels (69). Tangentially and integrally affixed to the extremity of said short diagonal portion is a second minute circular radius arc which is also equal in magnitude to the first and positioned within it's third quadrant. Tangentially and Integrally affixed to the last extremity and for a short horizontal distance (622) at whose extremity is integrally affixed a female longitudinal jointed seam connector element (67). A final short horizontal distance is configured to a point where the second substantially chiseled shape edge is formed. Reference is made to FIGS. 21, 28, 29 and 31.

Still a further object of the invention is the provision of the pressure compensating door closing device (86) as per the drawings which illustrate embodiments of the invention; and specifically FIGS. 50 to 53.

The pressure compensating door closing device (86) is located on the internal sheet decking of the door opening component unit. It is assembled upon it's fulcrum mount (87) which are themselves integrally formed and molded within and upon the said internal sheet most inner surface and are in vertical and horizontal alignment with each other having two said fulcrum mounts upper and lower at opposite sides of the door opening and positioned a specific short distance away from each of the four corners and it's two longitudinal edges of the said door opening. The said pressure compensating door closing device (86) is integrally formed and molded in two separate portions. The closing arm (114) and the tension arm (115).

The said closing arm (114) is configured as per it's longitudinal sectional profile having angular directional changes which are formed by arcs and semicircular radius curves. The closing arm (114) is configured with two outer sides (630) each having identical shape and size to the other as per FIGS. 50 & 51. The lower left side is configured in a clockwise manner a substantial semicircle (631) of a specified radius curve having both it's initial and terminal extremities starting and ending within it's third and second quadrants respectively with it's most clockwise extremity terminating about midway it's second quadrant. At this point is configured tangentially a straight portion (632) which is inclined at about 45 degrees to the horizontal at whose end has a second circular arc (633) tangentially to it and of greater radius to that of the previous curve and terminating in it's first quadrant where another declined straight portion (635) is formed tangentially to said arc and itself terminating at a point where a third substantial semicircular curve (636) of a slightly larger radius than that of the first is configured in a clockwise direction and terminating in direct tangential alignment with the starting point of said substantial semicircle (631). Having tangentially to the substantial semicircular extremity a final straight portion (637) which also ends and is as one with said starting point (631). Along the longitudinal profile of both outer sides (638) is also configured integrally formed and molded and contoured within it's it's upper edges and perpendicular to each outer side is a rectangular strip portion (640) having one outer side at each of it's longitudinal extremities and configured as per dotted portion of the figure (50). Four circular holes are formed within both outer sides (638) of specified location and equal radius. Two each for the fulcrum pin (88) and two for the pivot pin (89). Having each hole in axial perpendicular alignment with the other and two thicker cylindrical bridging portions (645) and (646) with their core radius equal to that of the said holes and integrally formed and molded and spanning the distance between both pairs of holes within the outer sides (638).

The aforementioned tension arm (115) is substantially by-directional along it's longitudinal axis where it changes direction to approximately 90 degrees at about one half it's length. The said tension arm is configured as per it's sectional profile view as having angular directional changes which are formed by rounded portions as revealed along said longitudinal sectional profile. The tension arm is configured with two outer sides (647) both having the identical shape and size to each other as per FIG. 50. Commencing at its left side is a first radius curve specifically a substantial semicircular curve (648) of specified radius which begins within it's fourth quadrant and moving clockwise to about midway it's second quadrant where a straight portion (649) is configured tangentially on an incline plane to a point where a substantial 90 degree change in direction is configured by way of a second radius curve specifically a clockwise circular arc (650) of a greater value radius to the previous and beginning within it's second quadrant and terminating in it's first respectively at a point where another straight portion (651) is tangentially configured on a declined plane to the point of approximately equal length to that of the first at which extremity and tangentially clockwise to it is a third radius curve which is slightly smaller than the first and smaller than the second specifically a substantial semicircular radius curve (652) beginning in it's first quadrant and ending in the third respectively and whose value radius is smaller than the preceding and slightly smaller than the first radius and having at it's extremity and in it's said third quadrant tangentially another straight portion (653) which is a little less than the first two lengthwise and terminating at a point where still a fourth radius curve specifically an anticlockwise tangentially circular arc of specified radius (654) of a value that is greater than the third (652) and less than the second (650) Radius curve is configured whose initial and terminal sides begin in it's first quadrant and ends in it's second quadrant respectively at which point a short straight declined portion (653) which is tangentially configured and terminating at a point where a fifth radius curve specifically a clockwise tangential circular arc (654) of a greater than that of all others and commencing in it's fourth quadrant and terminating in it's fourth quadrant at which point and tangentially to it a final straight portion (655) is extended to make tangential contact with the initial extremity of the first radius curve (648).

This constitutes one outer side of the said tension arm (115). Along the longitudinal profile of both outer sides (657) is also configured integrally formed and molded and contoured within it's upper edge and perpendicular to each outer side is a rectangular strip portion (656) which is wider than the rectangular strip (640) of the closing arm (114) to allow for a close tolerance rotating fit around and without the aforementioned closing arm (114). The rectangular strip (656) is integrally formed and molded perpendicularly within and between both corresponding contoured edges of the outer sides of the tension arm as per the dotted portion thus forming a substantial U-shape along it's cross sectional axis as per FIG. 53. At one end of the tension arm specifically that which is pivoted about the closing arm is configured within it's inner surfaces and adjacent to it's pivot holes located on both inner surfaces of each outer side (657) is integrally formed and molded two thickened portions (659) of identical shape and size to withstand pivoting stresses. At it's opposite end specifically that which grips within the door closing anchor hooks (124) is configured a substantial longitudinal half of a cylinder (658) of thick walls and extended rounded outer edges integrally formed and molded within the inner distance from one outer side of the tension arm to the other.

Figure 37:
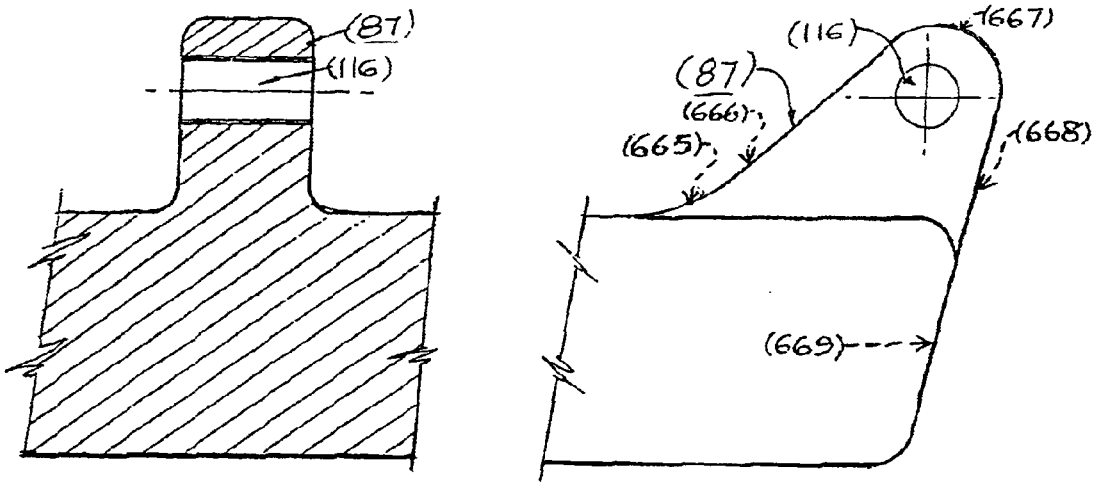
FIG. 37—Shows a detail of the Fulcrum Mount and hole for locking the door module (50) into it's closed position.
Figure 52:
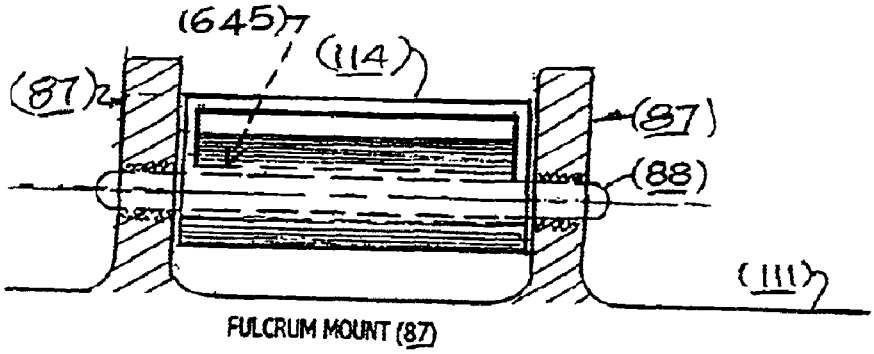
FIG. 52—Reveals the door closing device at it's mounting location upon the substantial internal sheet decking.
Figure 51:
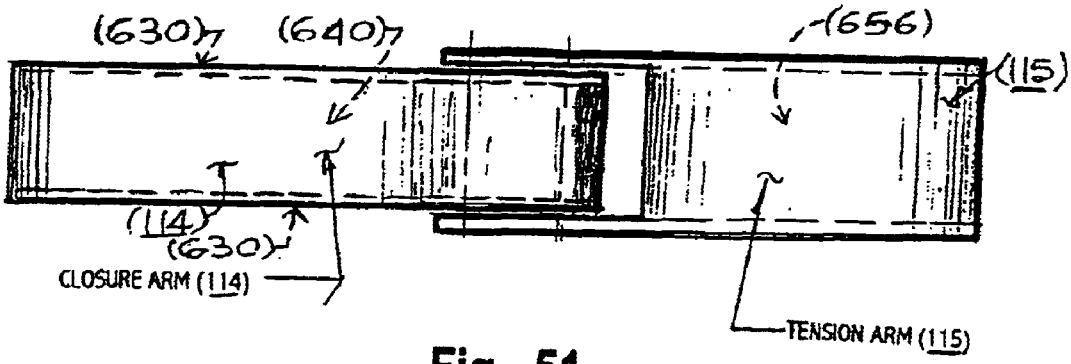
FIG. 51—illustrates a plan view looking vertically down on top the door closing device.

Yet a further object of the invention is the provision of the Fulcrum mount (87) as per the drawings which illustrate the embodiments of the invention; and specifically FIGS. 37 & 52. The fulcrum mount (87) is integrally formed and molded of substantially thicker plastic material in pairs and in vertical and horizontal alignment with each other in four locations within and upon the most inner surface of the door opening component unit's internal sheet decking (111). Specifically at and adjacent to the four filletted corners and longitudinal sides of the door opening. The fulcrum mount (87) is configured perpendicular to it's base surface as it protrudes via a radius curve in an anticlockwise tangential manner specifically a circular arc (665) whose initial and terminal sides begins in it's fourth quadrant and ends in it's fourth quadrant respectively. Having at said extremity and tangentially to it a straight portion (666) which is configured in an inclined direction to a point where a second radius curve specifically a clockwise circular arc (667) of a smaller radius than the first and having it's initial and terminal sides beginning and ending in it's second and fourth quadrants respectively. At this point is configured a final straight portion (668) which is in parallel alignment with the angular splayed portion (669) of the door opening skewed and tapered channel and integrally formed and molded monolithically with it. A fulcrum hole (116) is formed within as per FIG. 37. At a specific location and size in order to allow a forced tolerance tight fit for the closure fulcrum pin (88) during assembly. This description constitutes one half of that required of the said configuration in which to form one full pair of fulcrum mount (87). The second half is of identical configuration and size and is also integrally formed and molded within parallel vertical and horizontal alignment to it's other half as per FIG. 52 and the said pair is simultaneously in vertical and horizontal alignment with it's corresponding three pairs which are located at the upper and lower longitudinal edges of the door opening skewed and tapered channel's substantial internal sheet decking (111) and it's most inner surface.

One metallic closure pivot pin (89) and one metallic fulcrum pin (88) is used for each door closing device (86) during their assembly. They are both of the same diameter. The tension arm (115) is mounted over the closing arm (114) and the pivot holes are all aligned and the pivot pin (89) forced within the aligned holes. The pivot hole within the cylindrical core of the said closing arm (114) possess a diameter which allows for a close tolerance sliding fit. Both extremities of the said pin is forced within the holes which are of a smaller diameter within both outer sides of the tension arm (115) in order to obtain a tight tolerance forced fit where the pin is fixed in position and the closing arm (114) is allowed to rotate about it's axis.

Still another object of the invention is the provision of the door opening component unit (49) as per the drawings which illustrate embodiments of the invention; and specifically FIGS. 36, 38, 39, 46 and 47. The door opening component unit (49) is of the identical external dimensions and configuration along it's longitudinal and transverse extremities as that of it's dummy door component unit (45) Counterpart. The door opening component unit (49) is integrally formed and molded as a monolithic entity. It comprises a symmetrical three tiered and chamfered inner surface within said opening and having filleted and parallel radius curves as per FIGS. 36 38 & 39 at each of it's four corners with a substantial external and internal sheet decking (110) and (111) respectively with equally spaced three tiered web stiffeners (142) integrally formed and molded within it's two vertical longitudinal sides and threshold sides. Said sides of which are also equal in width to each other as per FIG. 38. The cross sectional configuration as viewed along it's cross sectional transverse axis unfolds from left to right with said substantial external sheet decking depicts substantial chiseled double pointed edges with it's apparent sharp edge towards and adjacent to it's cavity surface and a short distance away from said extremity and integrally affixed to the substantial external sheet decking's outermost surface is the female longitudinal jointed seam connector element (67) and for a short distance away from it is the first straight distance which is parallel to the x-axis at whose extremity is the raised and fielded panel (69). As per FIG. 32. The extremities of this latter is tangentially configured a straight portion (680) for a longer distance to the door opening where a tangentially anticlockwise first filletted curve of a specified small radius is formed within it's fourth quadrant to honor a change in direction of a specified angular value and tangentially to it another straight portion is formed (681) which is less than +90 degrees to the x-axis. At it's extremity and tangentially affixed a second circular arc of equal radius to the previous and residing in it's second quadrant in a clockwise direction thus depicting the first portion of the door opening three tiered inner surface (92). As per FIG. 38 and continuing from this point tangentially and directionally parallel to the x-axis is yet a second straight short portion from whose extremity subtends a third small circular arc of equal radius to that of the said previous and residing in it's fourth quadrant in an anti clockwise direction and terminating at a point of equal angular subtense as said first arc. Tangentially to the last point is extended a third short straight portion equal in length and direction to previous and followed by a fourth radius arc of equal magnitude to that of the said previous other which resides in it's second quadrant and moves in a clockwise direction to a point where a further tangential straight portion 682) of equal length as that of all previous and parallel to the said x-axis from whose last point is tangentially subtended a fifth circular arc of equal angular magnitude as said previous and of a clockwise direction and residing in it's fourth quadrant. Tangentially extended from last extremity and for a straight length an angular measurement less than 90 degrees to the x-axis and equal in length to its previous two at whose extremity is tangentially subtended a final circular arc of equal radius to said previous and residing in it's fourth and first quadrant respectively while moving in an anti clockwise direction and terminating at it's y-axis at which point and tangentially to it is extended a longer straight portion (683) which is parallel to the x-axis and previous straight portion (680) and at whose extremity is tangentially integrally formed and molded the raised and Fielded panel (69) in a diametrically opposed direction to that of the first (69) and at whose extremity tangentially commences another straight portion (684) which is parallel to previous portion (683). Said straight portion (684) extends to a point where a second Female longitudinal jointed seam connector element (67) is tangentially integrally formed and molded and having at its final extremity substantial chiseled pointed edge all as per FIG. 32.

The previous section constitutes a description of the left half portion of the said door opening component unit (49) as illustrated in FIG. 38. The opposite side, specifically that which is it's right side, is identical in shape and size to that of the left side with the exception of said right hand side being in a handed or mirrored position. Specifically a mirrored image reflectional reproduction of the said left side and taken about it's y-y axis. Also integrally formed and molded to said right side configuration also is the provision of two male longitudinal jointed seam connector elements (68) as displayed in FIG. 32. The access opening of the door opening component unit (49) comprises a three tiered access opening closure strip (92) with filleted equal radius curves at it's four interior corners and a substantial internal sheet decking (111) also a substantial external sheet decking (110) and equally spaced three tiered web stiffeners (142) which are integrally formed and molded between said sheet decking and within it's two longitudinal and threshold sides. All said three tiered access opening closure strips (92) are equal in width and height to each other in order to accommodate one standard sized door module (50). These features are shown in FIGS. 38 and 36.

Figure 48:
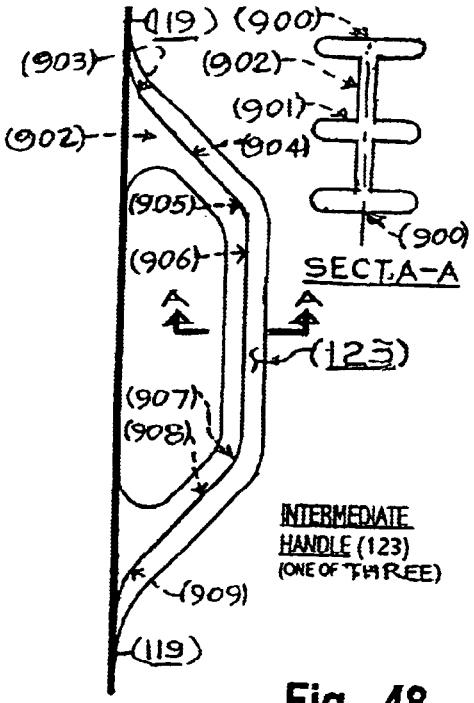
FIG. 48—Shows the intermediate door handle integrally affixed to the internal sheet decking of the door module.
Figure 53:
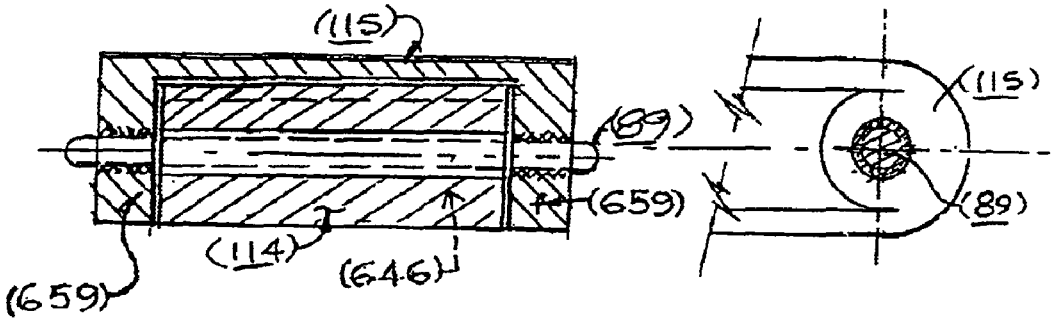
FIG. 53—Shows a sectional assembly detail of the door closing device (86).

Yet another object of the invention is the provision of the intermediate door handles (123) as per the drawings which illustrate embodiments of the invention; and specifically FIG. 48. The door intermediate handle (123) is integrally formed and molded within and upon the innermost surface of the door module (50). One on each longitudinal side and positioned parallel to it also. Approximately at midpoint between the upper and lower door module extremities. The intermediate door handle (123) is configured along it's cross sectional axis substantially as an upper case "I" having two tension/compression flanges (900) and a stiffener bar (901) which is parallel to the first two flanges and positioned at mid point having all three members integrally formed and molded perpendicular to the web member (902) which integrally intersects all three tension and compression stiffeners within their mid sections. Along it's longitudinal axis all three tension and compression stiffeners also the web member are integrally formed and molded within the door module internal sheet decking (119). The said intermediate handle (123) is viewed from top down as per FIG. 48. At it's top extremities where it is configured with an anticlockwise first radius curve (903) which begins and ends in it's third quadrant thus giving rise to an approximately 45 degree incline tangentially and short straight portion (904) about it's transverse axis and perpendicularly about it's longitudinal axis. At it's terminal extremity and tangentially to it a second radius curve (905) of slightly smaller radius than that of the first is configured clockwise which begins in it's first quadrant and ends along it's x-axis where tangentially a further vertical straight portion (906) is configured and is parallel to said interior sheet decking (119) for a longer distance than that of the said previous inclined portion (904). At it's extremity and tangentially to it a third radius curve (907) which is clockwise and equal in radius to the second begins along it's x-axis of the initial side and ends in it's fourth quadrant from which extremity a declined straight portion (908) which is equal in length and diametrically opposed to that of the first short straight inclined portion (904). A fourth and final radius curve (909) which is equal in radius to that of the first radius curve (903) is configured in a anticlockwise direction where it terminates as integrally formed and molded within and upon the surface of the said door module internal sheet decking (119). Another intermediate door handle (123) of identical configuration and size is integrally formed and molded within and upon the opposing longitudinal side of said door module (50) external sheet decking (118). Specifically located upon the right hand side and having it's longitudinal axis in parallel alignment integrally formed and molded in a vertically upright position with the longitudinal alignment of said door module (50) and approximately mid way it's height.

A further object of the invention is the provision of the jointed seam intersection socket (1000) functionally accommodating the aforementioned jointed seam connector elements at four-way converging locations, and similar in function to its three-way counterpart, the female longitudinal jointed seam connector sockets (84) which are integrally affixed to the door component side (22), and rear wall component side (26).

Figure 85:
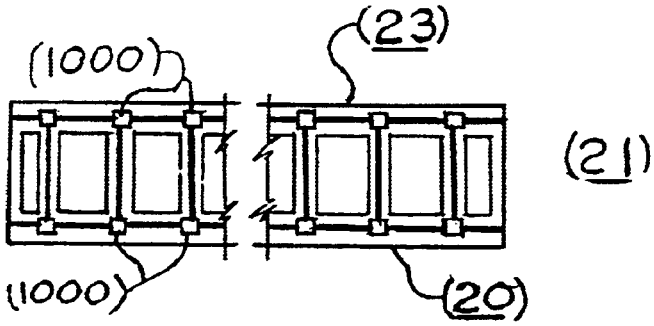
FIG. 85 shows a miniature diagrammatic cut view of the side elevation of a typical chamber showing direction of jointed seam lines, having intersection sockets (1000)

The intersection sockets (1000) are apparent on each of two side wall component sides (21) and integrally sealed between aforementioned roof component side (23), and aforementioned floor component side (20), as per FIG. 85.

The jointed seam intersection sockets (1000) are integrally formed and molded adjacent to each floor and roof sheet deckings' transverse extremity (1003) and jointed seam connector elements (65) and (67), specifically where two said female jointed seam connector elements (65) and (67) converge perpendicularly on said sheet decking, internally and externally as per FIGS. 81, 82, 85, and 86.

Figure 80:
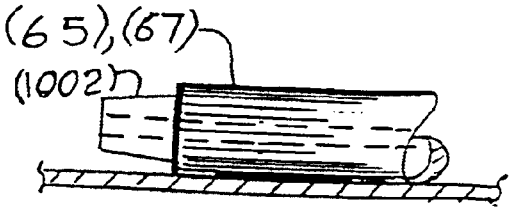
FIG. 80 shows a cut portion of the side elevation of a typical female jointed seam connnector (65), (67) integrally formed and molded within its sheet decking and having a spigot end (1002)
Figure 76:
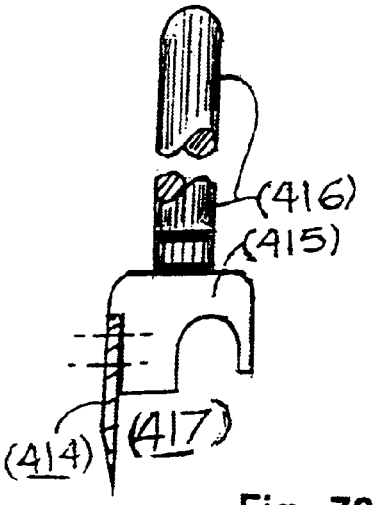
FIG. 76 displays a cutting knife (417) for disassembly.
Figure 81:
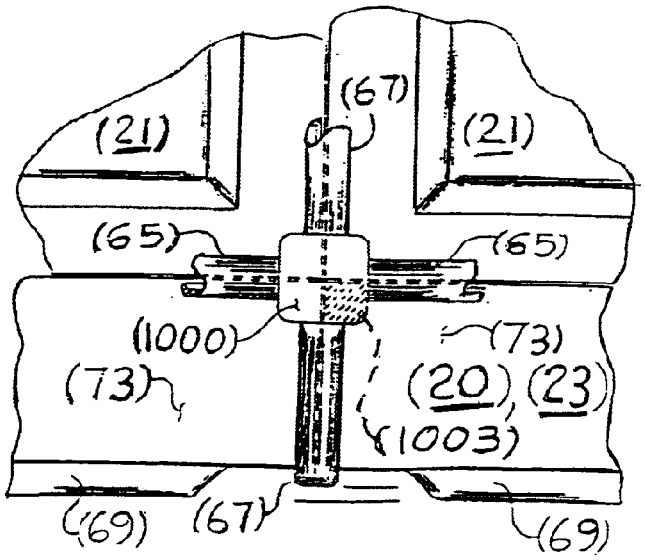
FIG. 81 shows an elevational view of the lower seam intersection socket (1000) adjacent to a portion of the floor component side (20) and side wall component side (21)
Figure 82:
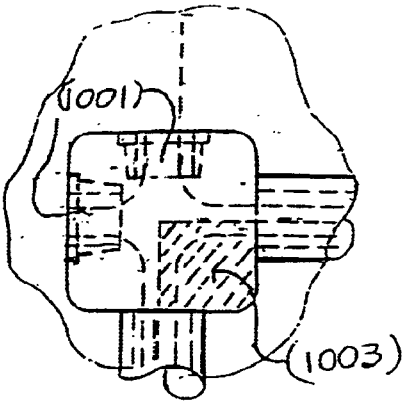
FIG. 82 is a detailed elevational view of a typical jointed seam intersection socket (1000) showing its two tapered socket receptacles (1001), and two integrally affixed female jointed seam connector elements (65) and (67)
Figure 86:
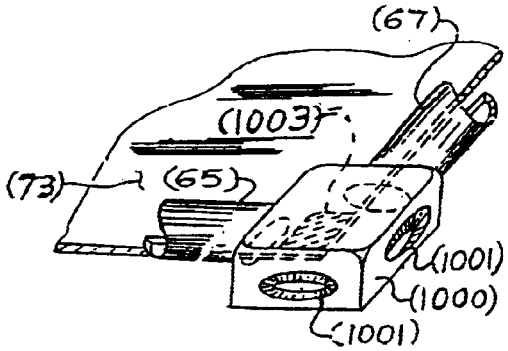
FIG. 86 displays a perspective view of a typical seam intersection socket (1000), having two tapered socket orifices (1001) integrally affixed to (1003)

The jointed seam intersecting socket (1000) having on its two opposing sides to those as previous, tapered orifices (1001) as per FIGS. 82 and 86, and so configured to house mating tapered ends (1002) as per FIG. 80.

Figure 83:
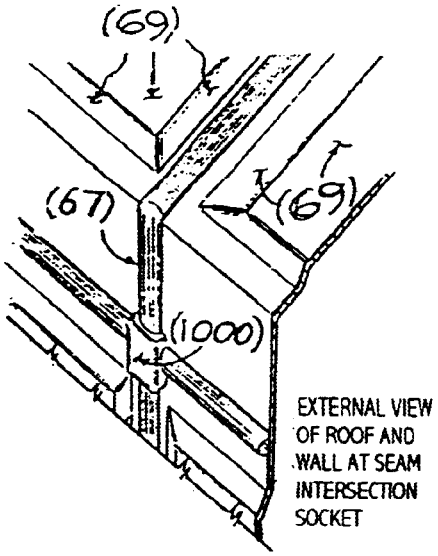
FIG. 83 shows a part perspective view of a typical external finished roof to wall jointed seam having said seam intersection socket (1000)
Figure 84:
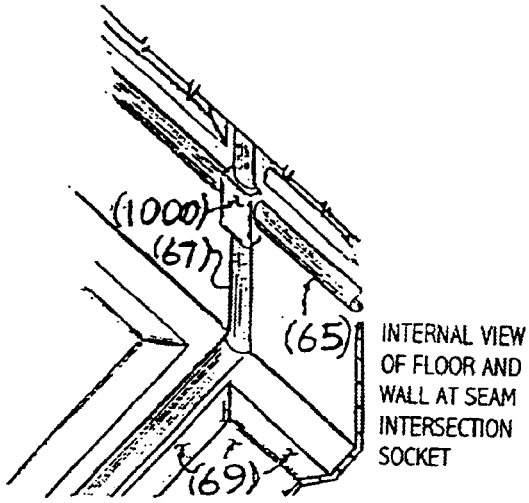
FIG. 84 is a similar view of that of FIG. 83, revealing internal part floor to wall jointed seam.

The roof and floor intersection sockets (1000) will be so located in position on the aforementioned sheet decking so as to be in axial vertical alignment with each other specifically said roof to said side walls and to said floor, internally and externally as illustrated in FIGS. 83 and 85.

Assembly of a Typical Enclosure

While a number of different assembly methods might be used, the preferred method of assembly of an enclosure begins with the manufacture and prefabrication of all modules and component units for all component sides of the enclosure. This process is performed within the manufacturing plant. In accordance with the prefabrication of the floor and roof module and component units the stiffener rib assembly is positioned within the cavity surface of the external sheet decking and indexed and registered within it's four set square up-stand registers having all it's corrugated openings (129) indexed and registered and axially centralized upon the longitudinal and transverse deflection stiffeners (72) and (71) respectively within the confines of raised panel of the raised and fielded panel (69). The internal sheet decking is then positioned upon also indexed and registered within the stiffener rib assembly and in a similar manner. An approved solvent sealant of conventional construction is then applied to contacting surfaces of the internal sheet decking sealing strips (83) and the end enclosure strips (73) and (95). A specified uniform pressure is then applied to said sealing surfaces. The preceding activities constitutes the prefabrication process of any typical module or component unit.

In accordance with the prefabrication of the wall module and component unit stiffener rib assembly is assembled and positioned upon and within the cavity surface of the wall external sheet decking where it is indexed and registered upon it's set square registers. The internal sheet decking is then positioned upon the stiffener rib assembly where it's set square registers are indexed and registered within said stiffener rib assembly. A solvent sealant of approved quality is then applied to the contact surfaces of the upper and lower transverse ends enclosure channels and the corresponding contact cavity surfaces of the internal and external sheet decking. Both upper and lower substantially U-shaped end enclosure channels are then aligned in position and subjected to a uniformly distributed pressure in order to effect integrally sealed extremities.

The desired overall width of the enclosure is the controlling dimension that will dictate the selection and sizing of the modules and component units with which the enclosure will be assembled. This is indicative of the distance measured along the longitudinal axis of the floor and roof intermediate modules and component units The module and component units are then selected and sized relative to the component sizing schedule and then preassembled to form each component side. Each component side may be sealed at it's extremities and vacuum tested prior to assembly within the enclosure. If conditions are conducive in terms of easy access to enclosure site installation location (e.g. size of door openings are elevator size etc.) Then component sides may be assembled within the plant and transported to the site for final assembly thus enhancing speed and efficiency of assembly.

During the assembly of modular members and component units an approved sealing solvent is applied to the contact surfaces of both male and female longitudinal jointed seam connector elements (67) of adjacent members Both module/component unit is then aligned along a vertical and horizontal plane and snapped into position via said jointed seam connector elements. The air vent holes along the shafts of both male and female jointed seam connector elements are also in alignment with each other at this point. The jointed connection is then allowed to dry undisturbed. This process is performed for all modular members and component units thus forming each component side. At the installation location the assembled floor component side is placed into position with the rubber gasket seating cushion in place on all upper and lower extremities of all wall component sides and the door component side each component side is now ready for installation within and upon the floor component side. The approved sealing solvent is then applied to all the contact areas of both the male and female horizontal seam connector elements of one component side and the specific installation location upon the floor component side respectively. The specific component side is then placed into position upon and between both outer and inner female fastener tracks of the floor component side and simultaneously having both male and female horizontal seam connector elements aligned with each other and adjacently with the opening of the female horizontal seam connector element with all air vents on both connector shafts aligned A moderate downward pressure is then applied to the wall component side thus resulting in it snapping into place via a close tolerance sliding fit and subjecting the rubber gasket seating cushion located at the lower ends of the wall component side to minimal compressive stresses. The roof component side will be installed upon the wall and door component sides in an identical manner as that of the floor to wall component sides. Each component side that is installed is temporarily held in a laterally stabilized position until assembly installation is complete and jointed seams are properly dried. A specified jointed sealant—"melt" of an approved polymeric plasticized filler compound will be injected within the core of all horizontal and longitudinal jointed seam connectors via a high pressured pneumatic glue gun at a specified high temperature thus filling all the inner surfaces as the air is expelled from the core via it's vented holes (94). The system is now vacuum pressure tested and minor repairs effected until specified pressure is attained and sustained.

On completion of assembly and pressure testing the structural stiffener braces (70) will be manually cut to their specific lengths and shapes and also in four equal pieces internally and also an additional four pieces externally all in accordance with the size of the enclosure in order to effect diagonal bracing both internally and externally. Diagonal structural stiffener braces (70) will be erected and integrally affixed upon each and every sheet decking both internally and externally and upon all component sides of said enclosure by the use of an approved bonding solvent applied to all it's contact surfaces.

Disassembly, Remodel, Resize, Relocate and/or Reassembly of the Enclosure

The structure of the Enclosure of the present invention is virtually self contained, and hence may be disassembled, remodeled, resized, relocated, and/or reassembled. This may be implemented by first depressurizing said enclosure via the vacuum pressure valve (159) which is located within the enclosure (10), as well as the door module (50). All internal equipment and detachables which include, Instrumentation and Controls Panel (325), Fine copper mesh (400) if so equipped, sound absorbing materials (403) from all surfaces, and continuous floor overlays, must be removed.

Figure 33:
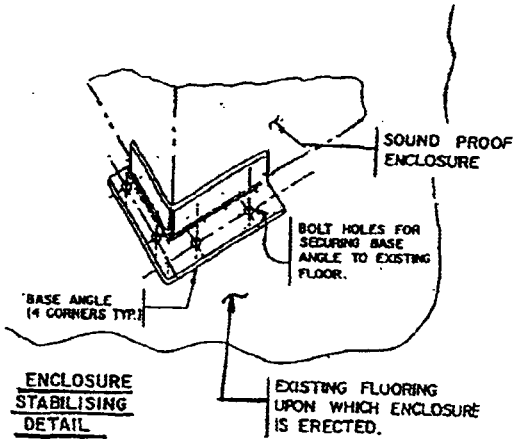
FIG. 33—Shows a typical enclosure corner detail—(one of four).

On stripping said enclosure to its sheet decking, preparation may now be made to partially disassemble, or in parts, by detaching all grounding conductors (405) and relevant utility connections, including corner brackets as per FIG. 33.

Figure 68:
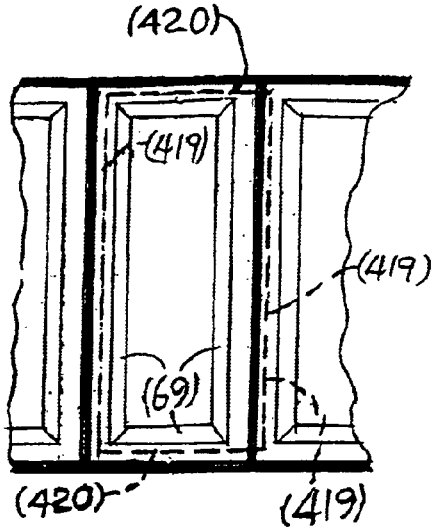
FIG. 68 reveals an elevational view of one modular bay.
Figure 66:
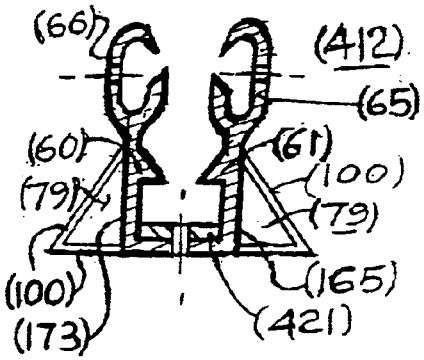
FIG. 66 shows a Transverse Sectional view of the Female Horizontal Seam Connector base channels (412), and corner channels (413).
Figure 69:
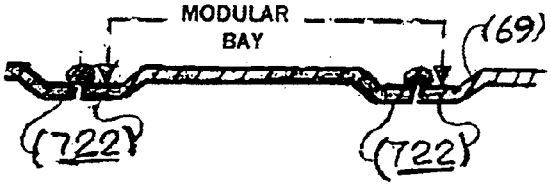
FIG. 69 is a sectional view of one modular bay.
Figure 65:
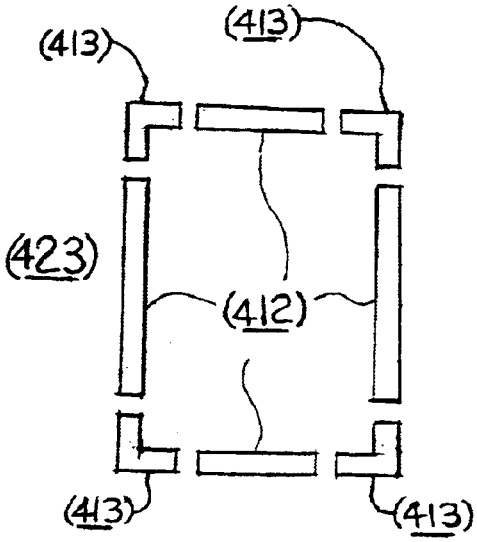
FIG. 65 displays an exploded view of the Female Horizontal Seam Connector base channels (412), and Female Horizontal Seam Connector base corners (413).
Figure 70:
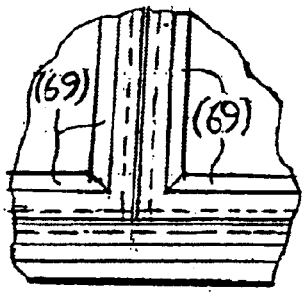
FIG. 70 shows a part elevational view of the vacuum surface of the external sheet decking viewed from within the enclosure.
Figure 72:
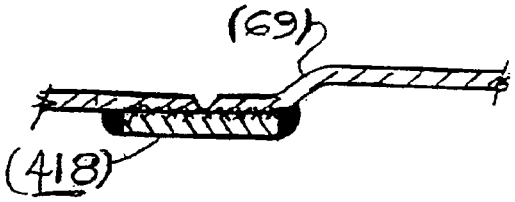
FIG. 72 shows a cut and integrally spliced sheet decking detail.
Figure 73:
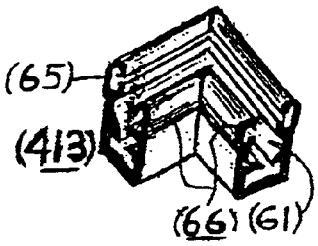
FIG. 73 displays an axhonometric view of a Female horizontal seam connector base corner (413).
Figure 74:
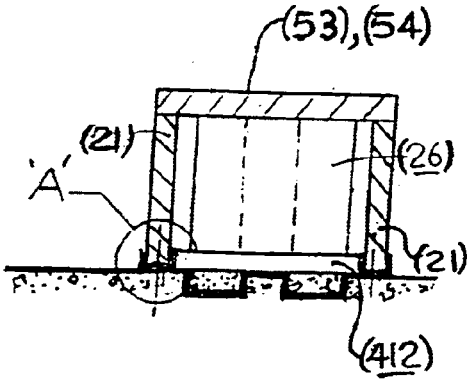
FIG. 74 shows an assembled cross sectional view of the chamber, as described in FIG. 71.
Figure 71:
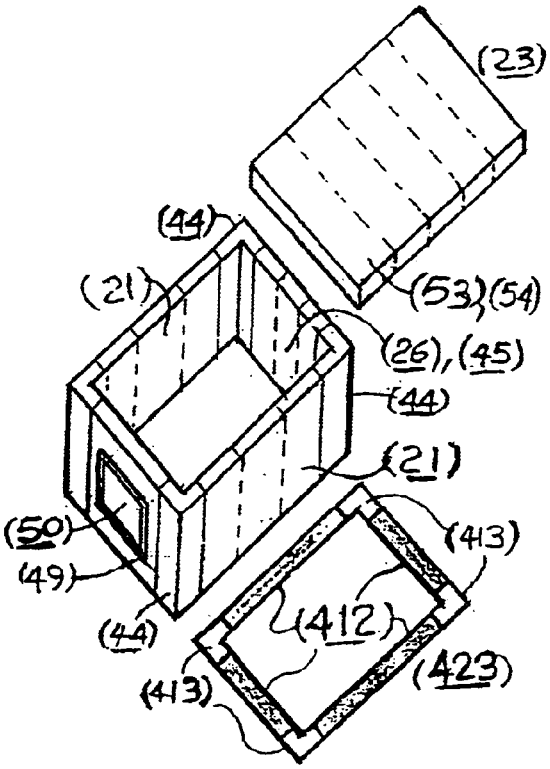
FIG. 71 displays an exploded view of a typical "THINK TANK NOISE SUPPRESSION CHAMBER" (450) Assembly.
Figure 75:
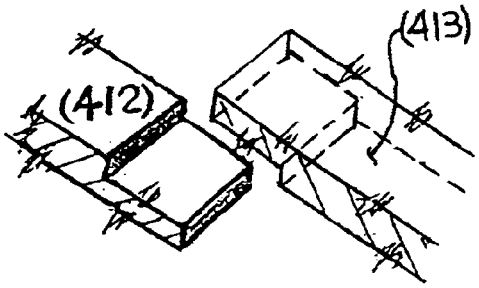
FIG. 75 shows a typical "sealing lip" portion of both Transverse ends of base corner (413) and base channel (412).
Figure 78:
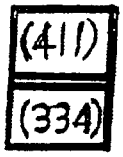
FIG. 78 reveals an air exchange—air revitalization system means (334), and a temperature air conditioner (411)
Figure 79:
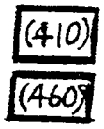
FIG. 79 shows the inclusion of an all frequency scanner (410), and a vacuum pump (460)
Figure 77:
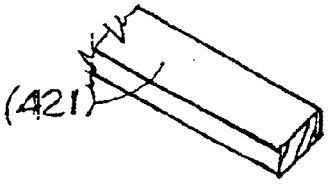
FIG. 77 shows a part continuous base channel anchor strip (421)

A convenient modular bay will be chosen within the Enclosure comprising a specific internal floor sheet decking and Internal vertically adjacent Walls Sheet Decking and corresponding Roof Sheet Decking, each located in corresponding structural vertical alignment with each other. Each line (419) precision marked between, and parallel to said Raised and Fielded Panel (69), and adjacent said Jointed Seam Connector in such a position (684), (720), (722) as per FIGS. 38 and 5 respectively, in identical positioned location upon corresponding sheet decking within adjacent modular bay and circumventing the internal vertical perimeter and parallel to direction of said floor and roof modules, of said enclosure. Reference is made in particular to FIGS. 68 and 69.

The above procedure will be implemented on the opposing longitudinal side, in parallel and similar manner, and in position of aforementioned chosen modular bay, whereby two sheet decking, adjacently joined along their longitudinal sides will be affected, for each component side to be dismembered within said modular bay, as per FIGS. 68 and 69.

An appropriate aforementioned cutting tool (417) will be skillfully used with cutting edge (414) inserted to within the thickness of said Floor Sheet Decking, and a precision straight cut made upon said precision marked line adjacent to its longitudinal edge, and from near one transverse end of said Sheet Decking, to the opposite transverse near end of said Sheet Decking. Said cutting tool (417) will subsequently cut perpendicularly to previous cut (420), parallel and between the transverse end of said sheet decking wall, and roof to wall jointed seam connector, and next the opposing transverse end (420) of said sheet decking wall, and wall to floor jointed seam connector, as per FIG. 68.

This process will be repeated on the opposite longitudinal side (419) of said adjoining Internal Sheet Decking, and circumventing the internal perimeter of the Enclosure and in like manner as previous. The aforementioned cut Internal Sheet Decking will then be individually removed. The aforementioned Stiffener Rib assembly within all component sides of said Modular Bay, will subsequently be carefully removed and disassembled.

On removal of the specific internal modular bay, and stiffener rib assemblies, the accessible cavity surfaces of the External Sheet Decking, as being visible from the interior of the Enclosure as per FIG. 69, will now be precision marked and cut in similar manner as before, and in corresponding position as its Internal Sheet Decking counterpart, with a similar cutting tool.

The above process of disassembly may be repeated within said enclosure and at other Modular Bay locations, depending on the intended reason and circumstances for disassembly of the Enclosure.

Reassembly may now be implemented by incorporating the necessary changes within the partly dismantled enclosure by way of relocating, resizing, remodeling, as the need requires.

Resizing and reassembly may be implemented by cutting a new sheet decking of equivalent height, along its longitudinal extremity, of equal distance from said raised and fielded panel within its narrow portion (722), as that of aforementioned sheet decking that is being added upon. Said new sheet decking is now considered an additional modular bay, and will be installed in a vertical plane, around the vertical perimeter of said enclosure. Additional modular bays may be assembled in like manner. Aforementioned cut portions in position (722) will be spliced as per figure (72) of drawing sheet 15. By applying a resealing strip (418), of similar material to said sheet decking, with an approved solvent sealant and applied uniformed pressure to the outer surface of said resealing strip, until integrally bonded and sealed.

Other Features

In a preferred feature, the Instrumentation and Controls Console Panel (325) comprises:

Console Cabinet (336)

Console Cabinet Lock (337) affixed to (338)

Cabinet Door (338) mounted on (336)

AC Electrical Receptacle (329) of conventional construction—mounted on (336)

Barometric Pressure Gage (326) of conventional construction—mounted on (336)

Vacuum Pressure gage (327) of conventional construction—mounted on (336)

Humidity gage (328) of conventional construction—mounted on (336)

Timer (331) of conventional construction—mounted on (336)

Electric Lighting Toggle Switch (330) of conventional construction—mounted on (336)

Exchange Controller (339)—mounted on (336).

Four DC Electrical female outlet jacks (340)—mounted on (336)

These features will be described in detail hereinbelow.

Figure 60:
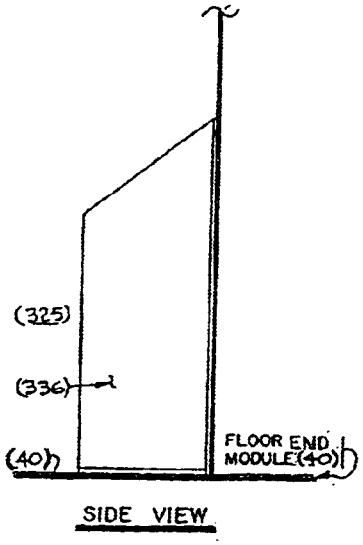
FIG. 60—Shows a side elevation of the console cabinet (336).
Figure 61:
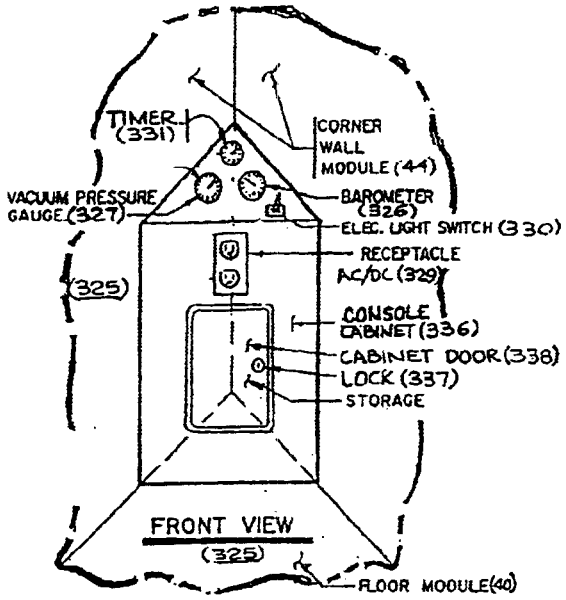
FIG. 61—illustrates a front elevational view of the console cabinet with instrumentation in place.
Figure 62:
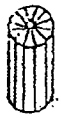
FIG. 62—Illustrates a filtration silencer for installation within acoustic collar of FIG. 58.
Figure 59:
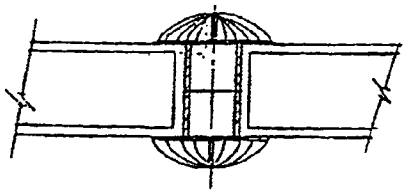
FIG. 59—Displays detail showing acoustic collar in place.

The Control Console Cabinet (336) will be preferably formed and molded with a triangular configuration as per FIGS. 60 and 61. Of whose rear areas will be formed open specifically that which is adjacently mounted to the aforementioned wall corner module (44) and will be surface mounted within either said wall corner module specifically to the innermost surface of the internal sheet decking (105) to that which is adjacent to the door component side (22). This console panel will possess cutouts in which the aforementioned instrumentation will be surface mounted. That which is required to facilitate the functional performance of the system.

Provisions will be made so as to preferably house via surface mounting a Barometric Pressure Gauge (326) of conventional construction to be installed within said control console cabinet for the purpose of verifying the appropriate atmospheric pressure from within the said enclosure at all times. The purpose of this is to assist in maintaining the appropriate working vacuum pressure within the system.

Provisions must be made in order to preferably accommodate a vacuum Pressure Gauge (327) of conventional construction to within the said control console cabinet which will be surface mounted within said cabinet for the purpose of verifying and maintaining the specified vacuum working pressure within the system.

Allowance will be made to preferably accommodate an Air Exchange Controller (339) that will be installed within the aforementioned control console cabinet for the purpose of managing the quality of air mixture within the confines of said Enclosure (10).

Allowance will be made so as to preferably accommodate a Humidity Gauge (328) of conventional construction to be surface mounted within the said control console panel (336) for the purpose of assisting in maintaining an acceptable level of comfort resulting from temperature changes within the said Enclosure.

Provisions will be made to preferably accommodate an AC Dual Receptacle (329) of conventional construction to be mounted within said control console cabinet (336).

Provision will be made to preferably accommodate an AC single inlet External power supply plug (335) to be located at the bottom corner of door opening component unit (49) adjacent to the control panel (336).

Provisions will be made for preferably accommodating within said control cabinet four DC Electrical female outlet jacks (340) of conventional construction.

Allowance will be made to preferably accommodate an electrical roof light switch (330) of conventional construction to be mounted within said control console cabinet (336).

Provisions will be made to preferably accommodate a Timer (331) of conventional construction within said cabinet for the purpose of monitoring the duration of use during occupancy and in order to fulfill other utility uses.

Other miscellaneous, or optional, accessories of Conventional Construction, which might be used in the fabrication of the enclosures of the present invention can include the following, namely:

A stand-alone temperature air conditioner

All frequency scanner

Electrical conductor with ground (407)—affixed to (406)

Electrical conductor retainers (406)

Heavy duty electrical grounding cables (405) affixed to (400)

AC/DC electrical lighting fixture

Approved high quality acoustic sheeting (403)

Thermoplastic/thermosetting stand-offs (401)

Thermoplastic/thermosetting stand-offs with stud (404)

Finishing cap screws—conventional construction

External single male AC power supply plug (335)

DC electrical illuminated "OCCUPIED" sign affixed to (110)

Continuous laminated sheeting ply or equivalent (409)

Vacuum Pump—of a type according to the Prior Art (460)

Attenuated Muffler Air Exchange System and/or Air Revitalization (334)

Figure 64:
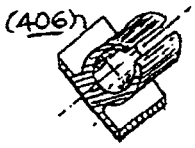
FIG. 64—Illustrates a typical surface mounted electrical conductor retainer (406).
Figure 67:
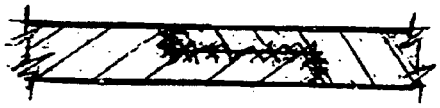
FIG. 67 shows a sectional detail of a "lip weld".

Provisions will be made to accommodate an insulated electrical conductor (407) from within said enclosure by means of surface mounted approved thermoplastic or thermosetting electrical conductor retainers (406) as per FIG. 64 which will be affixed to the innermost surfaces of said Enclosure by means of an approved bonding solvent.

Provisions will be made to accommodate a non metallic electrical lighting fixture of conventional construction to be surface mounted within said enclosure (10).

A Fine Copper Mesh or approved equivalent sheeting (400) of conventional construction will be provided and hung from within all walls door and roof component sides innermost surfaces of the said enclosure by means of aforementioned stand-offs (401) which are uniformly integrally affixed to said innermost surfaces by means of an approved bonding solvent. Applicable exclusively to THINK TANK—MARK II. Above and on top of the innermost surface of the floor component side and spanning wall to wall will be laid a continuous laminated sheeting ply (409) of conventional construction upon which will be laid said metallic mesh (400) securely fixed and overlapping at the corners.

An approved high quality acoustic sheeting (403) of conventional construction will be provided and hung from within all innermost surfaces of the wall door and roof component sides of the said enclosure by means of the aforementioned stand-offs (401) as in the case of THINK TANK—MARK I and secured with finished cap screws (402). Above and on top of the innermost surface of the floor component side and spanning wall to wall will be laid a continuous laminated ply sheeting (409) of conventional construction upon which will be laid said high quality sheeting (403) and spanning wall to wall.

Approved thermoplastic or thermosetting stand-offs (401) will be provided and integrally affixed in a uniform manner to the innermost surfaces of the enclosure to which the aforementioned acoustic sheeting (403) will be securely hung. Said stand-offs will be about 40 mm in diameter and of adequate length to clear the innermost surfaces of all structural stiffener braces (70). Said stand-offs (401) will be integrally affixed by means of an approved bonding solvent as per FIG. 54.

Finished Cap Screws (402) of conventional construction will be provided for the purpose of securing said acoustic sheeting (403) to aforementioned stand-offs (401) or stand-offs (404). The former in the case of THINK TANK—MARK I. The latter applicable in the case of THINK TANK—MARK II as per FIGS. 54, 55 and 56.

An AC Single Electrical power supply plug (335) of conventional construction to be installed within the lower extremities of the door opening component unit (49) specifically it's substantial external sheet decking (110) and substantially near to the location of the aforementioned control console panel (336).

The aforementioned Enclosure (10) will be provided with an Attenuated Muffler Air Exchange System (334) for the purpose of providing the allowance of the air exchange within the enclosure at regular intervals during use. As such, the chamber may comprise an air exchange system which passes through the wall, floor or roof of said chamber and allows for air to be circulated to and from the inside to the outside of said chamber. More preferably, however, the chamber is self contained, and the chamber preferably comprises an air revitalization system internal to said chamber in order to supply fresh air to the occupants of the chamber.

A DC electrical illuminated "OCCUPIED" sign to be surface mounted on the substantial external sheet decking (110) specifically within the Lintel area of said Door opening component unit's sheet decking.

Thus, it is apparent that there has been provided, in accordance with the present invention, a sound proof chamber which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Further, while this discussion has addressed prior art known to the inventor, it is not an admission that all art discussed is citable against the present application.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Moreover, use of the terms "he", "him", or "his", is not intended to be specifically directed to persons of the masculine gender, and could easily be read as "she", "her", or "hers", respectively.

What is claimed is:

1. A sound transmission restricting chamber for reducing the transmission of sound between the outside of said chamber and the inside of said chamber, comprising a plurality of interconnected modular components which essentially surrounds an area in order to form said chamber, wherein a plurality of said modular components comprise an inner wall surface, an outer wall surface, an edge frame structure jointing said inner wall surface to said outer wall surface, which edge frame structure extends around the perimeter of said modular component, wherein a cavity is formed between said inner and said outer wall surface, and wherein said edge frame includes a seal for sealing one component to an adjacent second component, wherein air is withdrawn from each of said modular components in order to establish at least a partial vacuum within the cavities of said interconnected modular components, and wherein each edge frame comprises at least one depressurization opening which can be positioned operatively adjacent to a depressurization opening on an adjacent edge frame from an adjacent modular component, in order to interconnect said modular components, whereby air can be simultaneously extracted from at least two of said modular components.

2. A chamber as claimed in claim 1 wherein said modular components are used to construct walls and roof for said chamber, and all of said modular components are interconnected.

3. A chamber as claimed in claim 1 wherein said modular components are used to construct walls, roof and a floor for said chamber, and all of said modular components are interconnected.

4. A chamber as claimed in claim 1 wherein said depressurization opening comprises one or a plurality of holes which allow air to be withdrawn from said components, and wherein said holes are located on a surface of said edge frame structure so that they are operatively adjacent to the holes of an adjacent component, and, in use, are sealed so as to prevent air from entering or exiting said component from other than said adjacent component.

5. A chamber as claimed in claim 4 wherein module is sealed using a flexible seal membrane located on an inner and outer edge of each of each of said modules, and wherein the inner and outer seal membrane of one module are aligned, in operation, to be operatively adjacent to a corresponding inner an outer seal membrane of an adjacent module in order to form a mated seal structure.

6. A chamber as claimed in claim 5 wherein each of said inner and outer seal membrane comprise a substantially elliptical section, which sections are mated together in operation to form a seal structure such that said substantially elliptical sections together form a seal structure having a hollow conduit within said seal structure.

7. A chamber as claimed in claim 6 wherein said seal structure comprises at least one opening into which a sealant can be injected into said hollow conduit.

8. A chamber as claimed in claim 1 wherein said modular components are fabricated from plastic, and are fabricated in a variety of standard components which components are essentially identical in shape and size.

9. A chamber as claimed in claim 1 additionally comprising a metal mesh which essentially surrounds said chamber in order to reduce or eliminate the transmission of selected electromagnetic frequencies between the inside and outside of said chamber.

10. A chamber as claimed in claim 9 wherein said metal mesh is located within said chamber, and is affixed to the inner wall surface.

11. A chamber as claimed in claim 1 wherein said modular components include a straight panel component wherein the inner and outer walls are essentially straight, and corner panel components wherein said inner and outer walls have panels which include an essentially right angle bend.

12. A chamber as claimed in claim 1 additionally comprising a door module which includes a door structure for entry into, and exit from said chamber, wherein said door structure has an inner wall and an outer wall which defines a door cavity therebetween, which door cavity is maintained under vacuum, and further, has a seal around said door structure for sealing said door structure to said door module.

13. A chamber as claimed in claim 1 wherein said chamber additionally comprises an air exchange system which passes through the wall, floor or roof of said chamber and allows for air to be circulated to and from the inside to the outside of said chamber.

14. A chamber as claimed in claim 1 wherein said chamber additionally comprises an air revitalization system internal to said chamber.

15. A chamber as claimed in claim 1 wherein said chamber is fitted with an all frequency scanning means for detecting electronic eavesdropping.

16. A sound transmission restricting chamber for reducing the transmission of sound between the outside of said chamber and the inside of said chamber, comprising a plurality of interconnected modular components which essentially surrounds an area in order to form said chamber, wherein a plurality of said modular components comprise an inner wall surface, an outer wall surface, an edge frame structure jointing said inner wall surface to said outer wall surface, which edge frame structure extends around the perimeter of said modular component, wherein a cavity is formed between said inner and said outer wall surface, and wherein said edge frame includes a seal for sealing one component to an adjacent second component, wherein air is withdrawn from each of said modular components in order to establish at least a partial vacuum within the cavities of said interconnected modular components, and additionally comprising a window module which includes a window structure having an inner transparent panel and an outer transparent panel, and a window edge structure, which transparent panels and window edge structures define a window cavity therebetween, and wherein said window edge structure includes at least one opening for operatively connecting said window cavity to said cavity within said modular component so that air can be removed from said window cavity into said modular cavity.

* * * * *